US008916318B2

(12) United States Patent
Hasegawa et al.

(10) Patent No.: US 8,916,318 B2
(45) **Date of Patent: *Dec. 23, 2014**

(54) BLACK TONER CONTAINING COMPOUND HAVING AZO SKELETON

(71) Applicant: Canon Kabushiki Kaisha, Tokyo (JP)

(72) Inventors: Yuki Hasegawa, Yokohama (JP); Yasuaki Murai, Kawasaki (JP); Waka Hasegawa, Kawasaki (JP); Takayuki Toyoda, Yokohama (JP); Masashi Kawamura, Yokohama (JP); Masatake Tanaka, Yokohama (JP); Masashi Hirose, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/777,361

(22) Filed: Feb. 26, 2013

(65) Prior Publication Data

US 2013/0224644 A1 Aug. 29, 2013

(30) Foreign Application Priority Data

Feb. 29, 2012 (JP) ..... 2012-043071

(51) Int. Cl.
*G03G 9/09* (2006.01)
*G03G 9/08* (2006.01)
*G03G 9/087* (2006.01)

(52) U.S. Cl.
CPC ..... *G03G 9/08* (2013.01); *G03G 9/08751* (2013.01); *G03G 9/091* (2013.01); *G03G 9/0806* (2013.01); *G03G 9/08768* (2013.01); *G03G 9/0904* (2013.01)
USPC ..... 430/108.22

(58) Field of Classification Search
CPC ..... G03G 9/08751; G03G 9/08768; G03G 9/091; G03G 9/0904
USPC ..... 430/108.22
See application file for complete search history.

(56) References Cited

U.S. PATENT DOCUMENTS

| | | | | |
|---|---|---|---|---|
| 8,377,616 | B2 * | 2/2013 | Tani et al. | 430/108.23 |
| 2011/0045398 | A1 | 2/2011 | Sekikawa | |
| 2011/0076606 | A1 * | 3/2011 | Kamiwaki et al. | 430/108.21 |
| 2013/0095421 | A1 * | 4/2013 | Tanaka et al. | 430/108.23 |
| 2013/0224645 | A1 * | 8/2013 | Toyoda et al. | 430/108.22 |
| 2013/0224646 | A1 * | 8/2013 | Murai et al. | 430/108.22 |

FOREIGN PATENT DOCUMENTS

| | | | |
|---|---|---|---|
| CN | 1197939 | A | 11/1998 |
| CN | 102334072 | A | 1/2012 |
| EP | 869398 | A2 | 10/1998 |
| JP | 06-148927 | A | 5/1994 |
| JP | 3285623 | B2 | 5/2002 |
| JP | 4510687 | B2 | 7/2010 |
| JP | 2010-529502 | A | 8/2010 |
| WO | WO 2012026378 | A1 * | 3/2012 |

OTHER PUBLICATIONS

Diamond, Arthur S & David Weiss (eds.) Handbook of Imaging Materials, 2nd ed . . . New York: Marcel-Dekker, Inc. (Nov. 2001) pp. 178-182.*

* cited by examiner

*Primary Examiner* — Christopher Rodee
(74) *Attorney, Agent, or Firm* — Canon U.S.A., Inc., IP Division

(57) ABSTRACT

A toner comprising toner particles, each of which contains a binder resin, a compound in which a polymer portion is bound to an azo skeleton structure are linked, and carbon black. The polymer portion has a monomer unit represented by the Formula (2) that is bound to a structure represented by Formula (1):

Formula (1)

Formula (2)

8 Claims, 5 Drawing Sheets

BLACK TONER CONTAINING COMPOUND HAVING AZO SKELETON

BACKGROUND OF THE INVENTION

1. Field of the Invention

The present invention relates to a black toner containing a compound having an azo skeleton unit as a dispersant for use in electrophotography, electrostatic recording, electrostatic printing, or toner jet recording.

2. Description of the Related Art

As a toner colorant of a black toner, carbon black has been generally used. However, the carbon black has a small primary particle diameter as compared with that of other pigments and forms structures. When the structures are smaller, the carbon black is more difficult to disperse. When the dispersibility of the carbon black in toner particles is insufficient, a reduction in the coloring power of the toner particles is caused. Furthermore, since the carbon black is electrically conductive, the dispersibility of the carbon black also affects the toner chargeability. More specifically, when the dispersibility of the carbon black in toner particles is insufficient, the chargeability of the toner deteriorates due to aggregation and uneven distribution of the carbon black in the toner, exposure onto the toner surface, and the like, which causes "fogging" in which the toner is developed in a blank portion of an image or image defects due to a reduction in the transfer efficiency of the toner.

In order to increase the dispersibility of the carbon black in a toner, various dispersants have been proposed. Japanese Patent No. 3285623 discloses a toner containing a block copolymer or a graft copolymer obtained by polymerizing a styrene monomer and an acrylate monomer (or a methacrylate monomer), carbon black, and a binder resin. On the other hand, PCT Japanese Translation Patent Publication No. 2010-529502 discloses a toner composition containing a modified carbon black to which an organic group having an aryl group is bonded or a carbon black to which at least one kind of a phenyl-containing polymer is attracted. Japanese patent No. 4510687 discloses a method for manufacturing toner particles containing a compound having an amide group and a zinc phthalocyanine compound.

According to methods for attracting the polymers described in Japanese Patent No. 3285623 and PCT Japanese Translation Patent Publication No. 2010-529502 to carbon black, since the affinity with the carbon black of the polymers is insufficient, sufficient dispersibility is not obtained, so that the coloring power of a toner, suppression of fogging, and an improvement of transfer efficiency, and the like required in a high definition image are not satisfied. On the other hand, according to a method for chemically bonding the polymer to the carbon black described in PCT Japanese Translation Patent Publication No. 2010-529502, good dispersibility of the carbon black is obtained by chemically modifying the carbon black beforehand but the manufacturing process becomes complicated, which is disadvantageous in terms of the toner manufacturing cost. According to the manufacturing method using the compound described in Japanese patent No. 4510687, good dispersibility of carbon black is obtained but, in order to satisfy a request for a further increase in image quality of output images in recent years, a black toner in which the dispersibility of carbon black is further improved needs to be provided.

SUMMARY OF THE INVENTION

The present invention provides a black toner in which the dispersibility to a binder resin of carbon black is improved and the coloring power is high. The invention also provides a black toner in which fogging is suppressed and the transfer efficiency is high.

The above-described purposes are achieved by the invention described below. More specifically, the invention relates to a black toner having toner particles, each of which contains a binder resin, a compound and a carbon black as a colorant, the compound has a structure in which a polymer portion having a monomer unit represented by Formula (2) is bound to a structure represented by Formula (1);

Formula (1)

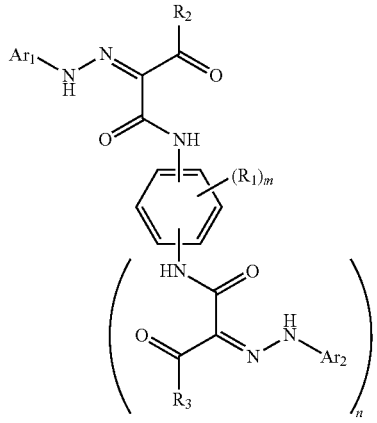

in which, in Formula (1), at least one of $R_2$, $R_3$, $Ar_1$, and $Ar_2$ is bound to the polymer portion directly or through a linking group, wherein $R_1$ each independently represents a hydrogen atom, a halogen atom, an alkyl group, an alkoxy group, a trifluoromethyl group, a cyano group, or a hydroxyl group, $R_2$ and $R_3$ not bound to the polymer portion independently represent a monovalent group selected from the group consisting of an alkyl group, a phenyl group, an $OR_4$ group, and an $NR_5R_6$ group, $R_4$ to $R_6$ independently represent a hydrogen atom, an alkyl group, a phenyl group, or an aralkyl group, $Ar_1$ and $Ar_2$ independently represent an aryl group, wherein any one of $R_2$ and $R_3$ bound to the polymer portion independently represents a divalent group of which a hydrogen atom is removed from the corresponding monovalent group of any one of $R_2$ and $R_3$, any one of $Ar_1$ and $Ar_2$ bound to the polymer portion independently represents a divalent group of which a hydrogen atom is removed from the corresponding monovalent group of any one of $Ar_1$ and $Ar_2$, m represents an integer of 3 or 4, n represents an integer of 1 or 2, and n+m is 5; and Formula (2)

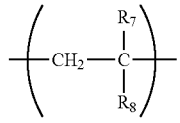

in Formula (2), $R_7$ represents a hydrogen atom or an alkyl group and $R_8$ represents a phenyl group, a carboxyl group, a carboxylic acid ester group, or a carboxylic acid amide group.

Further features of the present invention will become apparent from the following description of exemplary embodiments with reference to the attached drawings.

DESCRIPTION OF THE EMBODIMENTS

Figure 1:
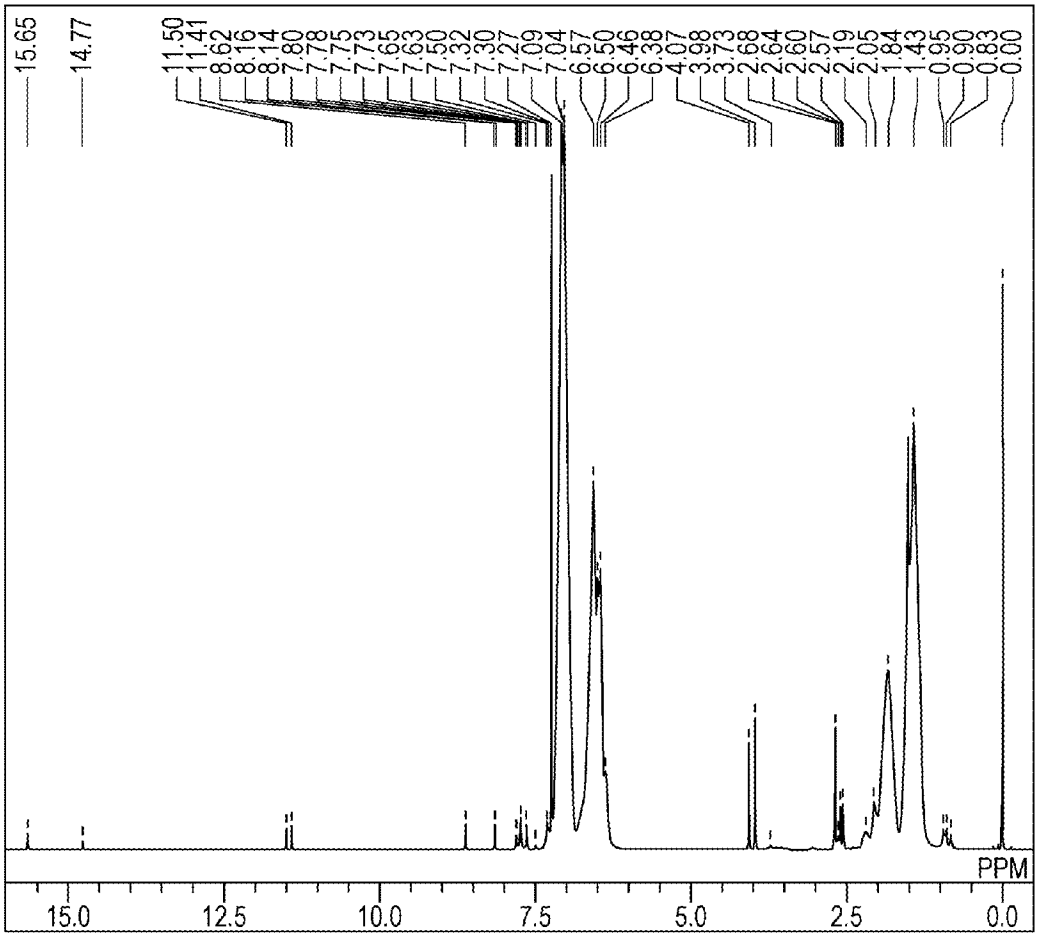
FIG. 1 is a view illustrating the $^1$H NMR spectrum at room temperature and at 400 MHz in $CDCl_3$ of a compound (41) having an azo skeleton unit.

Hereinafter, the invention is detailed in detail with reference to suitable embodiments.

A toner of the invention has toner particles, each of which contains a binder resin, a compound and a carbon black as a colorant, the compound has a structure in which a polymer portion having a monomer unit represented by Formula (2) is bound to a structure represented by Formula (1);

Formula (1)

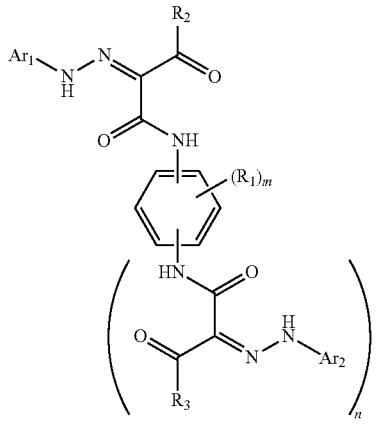

in which, in Formula (1), at least one of $R_2$, $R_3$, $Ar_1$, and $Ar_2$ is bound to the polymer portion directly or through a linking group, wherein each $R_2$ independently represents a hydrogen atom, a halogen atom, an alkyl group, an alkoxy group, a trifluoromethyl group, a cyano group, or a hydroxyl group, $R_2$ and $R_3$ not bound to the polymer portion independently represent a monovalent group selected from the group consisting of an alkyl group, a phenyl group, an $OR_4$ group, and an $NR_5R_6$ group, $R_4$ to $R_6$ each independently represent a hydrogen atom, an alkyl group, a phenyl group, or an aralkyl group, $Ar_1$ and $Ar_2$ independently represent an aryl group, any one of $R_2$ and $R_3$ bound to the polymer portion independently represents a divalent group of which a hydrogen atom is removed from the corresponding monovalent group of any one of $R_2$ and $R_3$; any one of $Ar_1$ and $Ar_2$ bound to the polymer portion independently represents a divalent group of which a hydrogen atom is removed from the corresponding aryl group of any one of $Ar_1$ and $Ar_2$, m represents an integer of 3 or 4, n represents an integer of 1 or 2, and n+m is 5; and Formula (2)

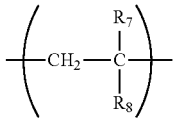

in Formula (2), $R_7$ represents a hydrogen atom or an alkyl group and $R_8$ represents a phenyl group, a carboxyl group, a carboxylic acid ester group, or a carboxylic acid amide group.

The invention provides a black toner containing the compound in which the structure represented by Formula (1) above and the polymer portion having the monomer unit represented by Formula (2) above are linked as a pigment dispersant. The compound has high affinity with a non-water soluble solvent, a polymerizable monomer, and a binder resin for toner and high affinity with carbon black. Therefore, by the use of the compound as a dispersant, a black toner in which the carbon black is favorably dispersed in the binder resin and the coloring power is high is provided. By adding the compound into a black toner, a black toner in which fogging is suppressed and the transfer efficiency is high is provided.

Hereinafter, the unit represented by Formula (1) is also referred to as an "azo skeleton structure". The compound in which the azo skeleton structure is bonded to the polymer portion having the monomer unit represented by Formula (2) is also referred to as a "compound having the azo skeleton structure". In a case where only the polymer portion having the monomer unit represented by Formula (2) to which the azo skeleton structure is not bonded, the portion is also simply referred to as a "polymer portion".

Hereinafter, the invention is described in detail.

First, the composition of the compound having the azo skeleton structure is described. The compound having the azo skeleton unit contains the azo skeleton structure represented by Formula (1) above having high affinity with carbon black and the polymer portion having the monomer unit represented by Formula (2) above having high affinity with a non-water soluble solvent.

First, the azo skeleton unit is described in detail.

As the halogen atom in $R_1$ in Formula (1) above, a fluorine atom, a chlorine atom, a bromine atom, and an iodine atom are mentioned.

As the alkyl group in $R_1$ in Formula (1) above, linear, branched, or cyclic alkyl groups, such as a methyl group, an ethyl group, an n-propyl group, an n-butyl group, an n-pentyl group, an n-hexyl group, an isopropyl group, an isobutyl group, a sec-butyl group, a tert-butyl group, and a cyclohexyl group are mentioned, for example.

As the alkoxy group in $R_1$ in Formula (1) above, linear and branched alkoxy groups, such as a methoxy group, an ethoxy group, an n-propoxy group, an n-butoxy group, and an isopropoxy group, are mentioned, for example.

$R_1$ in Formula (1) above can be arbitrarily selected from the substituents, the trifluoromethyl group, the cyano group, the hydroxyl group, and the hydrogen atom mentioned above and is suitably a hydrogen atom from the viewpoint of the affinity with carbon black.

As the substitution position of an acylacetamide group in Formula (1) above, when m is 4 and n is 1, cases where acylacetamide groups are substituted at the o-position, the m-position, and the p-position are mentioned. The affinity with carbon black when the substitution positions are different as described above is equivalent at the o-position, the m-position, and the p-position. When m is 3 and n is 2, cases where acylacetamide groups are substituted at the 1,2,3-position, the 1,2,4-position, and the 1,3,5-position are mentioned. The affinity with carbon black when the substituent positions are different as described above is equivalent at the 1,2,3-position, the 1,2,4-position, and the 1,3,5-position.

As the alkyl groups in $R_2$ and $R_3$ in Formula (1) above, linear, branched, or cyclic alkyl groups, such as a methyl group, an ethyl group, an n-propyl group, an n-butyl group, an n-pentyl group, an n-hexyl group, an isopropyl group, an isobutyl group, a sec-butyl group, a tert-butyl group, and a cyclohexyl group are mentioned, for example.

The substituents of $R_2$ and $R_3$ in Formula (1) above may be further substituted by a substituent insofar as the affinity with carbon black is not remarkably impaired. In this case, as substituents which may be substituted, a halogen atom, a nitro group, an amino group, a hydroxyl group, a cyano group, a trifluoromethyl group, and the like are mentioned, for example.

As the alkyl groups in $R_4$ to $R_6$ in Formula (1) above, linear, branched, or cyclic alkyl groups, such as a methyl group, an ethyl group, an n-propyl group, an n-butyl group, an n-pentyl group, an n-hexyl group, an isopropyl group, an isobutyl group, a sec-butyl group, a tert-butyl group, and a cyclohexyl group are mentioned, for example.

As the aralkyl groups in $R_4$ to $R_6$ in Formula (1) above, a benzyl group, a phenethyl group, and the like are mentioned, for example.

$R_4$ to $R_6$ in Formula (1) above can be arbitrarily selected from the substituents, the hydrogen atom, and the phenyl group mentioned above.

$Ar_1$ and $Ar_2$ in Formula (1) above represent an aryl group, and a phenyl group, a naphthyl group, and the like are mentioned. The substituents may be further substituted by a substituent insofar as the affinity with carbon black is not remarkably impaired. In this case, as substituents which may be substituted, an alkyl group, an alkoxy group, a halogen atom, a hydroxyl group, a cyano group, a trifluoromethyl group, a carboxyl group, a carboxylic acid ester group, a carboxylic acid amide group, and the like are mentioned, for example.

At least one of $R_2$, $R_3$, $Ar_1$, and $Ar_2$ in Formula (1) is bound to the polymer portion directly or through a linking group. It is preferably bound to the polymer portion through a linking group. Any one of $R_2$ and $R_3$ bound to the polymer portion independently represents a divalent group of which a hydrogen atom is removed from the corresponding monovalent group of any one of $R_2$ and $R_3$. Any one of $Ar_1$ and $Ar_2$ bound to the polymer portion independently represents a divalent group of which a hydrogen atom is removed from the corresponding aryl group of any one of $Ar_1$ and $Ar_2$. In terms of the affinity with carbon black, a case where the unit represented by Formula (1) above is represented by a unit of the following Formula (3) is suitable. More specifically, a case where $Ar_1$ and $Ar_2$ in Formula (1) are phenyl groups and at least one of the hydrogen atoms of the phenyl groups are substituted by the linking group and is linked to the polymer is suitable.

Formula (3)

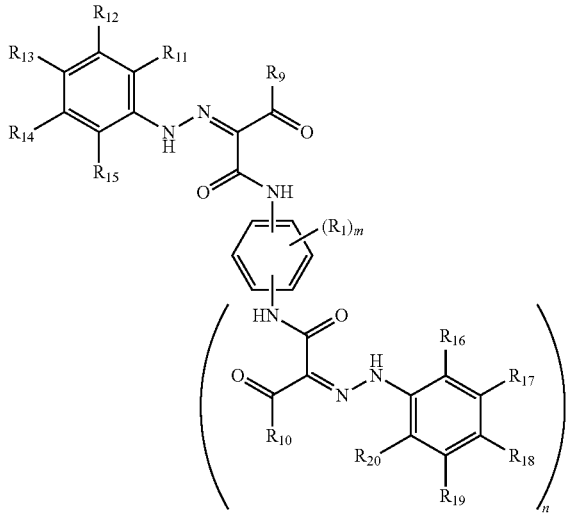

In Formula (3), $R_1$ is synonymous with $R_1$ in Formula (1) above. $R_9$ and $R_{10}$ independently represent an alkyl group, a phenyl group, an $OR_4$ group, or an $NR_5R_6$ group; $R_4$ to $R_6$ are synonymous with $R_1$ in Formula (1) above. $R_{11}$ to $R_{20}$ independently represent a linking group or a monovalent group selected from the group consisting of a hydrogen atom, a $COOR_{21}$ group, and a $CONR_{22}R_{23}$ group. $R_{21}$ to $R_{23}$ each independently represent a hydrogen atom or an alkyl group. At least one of $R_{11}$ to $R_{20}$ is the linking group that binds to the polymer portion. m represents an integer of 3 or 4, n represents an integer of 1 or 2, and n+m is 5.

$R_{11}$ to $R_{20}$ in Formula (3) above can be selected from a hydrogen atom, a $COOR_{21}$ group, and a $CONR_{22}R_{23}$ group. From the viewpoint of the affinity with carbon black, at least one of $R_{11}$ to $R_{20}$ is a $COOR_{21}$ group or a $CONR_{22}R_{23}$ group.

As the alkyl groups in $R_{21}$ to $R_{23}$ in Formula (3) above, linear, branched, or cyclic alkyl groups, such as a methyl group, an ethyl group, an n-propyl group, an n-butyl group, an n-pentyl group, an n-hexyl group, an isopropyl group, an isobutyl group, a sec-butyl group, a tert-butyl group, and a cyclohexyl group are mentioned, for example.

Although $R_{21}$ to $R_{23}$ in Formula (3) above can be arbitrarily selected from the substituents and the hydrogen atom mentioned above. From the viewpoint of the affinity with carbon black, $R_{21}$ is suitably a methyl group, $R_{22}$ is suitably a hydrogen atom, and $R_{23}$ is suitably a methyl group or a hydrogen atom.

As the alkyl groups in $R_{21}$ to $R_{23}$ in Formula (3) above, linear, branched, or cyclic alkyl groups, such as a methyl group, an ethyl group, an n-propyl group, an n-butyl group, an n-pentyl group, an n-hexyl group, an isopropyl group, an isobutyl group, a sec-butyl group, a tert-butyl group, and a cyclohexyl group are mentioned, for example.

Substituents of $R_9$ and $R_{10}$ in Formula (3) above may be further substituted by a substituent insofar as the affinity with carbon black is not remarkably impaired. In this case, as substituents which may be substituted, a halogen atom, a nitro group, an amino group, a hydroxyl group, a cyano group, a trifluoromethyl group, and the like are mentioned, for example.

Although $R_9$ and $R_{10}$ in Formula (3) above can be arbitrarily selected from the substituents mentioned above. From the viewpoint of the affinity with carbon black, $R_9$ and $R_{10}$ are suitably methyl groups.

The structure represented by Formula (3) above is suitably represented by the units of the following Formulae (4) to (7) in terms of the affinity of carbon black. More specifically, a case is mentioned where the azo skeleton structure and the polymer portion are linked through a linking group L as illustrated in the following Formulae (4) to (7).

Formula (4)

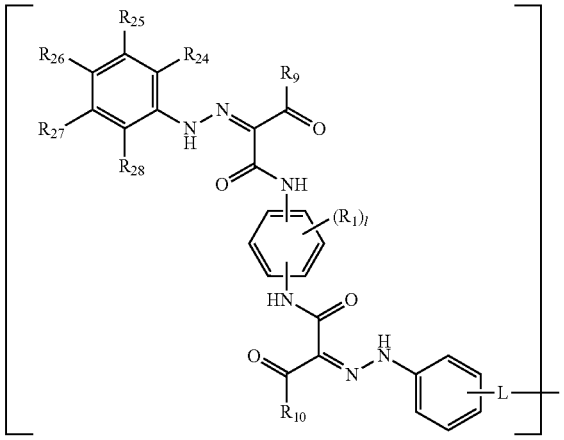

In Formula (4), $R_1$ is synonymous with $R_1$ in Formula (1) above. $R_9$ and $R_{10}$ are synonymous with $R_9$ and $R_{10}$ in Formula (3) above. $R_{24}$ to $R_{28}$ independently represent a hydrogen atom, a $COOR_{21}$ group, or a $CONR_{22}R_{23}$ group; $R_{21}$ to $R_{23}$ are synonymous with $R_{21}$ to $R_{23}$ in Formula (3) above. 1 is 4. L represents a divalent linking group that binds to the polymer portion.

Formula (5)

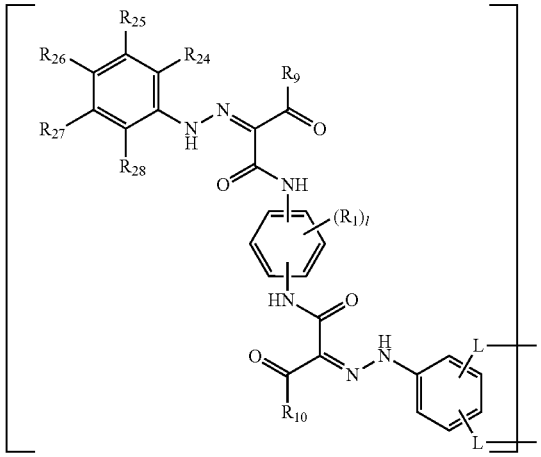

In Formula (5), $R_1$ is synonymous with $R_1$ in Formula (1) above. $R_9$ and $R_{10}$ are synonymous with $R_9$ and $R_{10}$ in Formula (3) above. $R_{24}$ to $R_{28}$ independently represent a hydrogen atom, a $COOR_{21}$ group, or a $CONR_{22}R_{23}$ group; $R_{21}$ to $R_{23}$ are synonymous with $R_{21}$ to $R_{23}$ in Formula (3) above. 1 is 4. L represents a divalent linking group that binds to the polymer portion.

Formula (6)

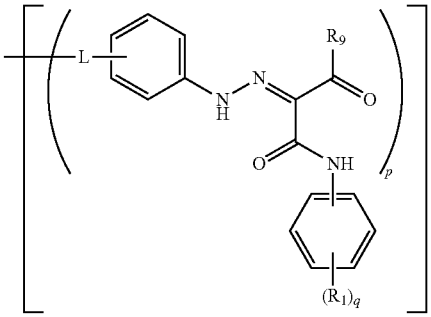

In Formula (6), $R_1$ is synonymous with $R_1$ in Formula (1) above. $R_9$ is synonymous with $R_9$ in Formula (3) above. p represents an integer of 2 or 3, q represents an integer of 3 or 4, and p+q is 6. L represents a divalent linking group binds to the polymer.

Formula (7)

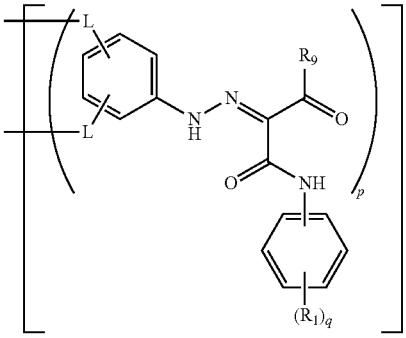

In Formula (7), $R_1$ is synonymous with $R_1$ in Formula (1) above. $R_9$ is synonymous with $R_9$ in Formula (3) above. p represents an integer of 2 or 3, q represents an integer of 3 or 4, and p+q is 6. L represents a divalent linking group that binds to the monomer.

L in Formulae (4) to (7) is a divalent linking group, through which the azo skeleton structure and the polymer portion are linked.

In the units of Formulae (4) and (6) above, the azo skeleton structure and the polymer portion are linked through L at one place. The structures of Formulae (5) and (7) above are linked at two places.

L in Formulae above is not particularly limited insofar as it is a divalent linking group. Bonds including amide bonds, such as a carboxylic acid amide bond and a sulfonic acid amide bond, ester bonds, such as a carboxylic acid ester bond and a sulfonic acid ester bond, ether bonds, such as an ether bond and a thioether bond, and the like are mentioned. The linking group can be arbitrarily selected from the bond species mentioned above and a case of including a carboxylic acid ester bond or a carboxylic acid amide bond is suitable in terms of ease of synthesis.

With respect to the substitution position of L in Formulae (4) to (7), a case is suitable where the substitution position of at least one L is the p-position or the m-position relative to a hydrazo group in terms of the affinity with carbon black.

$R_{24}$ to $R_{28}$ of (5) in Formula (4) or (5) above can be selected from a hydrogen atom, a $COOR_{21}$ group, and a $CONR_{22}R_{23}$ group and a case where at least one of $R_{24}$ to $R_{28}$ is a $COOR_{21}$ group or a $CONR_{22}R_{23}$ group is suitable from the viewpoint of the affinity with carbon black.

Next, the above-described polymer portion is described in detail.

The alkyl group in $R_7$ in General Formula (2) above is not particularly limited and linear, branched, or cyclic alkyl groups, such as a methyl group, an ethyl group, an n-propyl group, an n-butyl group, an n-pentyl group, an n-hexyl group, an isopropyl group, an isobutyl group, a sec-butyl group, a tert-butyl group, and a cyclohexyl group are mentioned, for example.

$R_7$ in General Formula (2) above can be arbitrarily selected from the substituents and the hydrogen atom mentioned above and is suitably a hydrogen atom or a methyl group from the viewpoint of the polymerizability of the monomer unit.

The carboxylic acid ester group in $R_8$ in General Formula (2) above is not particularly limited and, for example, linear or branched ester groups, such as a methyl ester group, an ethyl ester group, an n-propyl ester group, an isopropyl ester group, an n-butyl ester group, an isobutyl ester group, a sec-butyl ester group, a tert-butyl ester group, an octyl ester group, a nonyl ester group, a decyl ester group, an undecyl ester group, a dodecyl ester group, a hexadecyl ester group, an octadecyl ester group, an eicosyl ester group, a docosyl ester group, a 2-ethylhexyl ester group, a phenyl ester group, and a 2-hydroxy ethyl ester group are mentioned.

As the carboxylic acid amide group in $R_8$ in General Formula (2) above, linear or branched amide groups, such as an N-methyl amide group, an N,N-dimethyl amide group, an N-ethyl amide group, an N,N-diethyl amide group, an N-isopropyl amide group, an N,N-diisopropyl amide group, an N-n-butyl amide group, an N,N-di-n-butyl amide group, an N-isobutylamide group, an N,N-diisobutyl amide group, an N-sec-butyl amide group, an N,N-di-sec-butyl amide group, an N-tert-butyl amide group, an N-octyl amide group, an N,N-dioctyl amide group, an N-nonyl amide group, an N,N-dinonyl amide group, an N-decyl amide group, an N,N-didecyl amide group, an N-undecyl amide group, an N,N-diundecyl amide group, an N-dodecyl amide group, an N,N-didodecyl amide group, an N-hexadecyl amide group, an N-octadecyl amide group, an N-phenyl amide group, an N-(2-ethylhexyl)amide group, and an N,N-di(2-ethylhexyl)amide group are mentioned.

The substituent of $R_8$ in General Formula (2) above may be further substituted and is not particularly limited insofar as the polymerizability of the monomer unit is not impaired or the solubility of the compound having the azo skeleton structure is not remarkably reduced. In this case, as substituents which may be substituted, alkoxy groups, such as a methoxy group and an ethoxy group, amino groups, such as an N-methyl amino group and an N,N-dimethylamino group, acyl groups, such as an acetyl group, halogen atoms, such as a fluorine atom and a chlorine atom, and the like are mentioned.

$R_8$ in General Formula (2) can be arbitrarily selected from the substituents, the phenyl group, and the carboxyl group mentioned above and is suitably a phenyl group or a carboxylic acid ester group in terms of the dispersibility and compatibility of the compound having the azo skeleton unit with the binder resin of the toner.

In the above-described polymer portion, the affinity with a dispersion medium can be controlled by changing the proportion of the monomer unit represented by Formula (2) above. When the dispersion medium is a nonpolar solvent, such as styrene, it is suitable to increase the proportion of the monomer unit in which $R_8$ in Formula (2) above is represented by a phenyl group in terms of the affinity with a dispersion medium. When the dispersion medium is a solvent having a certain degree of polarity, such as acrylic acid ester, it is suitable to increase the proportion of the monomer unit in which $R_8$ in Formula (2) above is represented by a carboxyl group, a carboxylic acid ester group, or a carboxylic acid amide group in terms of the affinity with a dispersion medium.

With respect to the molecular weight of the above-described polymer portion, a case where the number average molecular weight is 500 or more is suitable in terms of increasing the dispersibility of carbon black. When the molecular weight is larger, the effect of increasing the dispersibility of carbon black is higher. However, when the molecular weight is excessively large, the affinity with a non-water soluble solvent tends to decrease. Therefore, the number average molecular weight of the polymer portion is suitably up to 200000. In addition, when considering ease of manufacturing, the number average molecular weight of the polymer portion is more suitably in the range of 2000 to 50000.

As disclosed in PCT Japanese Translation Patent Publication No. 2003-531001, a method is known which includes increasing the dispersibility by introducing a branched aliphatic chain to the terminal in a polyoxy alkylene carbonyl dispersant. Also in the above-described polymer portion, when a telechelic polymer portion is synthesized by a method, such as Atom Transfer Radial Polymerization (ATRP) described later, a branched aliphatic chain can be introduced into the terminal, so that the dispersibility increases in some cases.

The positions of the azo skeleton structures in the compound having the azo skeleton structures may be scattered at random or unevenly present at one end while forming one or two or more blocks.

When the number of the azo skeleton structures in the compound having the above-described azo skeleton structure is larger, the affinity with carbon black is higher. However, when the number of the azo skeleton structures is excessively large, the affinity with a non-water soluble solvent deteriorates, which is not suitable. Accordingly, the number of the azo skeleton structures is suitably in the range of 0.2 to 10 and more suitably in the range of 0.2 to 5 based on 100 monomers, which form the polymer portion.

With respect to the azo skeleton structure represented by Formula (1) above, tautomers represented by the following Formulae (8-A) and (8-B) as illustrated in the following view are present and these tautomers are included in the scope of the invention.

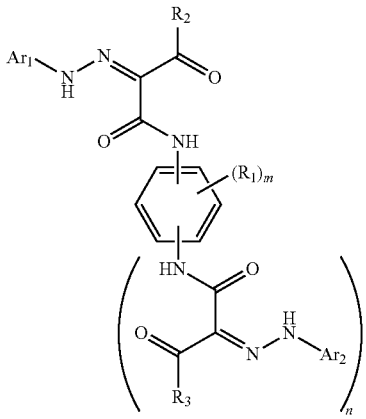

Formula (1)

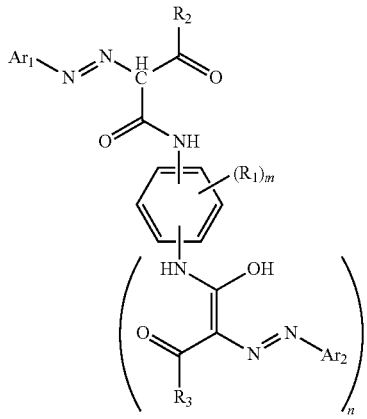

Formula (8-A)

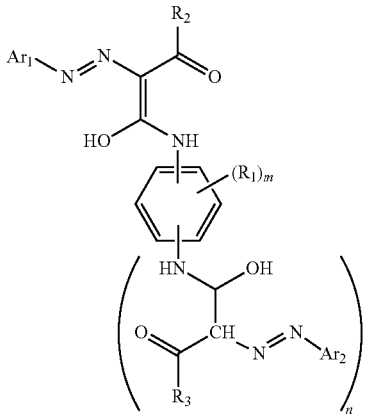

Formula (8-B)

$R_1$ to $R_3$, $Ar_1$, $Ar_2$, m, and n in Formulae (8-A) and (8-B) are synonymous with $R_1$ to $R_3$, $Ar_1$, $Ar_2$, m, and n in Formula (1), respectively.

The compound having the azo skeleton unit described above can be synthesized in accordance with known methods.

As methods for synthesizing the compound having the azo skeleton unit, the following methods (i) to (iv) are mentioned, for example.

First, the method (i) is described in detail with reference to an example of a scheme shown below. The method (i) includes synthesizing an azo skeleton unit and a polymer portion beforehand, and then linking them by a condensation reaction or the like to thereby synthesize the compound having the azo skeleton structure.

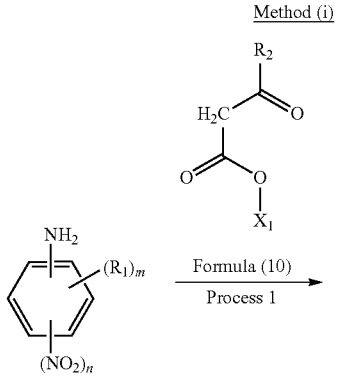

Formula (9)

-continued

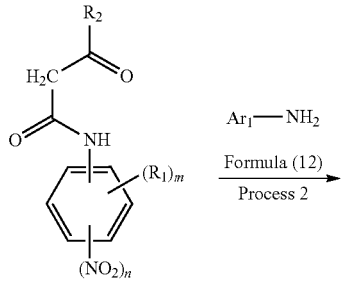

Formula (11)

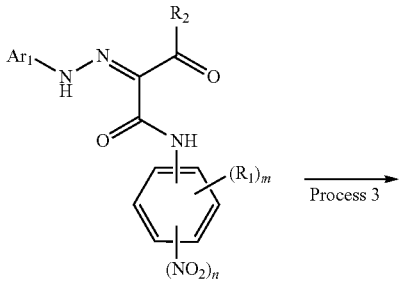

Formula (13)

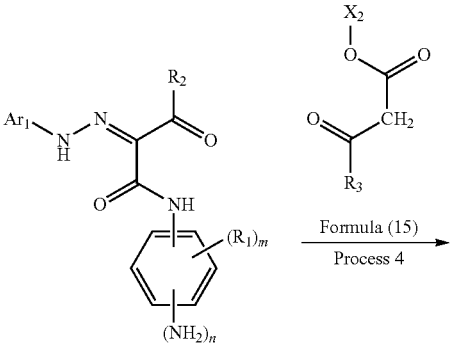

Formula (14)

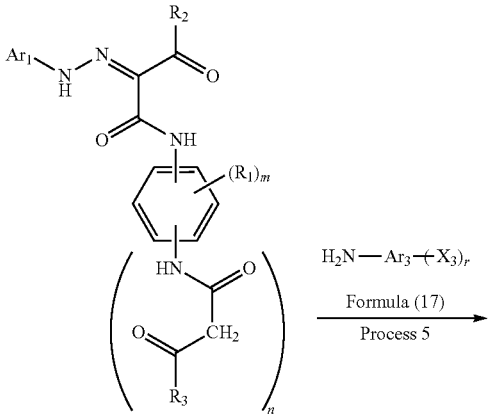

Formula (16)

-continued

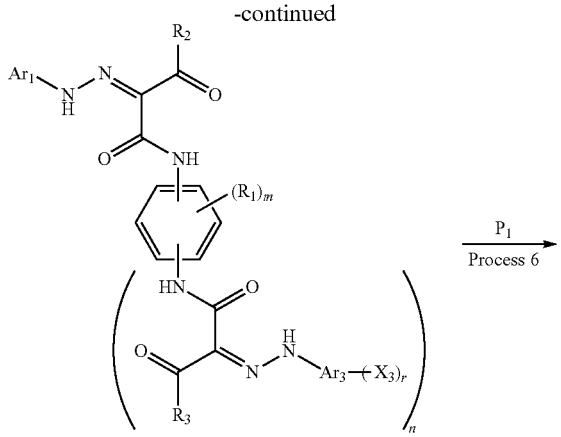

Formula (18)

Compound having azo skeleton unit $R_1$ to $R_3$, $Ar_1$, m, and n in Formulae (9) to (18) are synonymous with $R_1$ to $R_3$, $Ar_1$, m, and n in Formula (1) above, respectively. $Ar_3$ in Formulae (17) and (18) represents an arylene group. $X_1$ in Formula (10) and $X_2$ in Formula (15) represent leaving groups. $P_1$ represents a polymer portion having at least one kind of monomer unit among the monomer units represented by General Formula (2) above. In Formulae (17) and (18), $X_3$ represents a substituent which reacts with $P_1$ to form the divalent linking group L and r is an integer of 1 or 2.

In the scheme shown above as an example, the compound having the azo skeleton unit can be synthesized by a process 1 of amidating a nitroaniline derivative represented by Formula (9) and an acetoacetic acid analog represented by Formula (10) to synthesize an intermediate (11) which is an acylacetanilide analog, a process 2 of diazo-coupling the intermediate (11) and an aniline derivative (12) to synthesize an azo compound (13), a process 3 of reducing a nitro group in the azo compound (13) to synthesize an intermediate (14) which is an aniline analog, a process 4 of amidating the intermediate (14) and an acetoacetic acid analog represented by Formula (15) to synthesize an intermediate (16) which is an acylacetanilide analog, a process 5 of diazo-coupling the intermediate (16) and an aniline derivative (17) to synthesize an azo compound (18), and a process 6 of synthesizing an azo skeleton and a polymer portion $P_1$ by a condensation reaction or the like.

First, the process 1 is described. In the process 1, known methods can be used (For example, Datta E. Ponde and other four persons, "The Journal of Organic Chemistry" (U.S.), American Chemical Society, 1998, Volume 63, No. 4, p.p. 1058 to 1063). When $R_2$ in Formula (11) is a methyl group, the intermediate can be synthesized also by a method using diketene in place of the raw material (10) (For example, Kiran Kumar Solingapuram Sai and other two persons, "The Journal of Organic Chemistry" (U.S.), American Chemical Society, 2007, Volume 72, No. 25, p.p. 9761 to 9764.

Various kinds of the nitroaniline derivative (9) and the acetoacetic acid analog (10) are commercially available, so that the nitroaniline derivative (9) and the acetoacetic acid analog (10) can be easily obtained. The nitroaniline derivative (9) and the acetoacetic acid analog (10) can be easily synthesized by known methods.

Although this process can also be carried out in the absence of a solvent, the process is suitably carried out in the presence of a solvent in order to prevent a rapid progress of the reaction. The solvent is not particularly limited insofar as the reaction is not blocked. For example, alcohols, such as methanol, ethanol, and propanol, esters, such as methyl acetate, ethyl acetate, and propyl acetate, ethers, such as diethylether, tetrahydrofuran, and dioxane, hydrocarbons, such as benzene, toluene, xylene, hexane, and heptane, halogen containing hydrocarbons, such as dichloromethane, dichloroethane, and chloroform, amides, such as N,N-dimethylformamide, N-methylpyrrolidone and N,N-dimethyl imidazolidinone, nitriles, such as acetonitrile and propionitrile, acids, such as formic acid, acetic acid, and propionic acid, water, and the like are mentioned. The solvents mentioned above can be used as a mixture of two or more kinds and the mixing ratio in the case of mixing the solvents can be arbitrarily determined according to the solubility of a substrate. The use amount of the solvents can be arbitrarily determined and is suitably in the range of 1.0 to 20 mass times that of the compound represented by Formula (9) above in terms of reaction velocity.

This process is usually performed in a temperature range of 0° C. to 250° C. and is usually completed within 24 hours.

Next, the process 2 is described. In the process 2, known methods can be used. For example, a method described below is mentioned. First, an aniline derivative (12) is allowed to react with a diazotization agent, such as sodium nitrite or nitrosyl sulfate, in the presence of inorganic acid, such as hydrochloric acid or sulfuric acid, in a methanol solvent to synthesize a corresponding diazonium salt. Furthermore, the diazonium salt is coupled with the intermediate (11) to synthesize the azo compound (13).

Various kinds of the aniline derivative (12) are commercially available, so that the aniline derivative (12) can be easily obtained. The aniline derivative (12) can be easily synthesized by known methods.

Although this process can also be carried out in the absence of a solvent, the process is suitably carried out in the presence of a solvent in order to prevent a rapid progress of the reaction. The solvent is not particularly limited insofar as the reaction is not blocked. For example, alcohols, such as methanol, ethanol, and propanol, esters, such as methyl acetate, ethyl acetate, and propyl acetate, ethers, such as diethylether, tetrahydrofuran, and dioxane, hydrocarbons, such as benzene, toluene, xylene, hexane, and heptane, halogen containing hydrocarbons, such as dichloromethane, dichloroethane, and chloroform, amides, such as N,N-dimethylformamide, N-methylpyrrolidone and N,N-dimethyl imidazolidinone, nitriles, such as acetonitrile and propionitrile, acids, such as formic acid, acetic acid, and propionic acid, water, and the like are mentioned. The solvents mentioned above can be used as a mixture of two or more kinds and the mixing ratio in the case of mixing the solvents can be arbitrarily determined according to the solubility of a substrate. The use amount of the solvents can be arbitrarily determined and is suitably in the range of 1.0 to 20 mass times that of the compound represented by Formula (12) above in terms of reaction velocity.

This process is usually performed in a temperature range of −50° C. to 100° C. and is usually completed within 24 hours.

Next, the process 3 is described. In the process 3, known methods can be utilized [As a method for using a metallic compound and the like, "Experimental Chemistry Course" (Jikken Kagaku Kouza, in Japanese), Maruzen Co., Ltd., First edition, Volume 17-2, p.p. 162 to 179, is referred to, for example. As a catalytic hydrogenation method, "Experimental Chemistry Course" (Jikken Kagaku Kouza, in Japanese), Maruzen Co., Ltd., First edition, Volume 15, p.p. 390 to 448, or International Publication No. 2009/060886 pamphlet, is referred to, for example.].

Although this process can also be carried out in the absence of a solvent, the process is suitably carried out in the presence of a solvent in order to prevent a rapid progress of the reaction. The solvent is not particularly limited insofar as the reaction is not blocked. For example, alcohols, such as methanol, ethanol, and propanol, esters, such as methyl acetate, ethyl acetate, and propyl acetate, ethers, such as diethylether, tetrahydrofuran, and dioxane, hydrocarbons, such as benzene, toluene, xylene, hexane, and heptane, amides, such as N,N-dimethylformamide, N-methylpyrrolidone and N,N-dimethyl imidazolidinone, and the like are mentioned. The solvents mentioned above can be used as a mixture of two or more kinds and the mixing ratio in the case of mixing the solvents can be arbitrarily determined according to the solubility of a substrate. The use amount of the solvents can be arbitrarily determined and is suitably in the range of 1.0 to 20 mass times that of the compound represented by Formula (13) above in terms of reaction velocity.

This process is usually performed in a temperature range of 0° C. to 250° C. and is usually completed within 24 hours.

Next, the process 4 is described. In the process 4, the intermediate (16) which is an acylacetanilide analog can be synthesized by utilizing the same method as that of the process 1.

Next, the process 5 is described. In the process 5, the azo compound (18) can be synthesized by the application of the same method as that of the process 2.

Various kinds of the aniline derivative (17) are commercially available, so that the aniline derivative (17) can be easily obtained. The aniline derivative (17) can be easily synthesized by known methods.

Next, a method for synthesizing a polymer portion $P_1$ to be used in the process 6 is described. In the synthesis of the polymer portion $P_1$, known polymerization methods can be utilized [For example, Krzysztof Matyjaszewski and other one person, "Chemical Reviews" (U.S.), American Chemical Society, 2001, Volume 101, p.p. 2921 to 2990].

For example, radical polymerization, cationic polymerization, and anionic polymerization are mentioned. It is suitable to use radical polymerization in terms of ease of manufacturing.

The radical polymerization can be performed by the use of a radical polymerization initiator, irradiation with radiation, laser light, and the like, combined use of a photopolymerization initiator and irradiation with light, heating, and the like.

As the radical polymerization initiator, any substance may be used insofar as the substance can generate radicals to initiate a polymerization reaction. The radical polymerization initiator can be selected from compounds generating radicals by the action of heat, light, radiation, an oxidation-reduction reaction, and the like. For example, azo compounds, organic peroxides, inorganic peroxides, organic metallic compounds, photopolymerization initiators, and the like are mentioned. For example, azo polymerization initiators, such as 2,2'-azobis (isobutyronitrile), 2,2'-azobis(2-methylbutyronitrile), 2,2'-azobis(4-methoxy-2,4-dimethylvaleronitrile), and 2,2'-azobis(2,4-dimethylvaleronitrile), organic peroxide polymerization initiators, such as benzoyl peroxide, di-tert-butyl peroxide, tert-butylperoxyisopropyl carbonate, tert-hexylperoxybenzoate, and tert-butylperoxybenzoate, inorganic peroxide polymerization initiators, such as potassium persulfate and ammonium persulfate, redox initiators, such as hydrogen peroxide-ferrous iron type, a benzoyl peroxide-dimethyl aniline type, and a cerium (IV) salt-alcohol type, and the like are mentioned. As the photopolymerization initiators, benzophenones, benzoinethers, acetophenones, and thioxanthones are mentioned. These radical polymerization initiators may be used in combination of two or more kinds.

The use amount of the polymerization initiator in this case is suitably adjusted in the range of 0.1 to 20 parts by mass relative to 100 parts by mass of monomers in such a manner as to obtain a copolymer having a target molecular weight distribution.

The polymer portion represented by $P_1$ can also be manufactured using any method for solution polymerization, suspension polymerization, emulsification polymerization, dispersion polymerization, precipitation polymerization, and mass polymerization without particular limitation and solution polymerization in a solvent capable of dissolving ingredients to be used in manufacturing is suitable. For example, alcohols, such as methanol, ethanol, and 2-propanol, ketones, such as acetone and methyl ethyl ketone, ethers, such as tetrahydrofuran and diethylether, polar organic solvents, such as ethylene glycol monoalkyl ethers or acetates thereof, propylene glycol monoalkyl ethers or acetates thereof, and diethylene glycol monoalkyl ethers, and, depending on the cases, nonpolar solvents, such as toluene and xylene, can be used singly or as a mixture. Among the above, the solvents whose boiling point is in the temperature range of 100 to 180° C. are more suitably used singly or as a mixture.

With respect to the polymerization temperature, a suitable temperature range varies depending on the type of the initiator to be used and is not particularly limited. For example, it is common to perform polymerization in a temperature range of −30 to 200° C. and a more suitable temperature range is 40 to 180° C., for example.

In the polymer portion represented by $P_1$, the molecular weight distribution and the molecular structure can be controlled using known methods. For example, the polymer portion $P_1$ in which the molecular weight distribution and the molecular structure are controlled can be manufactured by the use of a method utilizing an addition cleavage type chain transfer agent (Japanese Patent Nos. 4254292 and 3721617), an NMP method utilizing dissociation and bonding of amine oxide radicals [e.g., Craig J. Hawker and other two persons, "Chemical Reviews", (U.S.), American Chemical Society, 2001, Volume 101, p.p. 3661 to 3688], an ATRP method for performing polymerization using a metal catalyst and a ligand using a halogen compound as a polymerization initiator [e.g., Masami Kamigaito and other two persons, "Chemical Reviews" (U.S.), American Chemical Society, 2001, Volume 101, p.p. 3689 to 3746], an RAFT method using dithiocarboxylic acid ester, a xanthate compound, and the like as a polymerization initiator. (e.g., PCT Japanese Translation Patent Publication No. 2000-515181), an MADIX method (e.g., International Publication No. 99/05099 pamphlet), a DT method [e.g., Atsushi Goto and other six persons, "Journal of The American Chemical Society", (U.S.), American Chemical Society, 2003, Volume 125, p.p. 8720 to 8721], or the like.

Next, the process 6 is described. In the process 6, known methods can be used. For example, a compound having an azo skeleton unit in which the linking group L has a carboxylic acid ester bond can be synthesized by the use of the polymer portion $P_1$ having a carboxyl group and the azo compound (18) in which $X_3$ is a substituent having a hydroxyl group. Moreover, a compound having the azo skeleton unit in which the linking group L has a sulfonic acid ester bond can be synthesized by the use of the polymer portion $P_1$ having a hydroxyl group and the azo compound (18) in which $X_3$ is a substituent having a sulfonic acid group. Furthermore, a compound having an azo skeleton unit in which the linking group L has a carboxylic acid amide bond can be synthesized by the use of the polymer portion $P_1$ having a carboxyl group and the azo compound (18) in which $X_3$ is a substituent having an amino group. For example, a method using 1-ethyl-3-(3-dimethylamino propyl) carbodiimide hydrochloride and the like as a dehydration-condensation agent (e.g., Melvin S. Newman and other one person, "The Journal of Organic Chemistry" (U.S.), American Chemical Society, 1961, Volume 26, No. 7, p.p. 2525 to 2528) and Schotten-Baumann method (e.g., Norman O. V. Sonntag, "Chemical Reviews", (U.S.), American Chemical Society, 1953, Volume 52, No. 2, p.p. 237 to 416), and the like are mentioned.

Although this process can also be carried out in the absence of a solvent, the process is suitably carried out in the presence of a solvent in order to prevent a rapid progress of the reaction. The solvent is not particularly limited insofar as the reaction is not blocked. For example, ethers, such as diethylether, tetrahydrofuran, and dioxane, hydrocarbons, such as benzene, toluene, xylene, hexane, and heptane, halogen containing hydrocarbons, such as dichloromethane, dichloroethane, and chloroform, amides, such as N,N-dimethylformamide, N-methylpyrrolidone, and N,N-dimethyl imidazolidinone, nitriles, such as acetonitrile and propionitrile, and the like are mentioned. The solvents mentioned above can be used as a mixture of two or more kinds and the mixing ratio in the case of mixing the solvents can be arbitrarily determined according to the solubility of a substrate. The use amount of the solvents can be arbitrarily determined and is suitably in the range of 1.0 to 20 mass times that of the compound represented by Formula (18) above in terms of reaction velocity.

This process is usually performed in a temperature range of 0° C. to 250° C. and is usually completed within 24 hours.

Next, the method (ii) is described in detail with reference to an example of a scheme shown below. The method (ii) includes synthesizing an azo compound having a polymerizable functional group beforehand, and then copolymerizing the same with a polymerizable monomer represented by Formula (2) above to thereby synthesize the compound having the azo skeleton unit described above.

Method (ii)

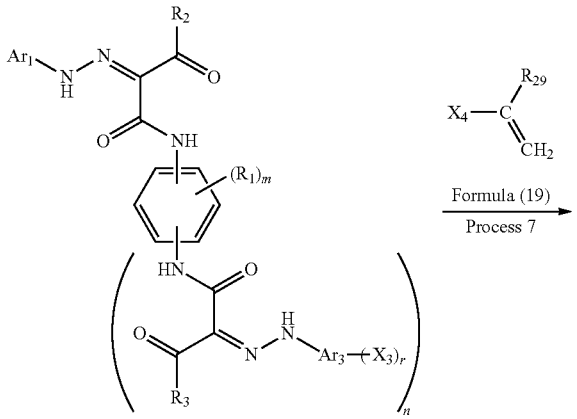

Formula (18)

-continued

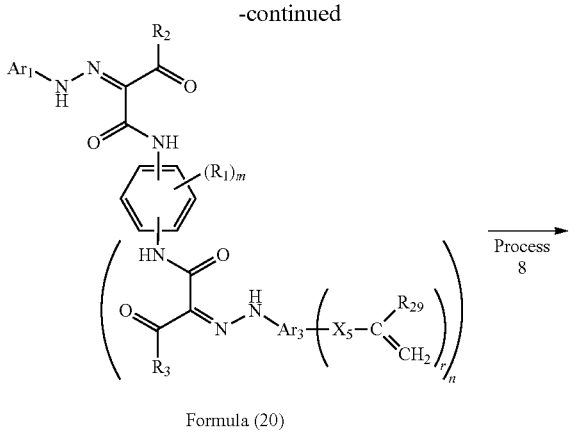

Method (iii)

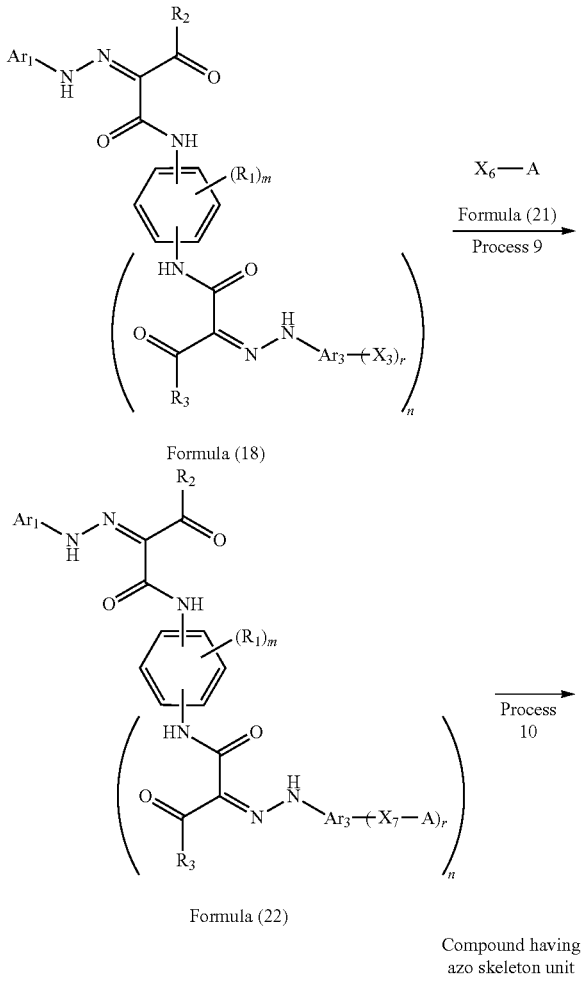

$R_1$ to $R_3$, $Ar_1$, $Ar_3$, $X_3$, m, n, and r in Formula (18) are synonymous with $R_1$ to $R_3$, $Ar_1$, $Ar_3$, $X_3$, m, n, and r in Formula (18), respectively, in the scheme of the method (i) described above. In Formula (19), $R_{29}$ represents a hydrogen atom or an alkyl group and $X_4$ represents a substituent which reacts with $X_3$ in Formula (18) to form $X_5$ in Formula (20). $R_1$ to $R_3$, $R_{29}$, $Ar_1$, $Ar_3$, m, n, and r in Formula (20) are synonymous with those in Formulae (18) and (19), respectively, and $X_5$ represents the divalent linking group L formed by a reaction of $X_3$ in Formula (18) and $X_4$ in Formula (19).

In the scheme shown above, the compound having the azo skeleton unit is synthesized by a process 7 of reacting the azo compound (18) with a vinyl group-containing compound represented by Formula (19) to synthesize an azo compound (20) having a polymerizable functional group and a process 8 of copolymerizing the azo compound (20) having a polymerizable functional group and a polymerizable monomer forming the monomer unit represented by Formula (2) above.

First, the process 7 is described. In the process 7, the azo compound (20) having a polymerizable functional group can be synthesized by utilizing the same method as that of the process 6 of the method (i) described above.

Various kinds of the vinyl group-containing compound (19) are commercially available, so that the vinyl group-containing compound (19) can be easily obtained. The vinyl group-containing compound (19) can be easily synthesized by known methods.

Next, the process 8 is described. In the process 8, the compound having the azo skeleton unit can be synthesized by copolymerizing the azo skeleton unit (20) and a polymerizable monomer forming the monomer unit represented by Formula (2) above utilizing the same method as that in the synthesis of the polymer portion $P_1$ of the method (i) described above.

Next, a method (iii) is described in detail with reference to an example of a scheme shown below. The method (iii) includes synthesizing the compound having the azo skeleton unit by copolymerizing the azo compound having a halogen atom synthesized beforehand as a polymerization initiator and a polymerizable monomer forming the monomer unit represented by Formula (2) above.

$R_1$ to $R_3$, $Ar_1$, $Ar_3$, $X_3$, m, n, and r in Formula (18) are synonymous with $R_1$ to $R_3$, $Ar_1$, $Ar_3$, $X_3$, m, n, and r in Formula (18), respectively, in the scheme of the method (i) described above. In Formula (21), $X_6$ represents a substituent which reacts with $X_3$ in Formula (18) to form $X_7$ in Formula (22) and A represents a chlorine atom, a bromine atom, or an iodine atom. $R_1$ to $R_3$, $Ar_1$, $Ar_3$, $X_3$, m, n, and r in Formula (22) are synonymous with those in Formula (18) above and $X_7$ represents the divalent linking group L formed by a reaction of $X_3$ in Formula (18) and $X_6$ in Formula (21).

In the scheme shown above, the compound having the azo skeleton unit is synthesized by a process 9 of reacting the azo compound (18) and a halogen atom-containing compound represented by Formula (21) to synthesize an azo compound (22) having a halogen atom and a process 10 of performing polymerization with polymerizable monomers forming the monomer unit represented by Formula (2) above using the azo compound (22) having a halogen atom as a polymerization initiator.

First, the process 9 is described. In the process 9, the azo compound (22) having a halogen atom can be synthesized utilizing the same method as the process 6 of the method (i) described above. For example, the azo skeleton unit (22) having a halogen atom having a structure in which the linking group L includes a carboxylic acid ester bond can be synthesized by the use of the halogen atom-containing compound

(21) having a carboxyl group and the azo compound (18) in which $X_3$ is a substituent having a hydroxyl group. Moreover, the azo skeleton unit (22) having a halogen atom having a structure in which the linking group L includes a sulfonic acid ester bond can be synthesized by the use of the halogen atom-containing compound (21) having a hydroxyl group and the azo compound (18) in which $X_3$ is a substituent having a sulfonic acid group. Furthermore, the azo skeleton unit (22) having a halogen atom having a structure in which the linking group L includes a carboxylic acid amide bond can be synthesized by the use of the halogen atom-containing compound (21) having a carboxyl group and the azo compound (18) in which $X_3$ is a substituent having an amino group.

Mentioned as the halogen atom-containing compound (21) having a carboxyl group are, for example, chloracetic acid, α-chloropropionic acid, α-chlorobutyric acid, α-chloroisobutyric acid, α-chlorovaleric acid, α-chloroisovaleric acid, α-chlorocaproic acid, α-chlorophenylacetic acid, α-chlorodiphenylacetic acid, α-chloro-α-henylpropionic acid, α-chloro-β-phenylpropionic acid, bromoacetic acid, α-bromopropionic acid, α-bromobutyric acid, α-bromoisobutyric acid, α-bromovaleric acid, α-bromoisovaleric acid, α-bromocaproic acid, α-bromophenylacetic acid, α-bromodiphenylacetic acid, α-bromo-α-phenylpropionic acid, α-bromo-β-phenylpropionic acid, iodoacetic acid, α-iodopropionic acid, α-iodobutyric acid, α-iodoisobutyric acid, α-iodovaleric acid, α-iodoisovaleric acid, α-iodocaproic acid, α-iodophenylacetic acid, α-iododiphenylacetic acid, α-iodine-α-phenylpropionic acid, α-iodine-β-phenylpropionic acid, β-chlorobutyric acid, β-bromoisobutyric acid, iododimethyl methylbenzoate, 1-chloroethyl benzoate, and the like. Acid halides and acid anhydrides thereof can also be similarly used in the invention.

Mentioned as the halogen atom-containing compound (21) having a hydroxyl group are, for example, 1-chloroethanol, 1-bromoethanol, 1-iodoethanol, 1-chloropropanol, 2-bromopropanol, 2-chloro-2-propanol, 2-bromo-2-methylpropanol, 2-phenyl-1-bromoethanol, 2-phenyl-2-iodoethanol, and the like.

Next, the process 10 is described. In the process 10, the compound having the azo skeleton unit can be synthesized by polymerizing polymerizable monomers forming the monomer unit (2) in the presence of a metal catalyst and a ligand using the azo skeleton unit (22) having a halogen atom as a polymerization initiator utilizing the ATRP method for the method (i) described above.

The metal catalyst for use in the ATRP method is not particularly limited and is suitably at least one kind of a transition metal selected from elements of Periodic Table Groups VII to XI. In redox catalysts (redox conjugated complexes) in which a low valent complex and a high valent complex reversibly change, mentioned as a low valent metal to be used is, for example, a metal selected from the group of $Cu^+$, $Ni^0$, $Ni^+$, $Ni^{2+}$, $Pd^0$, $Pd^+$, $Pt^0$, $Pt^+$, $Pt^{2+}$, $Rh^+$, $Rh^{2+}$, $Rh^{3+}$, $Co^+$, $Co^{2+}$, $Ir^0$, $Ir^+$, $Ir^{2+}$, $Ir^{3+}$, $Fe^{2+}$, $Ru^{2+}$, $Ru^{3+}$, $Ru^{4+}$, $Ru^{5+}$, $Os^{2+}$, $Os^{3+}$, $Re^{2+}$, $Re^{3+}$, $Re^{4+}$, $Re^{6+}$, $Mn^{2+}$, and $Mn^{3+}$. Among the above, $Cu^+$, $Ru^{2+}$, $Fe^{2+}$, or $Ni^{2+}$ is suitable and $Cu^+$ is particularly suitable. As monovalent copper compounds, cuprous chloride, cuprous bromide, cuprous iodide, cuprous cyanide, and the like are mentioned, for example. The copper compounds mentioned above can be suitably used also in terms of availability of raw materials.

As ligands for use in the ATRP method, organic ligands are generally used. For example, 2,2'-bipyridyl and derivatives thereof, 1,10-phenanthroline and derivatives thereof, N,N,N',N'-tetramethylethylenediamine, N,N,N',N'',N''-pentamethyl diethylene triamine, tris[2-(dimethylamino)ethyl]amine, triphenylphosphine, tributylphosphine, and the like are mentioned. In particular, aliphatic polyamines, such as N,N,N',N'',N''-pentamethyl diethylene triamine, are suitable in terms of availability of raw materials.

Next, a method (iv) is described in detail with reference to an example of a scheme shown below. The method (iv) includes synthesizing a polymer portion having at least one kind of a monomer unit among the monomer units represented by Formula (2) above bonded to an aryl group having an amino group and an intermediate which is an acylacetanilide analog beforehand, and then diazo-coupling them to thereby synthesize the compound having the azo skeleton unit.

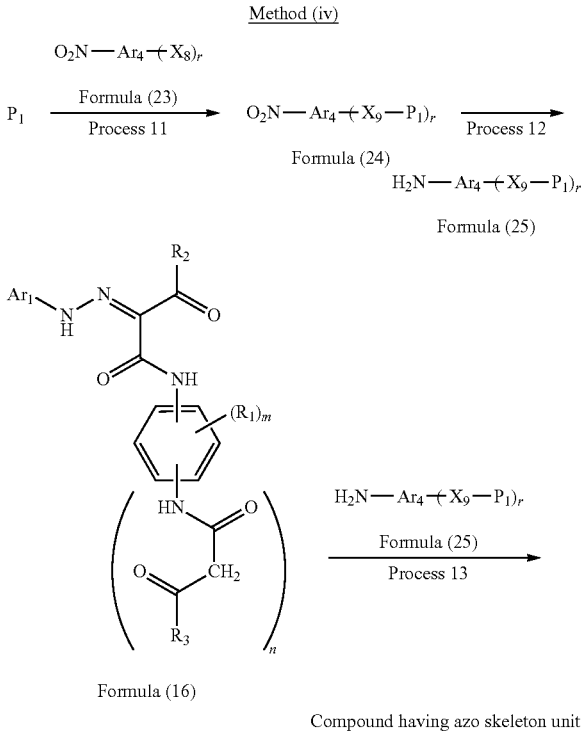

$P_1$ is synonymous with $P_1$ in the scheme of the method (i) described above. $R_1$ to $R_3$, $Ar_1$, m, and n in Formula (16) are synonymous with $R_1$ to $R_3$, $Ar_1$, m, and n in Formula (16). respectively, in the scheme of the method (i) described above. $Ar_4$ in Formulae (23) to (25) represents an arylene group. $X_8$ in Formula (23) represents a substituent which reacts with $P_1$ to form $X_9$ in Formula (24) and r represents 1 or 2. $X_9$ in Formulae (24) and (25) represents the divalent linking group L formed by a reaction of $X_8$ in Formula (23) and $P_1$.

In the scheme shown above, the compound having the azo skeleton unit is synthesized by a process 11 of introducing a nitro group-containing arylene group (23) into the polymer portion $P_1$ to synthesize a polymer portion (24) having the nitro group-containing arylene group, a process 12 of reducing the polymer portion (24) having the nitro group-containing arylene group to synthesize a polymer portion (25) having an amino group-containing arylene group, and a process 13 of diazo-coupling the polymer portion (25) having the amino group-containing arylene group and the intermediate (16) which is an acylacetanilide analog.

First, the process 11 is described. In the process 11, the polymer portion (24) having the nitro group-containing arylene group can be synthesized by utilizing the same method as that of the process 6 of the method (i) described above. For example, the polymer portion (24) having the nitro group-containing arylene group in which the linking group is a carboxylic acid ester bond can be synthesized by reacting the polymer portion $P_1$ having a carboxyl group and the nitro group-containing arylene group (23) in which $X_8$ is a substituent having a hydroxyl group. Moreover, the polymer portion (24) having the nitro group-containing arylene group in which the linking group is a sulfonic acid ester bond can be synthesized by reacting the polymer portion $P_1$ having a hydroxyl group and the nitro group-containing arylene group (23) in which $X_8$ is a substituent having sulfonic acid. Furthermore, the polymer portion (24) having the nitro group-containing arylene group in which the linking group is a carboxylic acid amide bond can be synthesized by the use of the polymer portion $P_1$ having a carboxyl group and the nitro group-containing arylene group (23) in which $X_8$ is a substituent having an amino group.

Various kinds of compounds having nitro group-containing arylene group of Formula (23) are commercially available, so that the nitro group-containing arylene group of Formula (23) can be easily obtained. The nitro group-containing arylene group of Formula (23) can be easily synthesized by known methods.

Next, the process 12 is described. In the process 12, the polymer portion (25) having the amino group-containing arylene group can be synthesized by the application of the same method as that of the process 3 of the method (i) described above.

Next, the process 13 is described. In the process 13, the compound having the azo skeleton unit can be synthesized by the application of the same method as that of the process 2 of the method (i) described above.

The compound having the azo skeleton unit obtained in each process of the synthesis methods mentioned above and the compounds represented by Formulae (11), (13), (14), (16), (18), (20), (22), (24), and (25) above can be purified using usual isolation and purification methods of organic compounds. As the isolation and purification methods, a recrystallization method and a reprecipitation method using an organic solvent, column chromatography using silica gel or the like, and the like are mentioned, for example. By purifying the compound using one of the methods or two or more of the methods in combination, the compound having high purity can be obtained.

The compounds represented by Formulae (11), (13), (14), (16), (18), (20), and the (22) obtained in each process of the synthesis methods described above as an example were identified and measured for the purity by nuclear magnetic resonance spectroscopic analysis [ECA-400, manufactured by JEOL Co., Ltd.], ESI-TOF MS (LC/MSD TOF, manufactured by Agilent Technologies), and HPLC analysis [LC-20A, manufactured by Shimadzu Corporation].

The compounds having the azo skeleton unit and the compounds of Formula (24) and (25) obtained by the synthesis methods described above as an example were identified and measured for the molecular weight by size exclusion chromatography (SEC) [HLC8220GPC, manufactured by TOSOH CORP.], nuclear magnetic resonance spectroscopic analysis [ECA-400, manufactured by JEOL Co., Ltd.], and acid value measurement based on JISK-0070 [Automatic titration measuring device COM-2500, manufactured by Hiranuma Sangyo Co., Ltd.].

Next, the binder resin of the toner of the invention is described.

As the binder resin of the toner of the invention, a styrene-methacrylic acid copolymer, a styrene-acrylic acid copolymer, a polyester resin, an epoxy resin, a styrene-butadiene copolymer, and the like which are generally used are mentioned. In a method for directly obtaining toner particles by a polymerization method, monomers for forming them are used. For example, styrene monomers, such as styrene, α-methylstyrene, α-ethylstyrene, o-methylstyrene, m-methylstyrene, p-methylstyrene, o-ethylstyrene, m-ethylstyrene, and p-ethylstyrene, methacrylate monomers, such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and amide methacrylate, acrylate monomers, such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylamino ethyl acrylate, diethylaminoethyl acrylate, acrylonitrile, and amide acrylate, and olefin monomers, such as butadiene, isoprene, and cyclohexene, are suitably used. These monomers are used singly or mixed as appropriate in such a manner that the theoretical glass transition temperature (Tg) is in the range of 40 to 75° C. [refer to "Polymer Handbook" edited by J. Brandrup, E. H. Immergut (U.S.), Third edition, John Wiley & Sons, 1989, p.p. 209 to 277]. When the theoretical glass transition temperature is lower than 40° C., problems are likely to arise in terms of the storage stability and durable stability of the toner. On the other hand, when the theoretical glass transition temperature exceeds 75° C., the transparency of the toner decreases in full color image formation. The binder resin in the toner of the invention can control a distribution in the toner of additives, such as a colorant, a charge control agent, and a wax by the use of a nonpolar resin, such as polystyrene, and a polar resin, such as a polyester resin and a polycarbonate resin, in combination. For example, in the case of directly manufacturing toner particles by a suspension polymerization method or the like, the polar resin is added in a polymerization reaction from a dispersion process to a polymerization process. The polar resin is added according to the polarity balance of a polymerizable monomer composition formed into toner particles and an aqueous medium. As a result, the distribution in the toner can be controlled in such a manner that the resin concentration continuously changes from the toner particle surface towards the center, e.g., the polar resin forms a thin layer on the toner particle surface. In this case, a colorant can be present in the toner particles in a suitable manner by the use of a polar resin having an interaction with the compound having the azo skeleton unit described above, a colorant, and a charge control agent.

Carbon black to be used as the colorant of the toner of the invention is not particularly limited, and carbon black obtained by manufacturing methods, such as a thermal method, an acetylene method, a channel method, a furnace method, and a lampblack method can be used, for example.

The average particle diameter of primary particles of the carbon black for use in the invention is not particularly limited. The average particle diameter of the primary particles is suitably 14 to 80 nm and more suitably 25 to 50 nm. When the average particle diameter of the primary particles is smaller than 14 nm, the toner exhibits redness, which is unsuitable as black for full color image formation. On the contrary, when the average particle diameter of the primary particles of the carbon black is larger than 80 nm, the coloring power becomes excessively low even when the carbon black is favorably dispersed, which is not suitable.

The average particle diameter of the primary particles of the carbon black can be measured by take a photograph of enlarged particles by a scanning electron microscope.

The DBP oil absorption amount of the carbon black for use in the invention is not particularly limited and is suitably 30 to 200 ml/100 g and more suitably 40 to 150 ml/100 g. When the DBP oil absorption amount of the carbon black is lower than 30 ml/100 g, the coloring power is likely to become low even when the carbon black is favorably dispersed. On the contrary, when the DBP oil absorption amount of the carbon black is larger than 200 ml/100 g, a large amount of a dispersion medium is required when producing a carbon black dispersion liquid in a toner manufacturing process. Therefore, the DBP oil absorption amount is not suitable.

The DBP oil absorption of carbon black is the amount of DBP (dibutylphthalate) which 100 g of carbon black absorbs, and can be measure based on "JIS K6217".

The pH of the carbon black for use in the invention is not particularly limited insofar as the effects of the compound having the azo skeleton unit are not remarkably impaired and the toner characteristics, such as the fixability of the toner and fogging, are not impaired.

The pH of the carbon black can be measured by measuring a mixed liquid of the carbon black and distilled water with a pH electrode.

The specific surface area of the carbon black for use in the invention is not particularly limited and is suitably 300 $m^2/g$ or lower and more suitably 100 $m^2/g$. When the specific surface area of the carbon black is larger than 300 $m^2/g$, a large amount of the compound having the azo skeleton unit required for obtaining good dispersibility of the carbon black are required. Therefore, the specific surface area is not suitable.

The specific surface area of the carbon black is the BET specific surface area and can be measured based on "JIS K4652".

The carbon black may be used singly or as a mixture of two or more kinds thereof.

The weight composition ratio of the carbon black and the compound having the azo skeleton unit in the toner of the invention is suitably in the range of 100:0.1 to 100:100. More suitably, when the specific surface area of the carbon black is 300 $m^2/g$ or lower, the weight composition ratio is in the range of 100:0.5 to 100:20 in terms of the dispersibility of the carbon black.

As the colorant in the toner of the invention, the carbon black described above is always used. However, other colorants can be used in combination insofar as the dispersibility of this carbon black is not impaired.

As the colorants which can be used in combination, known black colorants can be used when the toner is used as a nonmagnetic toner.

Mentioned as the black colorants which can be used in combination are, for example, C.I. Pigment Black 1, C.I. Pigment Black 10, C.I. Pigment Black 31, C.I. Natural Black 1, C.I. Natural Black 2, and C.I. Natural Black 3, C.I. Natural Black 4, C.I. Natural Black 5, C.I. Natural Black 6, activated carbon, and the like.

In the toner of the invention, known magenta colorants, cyan colorants, or yellow colorants can be further used in combination for tone adjustment.

When the toner of the invention is used as a magnetic toner, magnetic materials mentioned below can be used as a black colorant. More specifically, iron oxides, such as magnetite, maghemite, and ferrite or iron oxides containing the other metal oxides, metals, such as Fe, Co, and Ni, or alloys of the metals and metals, such as Al, Co, Cu, Pb, Mg, Ni, Sn, Zn, Sb, Be, Bi, Cd, Ca, Mn, Se, Ti, W, and V, mixtures thereof, and the like are mentioned.

The use amount of these colorants varies depending on the type of the colorant. It is appropriate that the use amount is 0.1 to 60 parts by mass and suitably 0.5 to 50 parts by mass in total based on 100 parts by mass of the binder resin. Furthermore, in the invention, a crosslinking agent can also be used in the synthesis of the binder resin in order to increase the mechanical strength of toner particles and also in order to control the molecular weight of the particle constituent molecules.

Mentioned as the crosslinking agents for use in the toner particle of the invention are bifunctional crosslinking agents, such as divinylbenzene, bis(4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, and diacrylates of polyethylene glycols #200, #400, and #600, dipropyrene glycol diacrylate, polypropylene glycol diacrylate, polyester type diacrylate, and substances in which theses diacrylates are substituted with dimethacrylates.

Mentioned as polyfunctional crosslinking agents are pentaerythritol triacrylate, trimethylolethane triacrylate, trimethylolpropane triacrylate, tetramethylolmethane tetraacrylate, origo ester acrylate and a methacrylate thereof, 2,2-bis (4-methacryloxyphenyl)propane, diallylphthalate, triallylcyanurate, triallylisocyanurate, triallyltrimellitate, and the like.

These crosslinking agents may be used suitably in the range of 0.05 to 10 parts by mass and more suitably 0.1 to 5 parts by mass based on 100 parts by mass of the above-described monomers in terms of the fixability and the offset resistance of the toner.

Furthermore, in the invention, wax components can also be used in the synthesis of the binder resin in order to prevent adhesion to a fixing member.

Mentioned as the wax components usable in the invention are, for example, petroleum waxes, such as paraffin wax, microcrystalline wax, and petrolatum, and derivatives thereof, montan wax and derivatives thereof, a hydrocarbon wax by Fischer-Tropsch process and derivatives thereof, a polyolefin wax typified by polyethylene and derivatives thereof, natural waxes, such as carnauba wax and candelilla wax, and derivatives thereof, and the like and the derivatives include oxides, block copolymers with vinyl monomers, and graft modified substances. Moreover, alcohols, such as higher aliphatic alcohol, fatty acids, such as stearic acid and pulmitic acid, fatty acid amide, fatty acid ester, hardened castor oil and derivatives thereof, plant waxes, animal waxes, and the like are mentioned. These substances can be used singly or in combination.

As the addition amount of the wax components mentioned above, the content based on 100 parts by mass of the binder resin is suitably in the range of 2.5 to 15.0 parts by mass and more suitably 3.0 to 10.0 parts by mass in terms of the total amount. When the addition amount of the wax components is smaller than 2.5 parts by mass, oil-less fixation is difficult to achieve. When the addition amount exceeds 15.0 parts by mass, the amount of the wax components in the toner particles is excessively large. Therefore, a large amount of excessive wax components are present on the toner particle surface, which sometimes impairs desired charge characteristics. Therefore, the addition amounts are not suitable.

In the toner of the invention, charge control agents can be mixed as required for use. Thus, the optimal frictional charge amount according to a development system can be controlled.

As the charge control agents, known substances can be used. In particular, a charge control agent which has high charge speed and can stably maintain a fixed charge amount is suitable. When manufacturing toner particles by a direct polymerization method, a charge control agent which has low polymerization inhibiting properties is low and substantially does not contain a soluble substance in an aqueous dispersion medium is suitable.

Mentioned as the charge control agents are, for example, as one which negatively charges a toner, a polymer or a copolymer having a sulfonic acid group, a sulfonate group, or a sulfonic acid ester group, a salicylic acid derivative and a metal complex thereof, a monoazo metallic compound, an acetyl acetone metallic compound, aromatic oxycarboxylic acid, aromatic mono- and poly-carboxylic acids, and metal salts, anhydrides and esters thereof, phenol derivatives, such as bisphenol, a urea derivative, a metal-containing naphthoic acid compound, a boron compound, a quarternary ammonium salt, calixarene, a resin charge control agent, and the like. Mentioned as charge control agents which positively charge a toner are nigrosine, nigrosine modified by fatty acid metal salts or the like, a guanidine compound, an imidazole compound, quarternary ammonium salts, such as tributylbenzilammonium-1-hydroxy-4-naphthosulfonate and tetrabutylammonium tetrafluoroborate, onium salts, such as phosphonium salts which are analogs thereof and lake pigments thereof, triphenylmethane dyes and lake pigments thereof. (Mentioned as laking agents are phosphotungstic acid, phosphomolybdic acid, phosphotungsten molybdic acid, tannic acid, lauric acid, gallic acid, ferricyanide, ferrocyanide, and the like.), metal salts of higher fatty acids, diorgano tin oxides, such as dibutyl tin oxide, dioctyl tin oxide, and dicyclohexyl tin oxide, diorgano tin borates, such as dibutyl tin borate, dioctyl tin borate, and dicyclohexyl tin borate, resin charge control agents, and the like. These substances can be uses singly or in combination of two or more kinds thereof.

In the toner of the invention, an inorganic fine powder may be added as a plasticizer to the toner particles. As the inorganic fine powder, fine powder, such as silica, titanium oxide, alumina or double oxides thereof, those obtained by surface treating them, can be used.

As a method for manufacturing the toner particles constituting the toner of the invention, a grinding method, a suspension polymerization method, a suspension granulation method, an emulsion polymerization method, and the like which are used heretofore are mentioned. From the viewpoint of the environmental load in manufacturing and the controllability of the particle diameter, it is suitable to obtain the toner particles particularly by a manufacturing method including granulating in an aqueous medium, such as a suspension polymerization method and a suspension granulation method among the manufacturing methods mentioned above.

In the method for manufacturing the toner of the invention, the dispersibility of the carbon black can be increased by mixing the compound having the azo skeleton unit and the carbon black beforehand to prepare a pigment composition.

The pigment composition can be manufactured by a wet process or dry process. Considering the fact that the compound having the azo skeleton unit has high affinity with a non-water soluble solvent, manufacturing by a wet process capable of simply manufacturing a uniform pigment composition is suitable. For example, the pigment composition is obtained as follows. The compound having the azo skeleton unit and, as required, a resin are dissolved into a dispersion medium, and then carbon black powder is gradually added under stirring to sufficiently mix the carbon black powder with the dispersion medium. Furthermore, by applying mechanical shearing force by a dispersing machine, such as a kneader, a roll mill, a ball mill, a paint shaker, a dissolver, an attritor, a sand mill, or a high speed mill, the carbon black can be stably finely-dispersed into uniform fine particles.

The dispersion medium usable in the pigment composition is not particularly limited. In order to obtain a high pigment dispersion effect of the compound having the azo skeleton unit, the dispersion medium is suitably a non-water soluble solvent. Mentioned as the non-water soluble solvent are, for example, esters, such as methyl acetate, ethyl acetate, and propyl acetate, hydrocarbons, such as hexane, octane, petroleum ether, cyclohexane, benzene, toluene, and xylene, halogen-containing hydrocarbons, such as carbon tetrachloride, trichloroethylene, and tetrabromoethane, and the like.

The dispersion media usable in the pigment composition may be polymerizable monomers. For example, styrene, α-methylstyrene, α-ethylstyrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butyl styrene, p-n-hexyl styrene, p-n-octyl styrene, p-n-nonyl styrene, p-n-decylstyrene, p-n-dodecylstyrene, ethylene, propylene, butylene, isobutylene, vinyl chloride, vinylidene chloride, vinyl bromide, vinyl iodide, vinyl acetate, vinyl propionate, vinyl benzoate, methacrylic acid, methyl methacrylate, ethyl methacrylate, propyl methacrylate, butyl methacrylate, n-octyl methacrylate, dodecyl methacrylate, 2-ethylhexyl methacrylate, stearyl methacrylate, behenyl methacrylate, phenyl methacrylate, dimethylaminoethyl methacrylate, diethylaminoethyl methacrylate, acrylic acid, methyl acrylate, ethyl acrylate, n-butyl acrylate, isobutyl acrylate, propyl acrylate, n-octyl acrylate, dodecyl acrylate, 2-ethylhexyl acrylate, stearyl acrylate, behenyl acrylate, 2-chloroethyl acrylate, phenyl acrylate, vinyl methyl ether, vinyl ethyl ether, vinyl isobutyl ether, vinyl methyl ketone, vinyl hexyl ketone, methyl isopropenyl ketone, vinyl naphthalene, acrylonitrile, methacrylonitrile, acryl amide, and the like can be mentioned.

As the resin usable in the pigment composition, resins usable as the binder resin of the toner of the invention can be used. For example, a styrene-methacrylic acid copolymer, a styrene-acrylic acid copolymer, a polyester resin, an epoxy resin, a styrene-butadiene copolymer, and the like are mentioned. The dispersion media can be used as a mixture of two or more kinds. The pigment composition can be isolated by known methods, such as filtration, decantation, or centrifugal separation. The solvent can also be removed by washing.

In the pigment composition, an auxiliary agent may be further added in manufacturing. For example, surfactants, dispersants, fillers, standardizers, resins, waxes, antifoaming agents, electrostatic prevention agents, dustproof agents, extenders, shading colorants, preservatives, dry inhibitors, rheology control additives, wetting agents, antioxidants, UV absorbents, photostabilizer, or combinations thereof are mentioned. The compound having the azo skeleton unit described above may be add beforehand in manufacturing a crude pigment.

The toner particles manufactured by the suspension polymerization method of the invention is manufactured as follows, for example. The pigment composition, the polymerizable monomer, the wax component, the polymerization initiator, and the like are mixed to thereby prepare a polymerizable monomer composition. Next, the polymerizable monomer composition is dispersed in an aqueous medium, and the particles of the polymerizable monomer composition are granulated. Then, the polymerizable monomers in the particles of the polymerizable monomer composition are polymerized in the aqueous medium to thereby obtain toner particles.

The polymerizable monomer composition in the above-described process is suitably one prepared by mixing a dispersion liquid in which the pigment composition is dissolved in a first polymerizable monomer with a second polymerizable monomer. More specifically, the pigment composition is sufficiently dispersed by the first polymerizable monomer, and then mixed with the second polymerizable monomer with other toner materials, whereby the carbon black can be present in the toner particles in a more favorable dispersion state.

As the polymerization initiator for use in the above-described suspension polymerization method, known polymerization initiators can be mentioned. For example, azo compounds, organic peroxides, inorganic peroxides, organic metallic compounds, photopolymerization initiators, and the like are mentioned. For example, initiators, such as azo polymerization initiators, such as 2,2'-azobis(isobutyronitrile), 2,2'-azobis(2-methyl butyronitrile), 2,2'-azobis(4-methoxy-2,4-dimethylvaleronitrile), 2,2'-azobis(2,4-dimethylvaleronitrile), and dimethyl 2,2'-azobis(isobutyrate), organic peroxide polymerization initiators, such as benzoyl peroxide, di-tert-butyl peroxide, tert-butylperoxyisopropyl monocarbonate, tert-hexylperoxybenzoate, and tert-butylperoxybenzoate, inorganic peroxide polymerization initiators, such as potassium peroxodisulfate and ammonium persulfate, a hydrogen peroxide-ferrous iron type, a BPO-dimethylaniline type, and a cerium (IV) salt-alcohol type, and the like are mentioned. As the photopolymerization initiators, acetophenones, benzoin ethers, ketals, and the like are mentioned. These methods can be used singly or in combination of two or more of the methods.

The concentration of the polymerization initiator is suitably in the range of 0.1 to 20 parts by mass and more suitably 0.1 to 10 parts by mass relative to 100 parts by mass of the polymerizable monomer. The type of the polymerizable initiators slightly varies depending on the polymerization method. The polymerizable initiators are used singly or as a mixture referring to a 10-hour half-life temperature.

In the aqueous medium for use in the suspension polymerization method, it is suitable to compound a dispersion stabilizer. As the dispersion stabilizer, known inorganic and organic dispersion stabilizers can be used. Mentioned as the inorganic dispersion stabilizers are, for example, calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, alumina, and the like. Mentioned as the organic dispersion stabilizers are, for example, sodium salts of polyvinyl alcohol, gelatin, methyl cellulose, methyl hydroxypropyl cellulose, ethyl cellulose, and carboxymethyl cellulose, starches, and the like. Moreover, nonionic, anionic, cationic surfactants can also be utilized. For example, dodecyl sodium sulfate, sodium tetradecyl sulfate, pentadecyl sodium sulfate, octyl sodium sulfate, sodium oleate, sodium laurate, potassium stearate, calcium oleate, and the like are mentioned.

Among the dispersion stabilizers mentioned above, it is suitable to use poor water-soluble inorganic dispersion stabilizers which are soluble in acid in the invention. In the invention, when preparing the aqueous dispersion medium using poor water-soluble inorganic dispersion stabilizers, it is suitable to use these dispersion stabilizers in such a manner that the proportion thereof is in the range of 0.2 to 2.0 parts by mass relative to 100 parts by mass of the polymerizable monomer in terms of the stability of liquid droplets in the aqueous medium of the polymerizable monomer composition. In the invention, it is suitable to prepare the aqueous medium using water in the range of 300 to 3000 parts by mass relative to 100 parts by mass of the polymerizable monomer composition.

In the invention, when preparing the aqueous medium in which the poor water-soluble inorganic dispersion stabilizer is dispersed, a commercially-available dispersion stabilizer as it is may be dispersed. However, in order to obtain dispersion stabilizer particles having a fine uniform particle size, it is suitable to prepare the aqueous medium by generating the poor water-soluble inorganic dispersion stabilizer under high-speed stirring in water. For example, when using calcium phosphate as a dispersion stabilizer, a suitable dispersion stabilizer can be obtained by mixing an aqueous sodium phosphate solution and an aqueous calcium chloride solution under high-speed stirring to form calcium phosphate fine particles.

With respect to the toner particles of the invention, suitable toner particles can be obtained also when manufactured by a suspension granulation method. Since the manufacturing process of the suspension granulation method does not include, a heating process, compatibilization of the resin and the wax component occurring when a low melting point wax is used can be suppressed and a reduction in the glass transition temperature of the toner resulting from the compatibilization can be prevented. In the suspension granulation method, various kinds of toner materials serving as the binder resin are used and it is easy to use a polyester resin which is generally advantageous in fixability as the main ingredient. Therefore, when manufacturing a toner of a resin composition to which the suspension polymerization method cannot be applied, the suspension polymerization method is an advantageous manufacturing method.

The toner particles manufactured by the suspension granulation method are manufactured as follows, for example. First, the pigment composition, the binder resin, the wax component, and the like are mixed in a solvent to prepare a solvent composition. Next, the solvent composition is dispersed in an aqueous medium to granulate particles of the solvent composition, thereby obtaining a toner particle suspension liquid. Then, the obtained suspension liquid is heated or decompressed to remove the solvent, whereby the toner particles can be obtained.

The solvent composition in the above-described process is suitably one prepared by mixing a dispersion liquid in which the pigment composition is dissolved in a first solvent with a second solvent. More specifically, the pigment composition is sufficiently dispersed by the first solvent, and then mixed with the second solvent with other toner materials, whereby the carbon black can be present in the toner particles in a more favorable dispersion state.

Mentioned as the solvents usable in the suspension granulation method are, for example, hydrocarbons, such as toluene, xylene, and hexane, halogen-containing hydrocarbons, such as methylene chloride, chloroform, dichloroethane, trichloroethane, and carbon tetrachloride, alcohols, such as methanol, ethanol, butanol, and isopropyl alcohol, polyhydric alcohols, such as ethylene glycol, propylene glycol, diethylene glycol, and triethylene glycol, cellosolves, such as methyl cellosolve and ethyl cellosolve, ketones, such as acetone, methyl ethyl ketone, and methyl isobutyl ketone, ethers, such as benzyl alcohol ethyl ether, benzyl alcohol isopropyl ether, and tetrahydrofuran, esters, such as methyl acetate, ethyl acetate, and butyl acetate, and the like. These solvents can be used singly or as a mixture of two or more kinds. Among the solvents mentioned above, in order to easily remove the solvent in the toner particle suspension liquid, it is suitable to use a solvent whose boiling point is low and which can sufficiently dissolve the binder resin.

The use amount of the solvent is suitably in the range of 50 to 5000 parts by mass and more suitably 120 to 1000 parts by mass relative to 100 parts by mass of the binder resin.

In the aqueous medium for use in the suspension granulation method, a dispersion stabilizer is suitably compounded.

As the dispersion stabilizer, known inorganic and organic dispersion stabilizers can be used. Mentioned as the inorganic dispersion stabilizers are, for example, calcium phosphate, calcium carbonate, aluminum hydroxide, calcium sulfate, barium carbonate, and the like. Mentioned as the organic dispersion stabilizers are, for example, water-soluble polymers, such as sodium salts of polyvinyl alcohol, methyl cellulose, hydroxyethyl cellulose, ethyl cellulose, and carboxymethyl cellulose, sodium polyacrylate, and sodium polymethacrylate, surfactants, such as anionic surfactants, such as sodium dodecylbenzenesulfonate, octadecyl sodium sulfate, sodium oleate, sodium laurate, and potassium stearate, cationic surfactants, such as lauryl amine acetate, stearyl amine acetate, and lauryl trimethyl ammonium chloride, amphoteric ionic surfactants, such as lauryl dimethylamine oxide, nonionic surfactants, such as polyoxyethylene alkyl ether, polyoxyethylene alkyl phenyl ether, and polyoxyethylene alkyl amine, and the like.

The use amount of the dispersant is suitably in the range of 0.01 to 20 parts by mass relative to 100 parts by mass of the binder resin in terms of the stability of liquid droplets in the aqueous medium of the solvent composition.

In the invention, the weight average particle diameter (hereinafter referred to as D4) of the toner is suitably in the range of 3.00 to 15.0 μm and more suitably 4.00 to 12.0 μm. When the weight average particle diameter is in the range mentioned above, a high definition image is easily obtained while maintaining charge stability.

The ratio of D4 and the number average particle diameter (hereinafter referred to as D1) of the toner (hereinafter referred to as D4/D1) is 1.35 or lower and suitably 1.30 or lower in terms of achieving suppression of fogging and improvement of transfer efficiency while maintaining a high resolution.

The adjustment methods of D4 and D1 of the toner of the invention vary depending on the manufacturing methods for the toner particles. For example, in the case of the suspension polymerization method, D1 and D4 can be adjusted by controlling the concentration of the dispersant for use in the preparation of the aqueous dispersion medium, the reaction stirring speed, the reaction stirring time, or the like.

The toner of the invention may be either a magnetic toner or a nonmagnetic toner. When used as a magnetic toner, a magnetic material may be mixed in the toner particles constituting the toner of the invention. Mentioned as such a magnetic material, are iron oxides, such as magnetite, maghemite, and ferrite, or iron oxides containing the other metal oxides, metals, such as Fe, Co, and Ni, or alloys of these metals and metals, such as Al, Co, Cu, Pb, Mg, Ni, Sn, Zn, Sb, Be, Bi, Cd, Ca, Mn, Se, Ti, W, and V, mixtures thereof, and the like. A particularly suitable magnetic material for the purpose of the invention is fine powder of tri-iron tetroxide or γ-diiron trioxide.

In the magnetic substance, it is suitable in terms of the developability of the toner that the average particle diameter is 0.1 to 2 μm (suitably 0.1 to 0.3 μm) and, with respect to the magnetic properties in the application of 795.8 kA/m, the coercive force is 1.6 to 12 kA/m, the saturation magnetization is 5 to 200 $Am^2/kg$ (suitably 50 to 100 $Am^2/kg$), and the residual magnetization is 2 to 20 $Am^2/kg$.

With respect to the addition amount of these magnetic materials, the magnetic materials are used in the proportion of 10 to 200 parts by mass and suitably 20 to 150 parts by mass relative to 100 parts by mass of the binder resin.

EXAMPLES

Hereinafter, the invention is described in more detail with reference to Examples and Comparative Examples but is not limited to the following Examples without departing from the scope of the invention. In the following description, "part(s)" and "%" are based on mass unless otherwise particularly specified.

Measurement methods used in the synthesis examples are described.

(1) Molecular Weight Measurement

The molecular weight of the polymer portion and the compound having the azo skeleton unit is calculated in terms of polystyrene by size exclusion chromatography (SEC). The measurement of the molecular weight by SEC was performed as described below.

One obtained by filtering a solution, which was obtained by adding a sample to the following eluate in such a manner that the sample concentration was 1.0%, and then leaving the mixture to stand still at room temperature for 24 hours, thorough a solvent resistant membrane filter having a pore diameter of 0.2 μm was used as a sample solution, and was measured under the following conditions.

Apparatus: High-speed GPC apparatus "HLC-8220GPC [manufactured by TOSOH CORP.]

Column: Two units of LF-804

Eluate: THF

Flow velocity: 1.0 ml/min

Oven temperature: 40° C.

Sample injection amount: 0.025 ml

In calculation of the molecular weight of the sample, the calibration curves produced from standard polystyrene resins [TSK standard polystyrenes F-850, F-450, F-288, F-128, F-80, F-40, F-20, F-10, F-4, F-2, F-1, A-5000, A-2500, A-1000, and A-500 manufactured by TOSOH CORP.] were used.

(2) Acid Value Measurement

The acid value of the polymer portion and the compound having the azo skeleton structure is determined by the following method.

The basic operation is based on JIS K-0070.

1) 0.5 to 2.0 g of the sample is accurately weighed. The mass at this time is defined as M (g).
2) The sample is put in a 50 ml beaker, and then 25 ml of a mixed liquid of tetrahydrofuran/ethanol (2/1) is added and dissolved.
3) Titration is performed using an ethanol solution of 0.1 mol/l of KOH and using a potentiometric titration meter [For example, automatic titration meter "COM-2500" manufactured by Hiranuma Sangyo Co., Ltd. or the like can be used.].
4) The use amount of the KOH solution at this time is defined as S (ml). The blank is simultaneously measured and the use amount of KOH at this time is defined as B (ml).
5) The acid value is calculated by the following expression. f represents the factor of the KOH solution.

$$\text{Acid value [mg KOH/g]} = \frac{(S-B)\times f\times 5.61}{M}$$

(3) Composition Analysis

The structural determination of the polymer portion and the compound having the azo skeleton unit was performed using the following apparatus.

$^1$-H NMR

ECA-400 manufactured by JEOL Co., Ltd. (Used solvent: deuterochloroform)

Example 1

Compounds having the azo skeleton unit were obtained by the following method.

Manufacturing Example of Compound (41)
A compound (41) having the azo skeleton unit represented by the following structure was manufactured according to the following scheme.
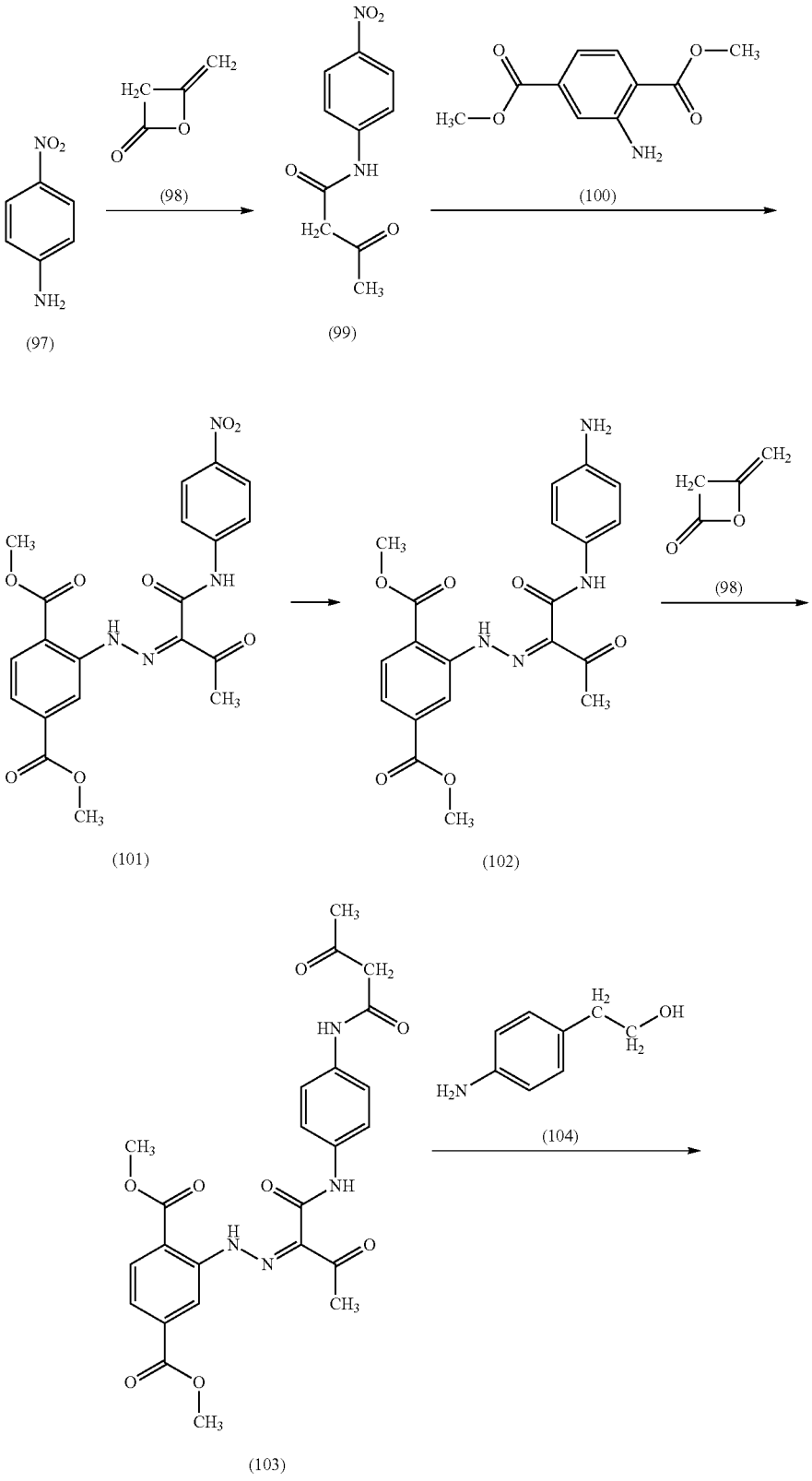

-continued
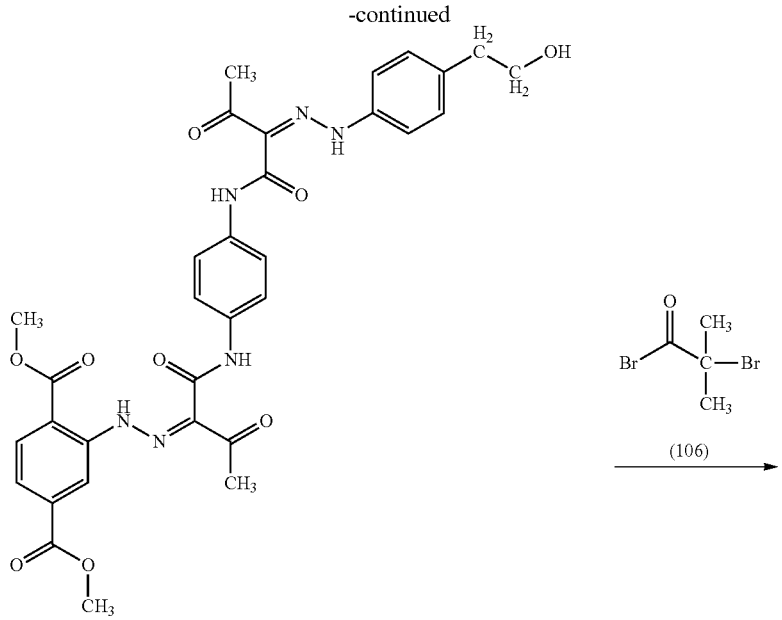
(105)
(106)
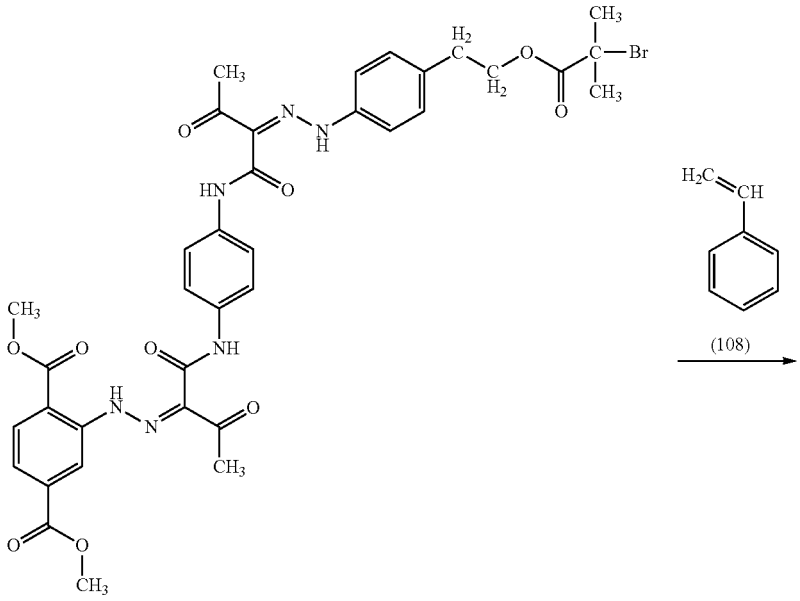
(107)
(108)

-continued

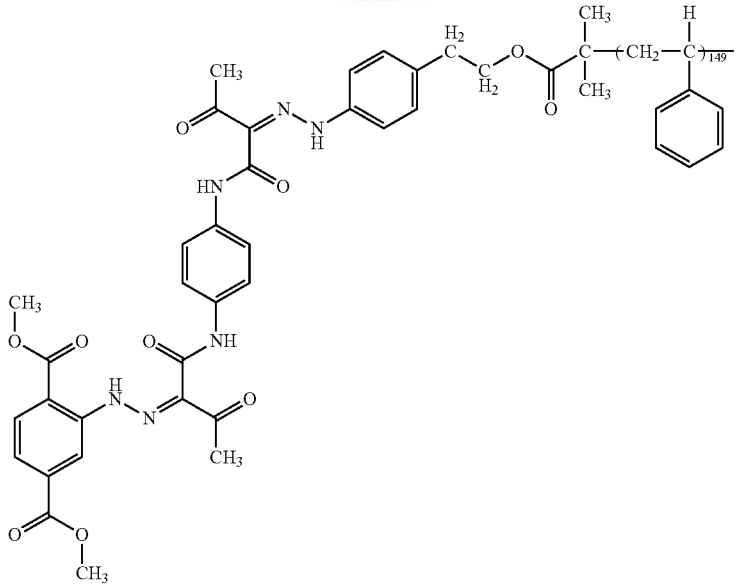

(41)

First, 3.11 parts of p-nitroglycerine aniline (97) was added to 30 parts of chloroform, the mixture was ice-cooled to 10° C. or lower, and then 1.89 parts of diketene (98) was added. Thereafter, the resultant mixture was stirred at 65° C. for 2 hours. After the completion of the reaction, the resultant mixture was extracted with chloroform and condensed, thereby obtaining 4.70 parts of a compound (99) (Yield of 94.0%).

Next, 40.0 parts of methanol and 5.29 parts of concentrated hydrochloric acid were added to 4.25 parts of 2-amino dimethyl terephthalate (100), and then the mixture was ice-cooled to 10° C. or lower. One in which 2.10 parts of sodium nitrite was dissolved in 6.00 parts of water was added to the solution, and then allowed to react at the same temperature for 1 hour. Subsequently, 0.990 part of sulfamic acid was added, and then further stirred for 20 minutes (diazonium salt solution). To 70.0 parts of methanol, 4.51 parts of the compound (99) was added, the mixture was ice-cooled to 10° C. or lower, and then the diazonium salt solution was added. Thereafter, one in which 5.83 parts of sodium acetate was dissolved in 7.00 parts of water was added, and then allowed to react at 10° C. or lower for 2 hours. After the completion of the reaction, 300 parts of water was added, the mixture was stirred for 30 minutes, the solid was separated by filtration and purified by a recrystallization method from N,N-dimethylformamide, thereby obtaining 8.71 parts of a compound (101) (Yield of 96.8%).

Next, 8.58 parts of the compound (101) and 0.40 part of palladium-activated carbon (palladium 5%) were added to 150 parts of N,N-dimethylformamide, and then the mixture was stirred at 40° C. for 3 hours under a hydrogen gas atmosphere (Reaction pressure of 0.1 to 0.4 MPa). After the completion of the reaction, the solution was separated by filtration, and then condensed, thereby obtaining 6.99 parts of a compound (102) (Yield of 87.5%).

Next, 6.50 parts of a compound (102) was added to 30.0 parts of chloroform, the mixture was ice-cooled to 10° C. or lower, and then 0.95 part of diketene (98) was added. Thereafter, the resultant mixture was stirred at 65° C. for 2 hours. After the completion of the reaction, the mixture was extracted with chloroform and condensed, thereby obtaining 7.01 parts of an azo compound intermediate (103) (Yield of 94.2%).

Next, 15.0 parts of methanol and 1.48 parts of concentrated hydrochloric acid were added to 1.78 parts of 2-(4-aminophenyl)ethanol (104), and the mixture was ice-cooled to 10° C. or lower. One in which 1.08 parts of sodium nitrite was dissolved in 3.00 parts of water was added to the solution, and then allowed to react at the same temperature for 1 hour. Subsequently, 0.380 part of sulfamic acid was added, and then further stirred for 20 minutes (diazonium salt solution). One in which 7.18 parts of potassium carbonate was dissolved in 7.00 parts of water and 6.50 parts of the compound (103) were added to 70.0 parts of N,N-dimethylformamide, the mixture was ice-cooled to 10° C. or lower, the diazonium salt solution was added, and then the mixture was allowed to react at 10° C. or lower for 2 hours. After the completion of the reaction, 300 parts of water was added, the mixture was stirred for 30 minutes, the solid was separated by filtration and purified by a recrystallization method from N,N-dimethylformamide, thereby obtaining 7.62 parts of a compound (105) (Yield of 91.0%).

Next, 2.00 parts of the compound (105) was added to 20.0 parts of chloroform, the mixture was ice-cooled to 10° C. or lower, and then 0.855 part of 2-bromoisobutyryl bromide (106) was added. Then, the mixture was stirred at 65° C. for 2 hours. After the completion of the reaction, the mixture was extracted with chloroform and condensed, thereby obtaining 2.26 parts of an intermediate (107) (Yield of 92.0%).

Next, 0.684 part of the compound (107), 27.3 parts of styrene (108), 0.305 part of N,N,N',N'',N''-pentamethyl diethylene triamine, and 0.124 part of copper bromide (I) were added to 10.0 parts of N,N-dimethylformamide. Thereafter, the mixture was stirred at 100° C. under a nitrogen atmosphere for 7.5 hours. After the completion of the reaction, the mixture was extracted with chloroform, and purified by reprecipitation with methanol, thereby obtaining 8.50 parts of a compound (41) (Yield of 85.0%).

It was confirmed using each apparatus mentioned above that the obtained compounds have the structure represented by Formula above. The analysis results are shown below.

[Analysis results of the compound (41) having the azo skeleton unit]

[1] Molecular weight measurement (GPC) results:

Weight average molecular weight (Mw)=15117

Number average molecular weight (Mn)=12910

[2] Acid value measurement results:

0 mgKOH/g

[3] $^1$H NMR (400 MHz, $CDCl_3$, room temperature) results (refer to FIG. 1): δ [ppm]=15.65 (s, 1H), 14.77 (s, 1H), 11.40 (s, 1H), 11.41 (s, 1H), 8.62 (s, 1H), 8.15 (d, 1H), 7.79 (d, 1H), 7.74 (d, 2H), 7.64 (d, 2H), 7.37-6.27 (m, 738H), 4.07 (s, 3H), 3.98 (s, 3H), 3.73 (br, 2H), 2.72-2.52 (m, 9H), 2.47-1.05 (m, 458H), 1.01-0.78 (m, 6H)

Manufacturing Example of Compound (54)

A compound (54) having the azo skeleton was manufactured according to the following scheme.

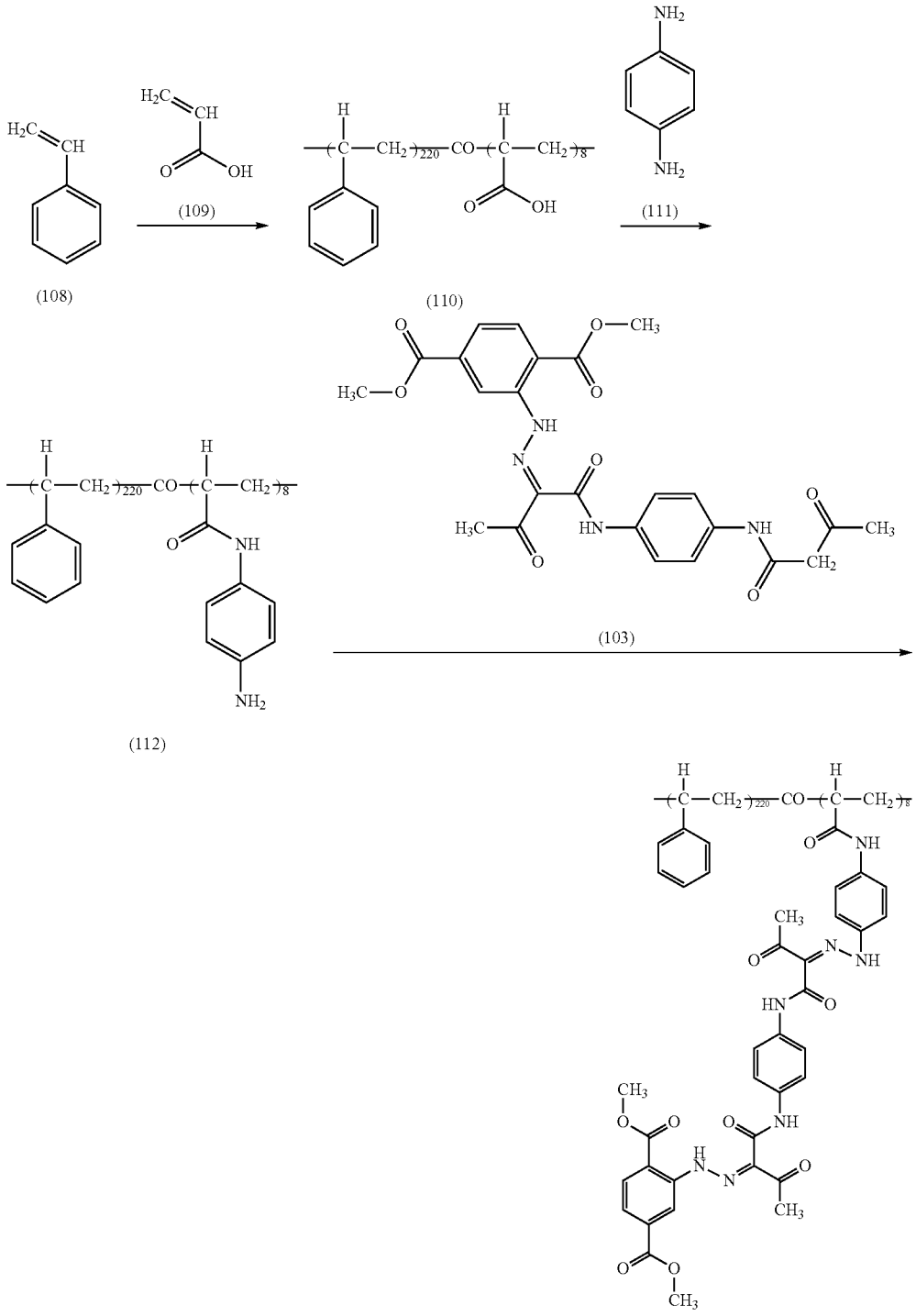

First, 100 parts of propylene glycol monomethyl ether was heated under nitrogen replacement, and then refluxed at a liquid temperature of 120° C. or higher. Then, a mixture of 190 parts of styrene (108), 10.0 parts of acrylic acid (109), and 1.00 part of tert-butylperoxybenzoate [organic peroxide polymerization initiator, Product name: Perbutyl Z, manufactured by NOF CORPORATION] was added dropwise thereto over 3 hours. After the completion of the dropwise addition, the solution was stirred for 3 hours, and then distilled at normal pressure while increasing the liquid temperature to 170° C. After the liquid temperature reached 170° C., the resultant mixture was distilled at 1 hPa under reduced pressure for 1 hour for desolventization, thereby obtaining a resin solid. The solid was dissolved in tetrahydrofuran, and then purified by reprecipitation with n-hexane, thereby obtaining 185 parts of a compound (110) (Yield of 92.5%).

Next, 3.00 parts of the compound (110) and 184 parts of oxalyl chloride were added to 15.0 parts of chloroform, and then stirred at room temperature under a nitrogen gas atmosphere for 5 hours. One in which 0.644 part of p-phenylene diamine (111) was dissolved in 10.0 parts of chloroform and 5.00 parts of N,N-dimethylformamide was added dropwise to this solution, and then the mixture was stirred at room temperature under nitrogen gas atmosphere for 2 hours. After the completion of the reaction, the resultant mixture was separated with chloroform/water, condensed, and then purified by reprecipitation with methanol, thereby obtaining 2.98 parts of a compound (112) (Yield of 90.3%).

Next, 10.0 parts of tetrahydrofurans and 0.252 part of concentrated hydrochloric acid were added to 1.00 part of the compound (112), and the mixture was ice-cooled to 0° C. or lower. One in which 0.0900 part of sodium nitrite was dissolved in 0.270 part of water was added to the solution, and then allowed to react at the same temperature for 1 hour. Subsequently, 0.063 part of sulfamic acid was added, and then the mixture was further stirred for 20 minutes (diazonium salt solution). One in which 0.446 part of potassium carbonate was dissolved in 1.50 parts of water and 0.354 part of the compound (103) were added to 15.0 parts of N,N-dimethylformamide, the mixture was ice-cooled to 10° C. or lower, the diazonium salt solution was added, and then the mixture was allowed to react at 10° C. or lower for 4 hours. After the completion of the reaction, 300 parts of water was added, the mixture was stirred for 30 minutes, the solid was separated by filtration and dissolved in chloroform followed by purifying by reprecipitation with methanol, thereby obtaining 0.970 part of a compound (54) (Yield of 97.0%).

Next, it was confirmed using each apparatus mentioned above that the obtained compounds have the structure represented by Formula above. The analysis results are shown below.

[Analysis Results of the Compound (54) Having the Azo Skeleton Unit]

[1] Molecular weight measurement (GPC) results:

Weight average molecular weight (Mw)=32442

Number average molecular weight (Mn)=18329

[2] Acid value measurement results:

0 mgKOH/g

Figure 2:
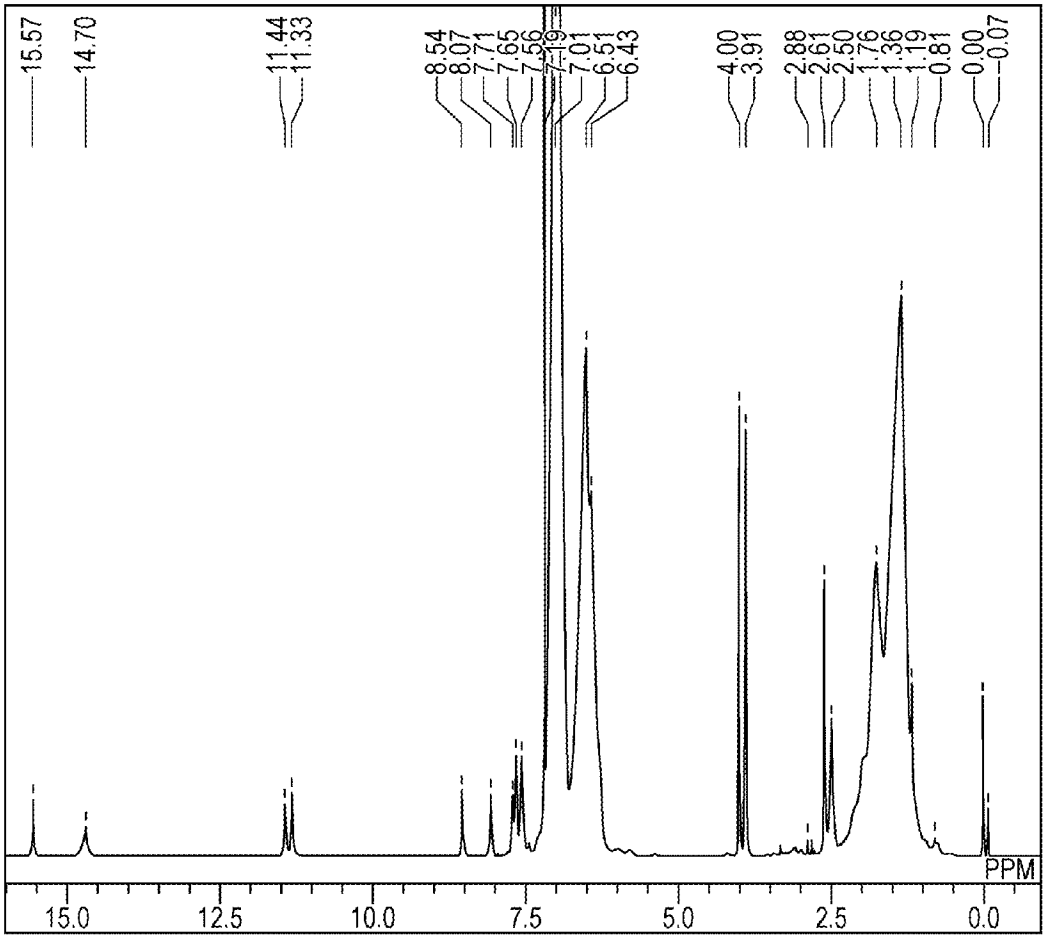
FIG. 2 is a view illustrating the $^1$H NMR spectrum at room temperature and at 400 MHz in $CDCl_3$ of a compound (54) having an azo skeleton unit.

[3] $^1$H NMR (400 MHz, $CDCl_3$, room temperature) results (refer to FIG. 2): δ [ppm]=15.57 (s, 1H), 14.70 (s, 1H), 11.44 (s, 1H), 11.33 (s, 1H), 8.54 (s, 1H), 8.07 (d, 1H), 7.71 (d, 1H), 7.65 (d, 2H), 7.56 (d, 2H), 7.19-6.43 (m, 136H), 4.00 (s, 3H), 3.91 (s, 3H), 2.61 (s, 3H), 2.50 (s, 3H), 1.76-0.81 (m, 97H).

Manufacturing Example of Compound (91)

A compound (91) having the azo skeleton represented by the following structure was manufactured according to the following scheme.

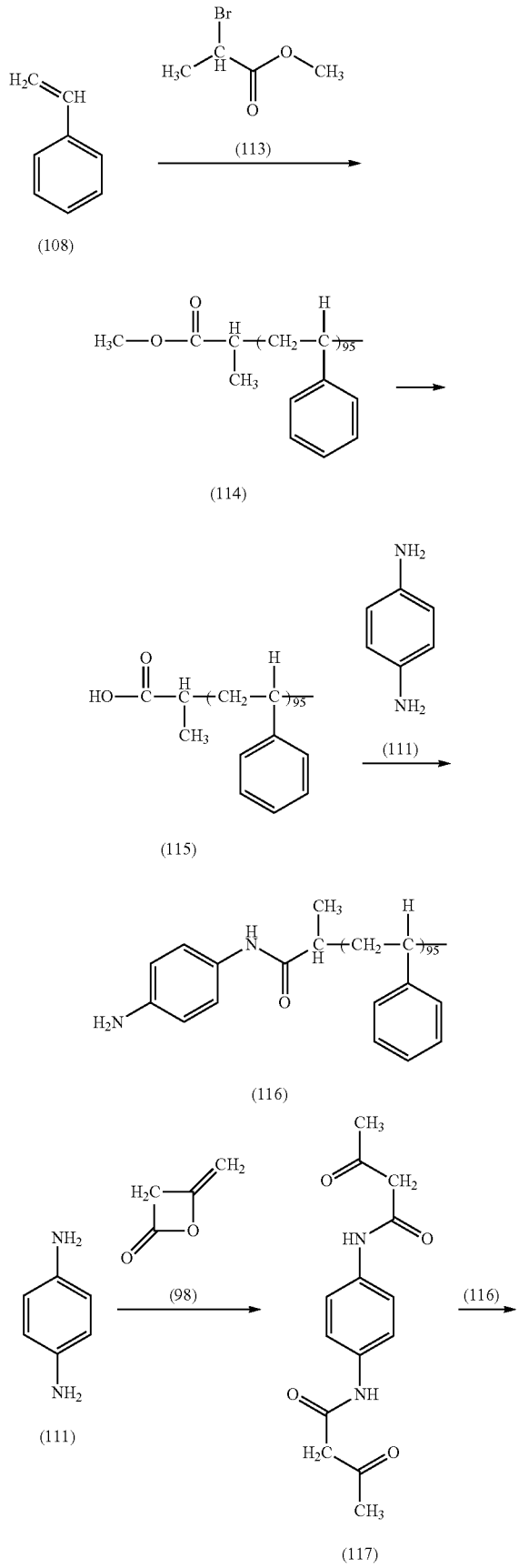

-continued

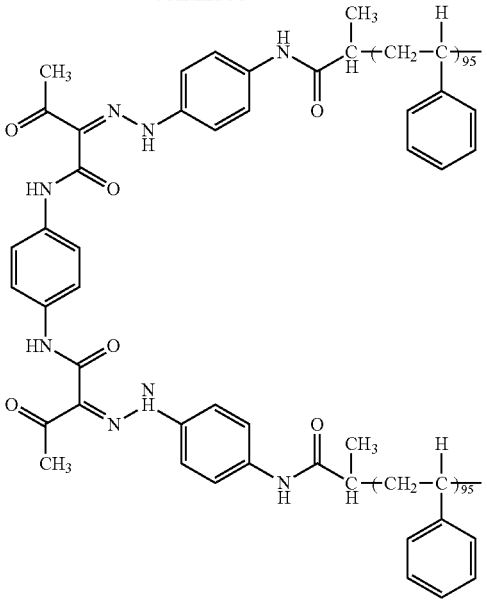

(91)

First, 60.0 parts of styrene (108), 1.47 parts of N,N,N',N'',N''-pentamethyl diethylene triamine, and 0.943 part of copper bromide (I) were added to 0.395 part of methyl 2-bromopropionate (113), and then the mixture was stirred at 100° C. under a nitrogen gas atmosphere for 5 hours. After the completion of the reaction, the mixture was extracted with chloroform, and then purified by reprecipitation with methanol, thereby obtaining 52.4 parts of a compound (114) (Yield of 81.9%).

Next, 1.00 part of the compound (114) was added to 150 parts of dioxane, the mixture was stirred at 110° C., a mixture of 5.00 parts of concentrated hydrochloric acid and 30 parts of dioxane was added, and then the mixture was stirred at 110° C. under a nitrogen gas atmosphere for 5 hours. After the completion of the reaction, the mixture was extracted with chloroform, and purified by reprecipitation with methanol, thereby obtaining 0.98 part of a compound (115) (Yield of 98.0%).

Next, 1.00 part of the compound (115) and 0.0160 part of oxalyl chloride were added to 5.00 parts of chloroform, and then the mixture was stirred at room temperature under a nitrogen gas atmosphere for 5 hours. One in which 0.0670 part of p-phenylene diamine (111) was dissolved in 10.0 parts of chloroform and 5.00 parts of N,N-dimethylformamide was added dropwise to the solution, and then the mixture was stirred at 60° C. under a nitrogen gas atmosphere for 2 hours. After the completion of the reaction, the mixture was separated with chloroform/water, concentrated, and then purified by reprecipitation with methanol, thereby obtaining 0.970 part of a compound (116) (Yield of 97.0%).

Next, 50.0 parts of p-phenylene diamine (111) and 35.0 parts of acetone were added to 300 parts of chloroform, the mixture was ice-cooled to 10° C. or lower, and 72.0 parts of diketene (98) was added. Then, the mixture was stirred at 65° C. for 2 hours. After the completion of the reaction, the mixture was extracted with chloroform and condensed, thereby obtaining 121 parts of a compound (117) (Yield of 97.4%).

Next, 40.0 parts of THF and 0.127 part of concentrated hydrochloric acid were added to 4.00 parts of the compound (116), and then the mixture was ice-cooled to 10° C. or lower. One in which 0.005 part of sodium nitrite was dissolved in 1.70 parts of water was added to the solution, and then allowed to react at the same temperature for 1 hour. Subsequently, 0.0320 part of sulfamic acid was added, and then the mixture was further stirred for 20 minutes (diazonium salt solution). One in which 0.230 part of potassium acetate was dissolved in 1.00 part of water and 0.0460 part of the compound (117) were added to 70.0 parts of methanol, the mixture was ice-cooled to 10° C. or lower, the diazonium salt solution was added, and then the mixture was allowed to react at 10° C. or lower for 2 hours. After the completion of the reaction, 300 parts of water was added, the mixture was stirred for 30 minutes, and then the solid was separated by filtration, followed by purification by reprecipitation with methanol, thereby obtaining 3.80 parts of a compound (91) (Yield of 95.0%).

[Analysis Results of Compound (91) having Azo Skeleton Unit]

[1] Molecular weight measurement (GPC) results:

Weight average molecular weight (Mw)=31686

Number average molecular weight (Mn)=22633

[2] Acid value measurement results:

0 mgKOH/g

Figure 3:
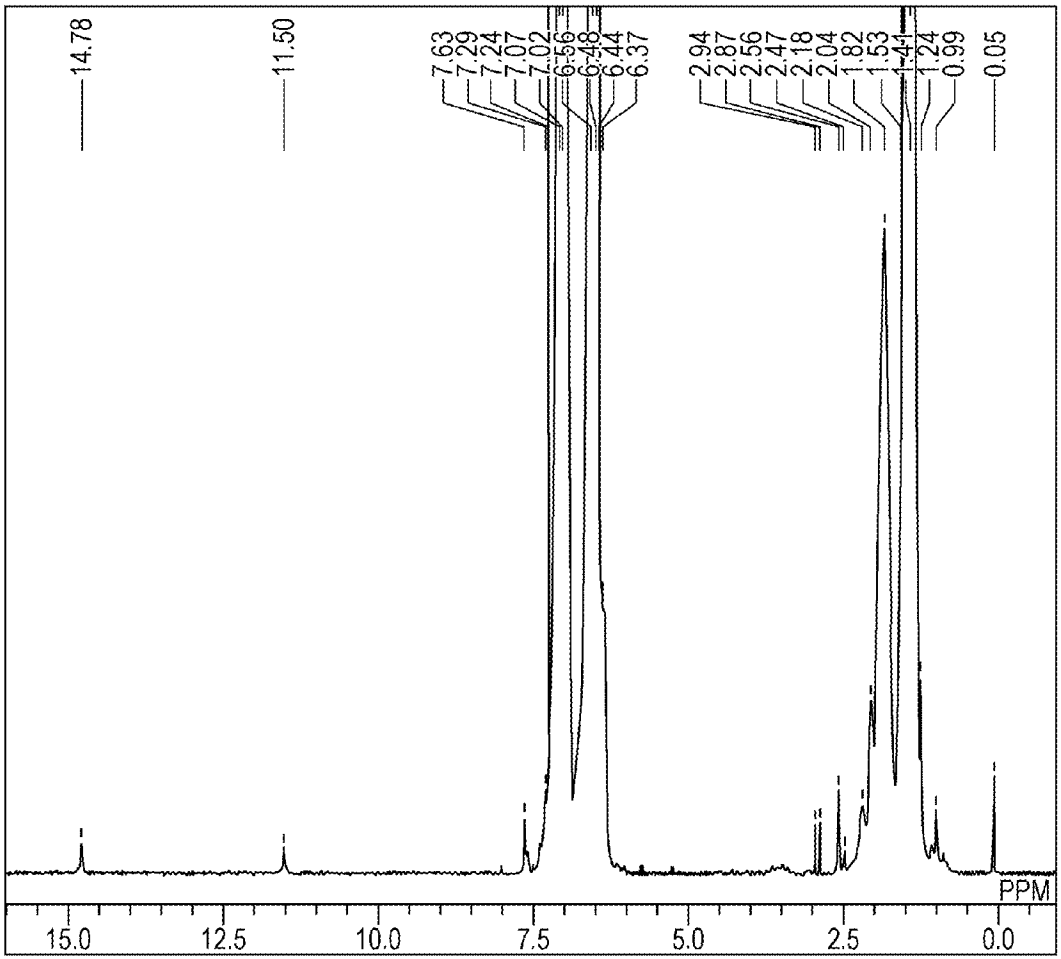
FIG. 3 is a view illustrating the $^1$H NMR spectrum at room temperature and at 400 MHz in $CDCl_3$ of a compound (91) having an azo skeleton unit.

[3] $^1$H NMR (400 MHz, $CDCl_3$, room temperature) results (refer to FIG. 3): δ [ppm]=14.78 (s, 2H), 11.50 (s, 2H), 7.63 (d, 4H), 7.29-6.37 (m, 1192H), 2.56 (s, 6H), 2.18-0.99 (m, 839H).

Manufacturing Example of Compound (93)

A compound (93) having the azo skeleton represented by the following structure was manufactured according to the following scheme.

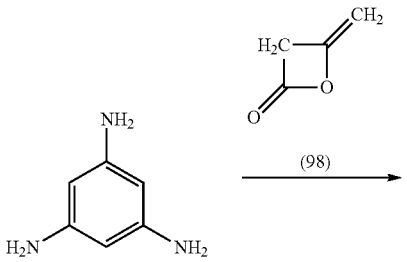

(118)

-continued

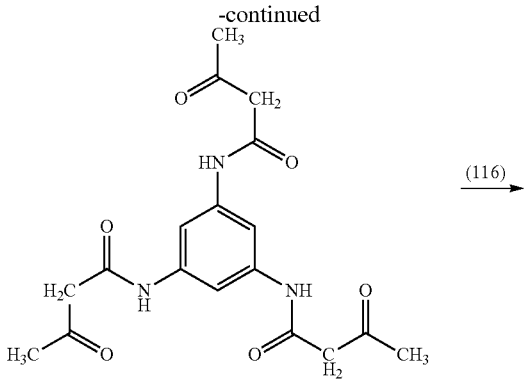

(119)

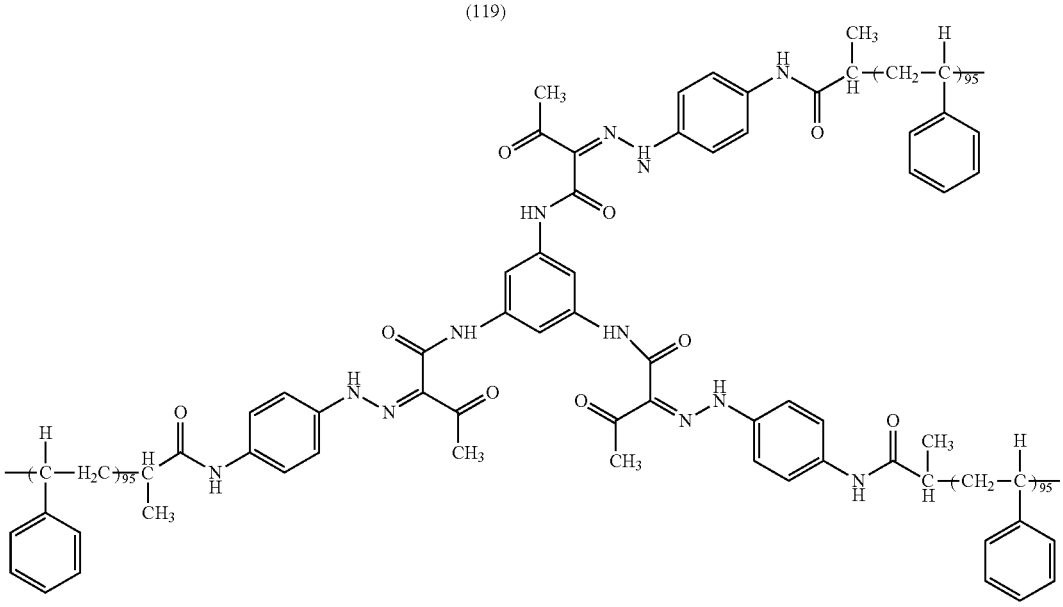

(93)

First, a compound (116) was obtained by the same operation as that of the manufacturing example of the compound (91).

Next, 0.500 part of 1,3,5-triaminobenzene (119) and 0.345 part of triethylamine were added to 10.0 parts of N,N-dimethylformamide, and then the mixture was stirred at room temperature. Next, 0.949 part of diketene (98) was added, and then the mixture was stirred at 50° C. for 2 hours. After the completion of the reaction, 300 parts of water was added, the mixture was stirred for 30 minutes, and then the solid was separated by filtration, thereby obtaining 1.41 parts of a compound (119) (Yield of 92.8%).

Next, 20 parts of DMF, 20.0 parts of THF, and 0.130 part of concentrated hydrochloric acid were added to 4.00 parts of the compound (116), and then the mixture was ice-cooled to 10° C. or lower. One in which 0.0450 part of sodium nitrite was dissolved in 0.136 part of water was added to this solution, and then the mixture was allowed to react at the same temperature for 1 hour. Subsequently, 0.0320 part of sulfamic acid was added, and then the mixture was further stirred for 20 minutes (diazonium salt solution). One in which 0.225 part of potassium acetate was dissolved in 1.00 part of water and 0.0440 part of the compound (119) were added to 15.0 parts of DMF, the mixture was ice-cooled to 10° C. or lower, the diazonium salt solution was added, and then the mixture was allowed to react at 10° C. or lower for 2 hours. After the completion of the reaction, 300 parts of water was added, the mixture was stirred for 30 minutes, and then the solid was separated by filtration and purified by a recrystallization method from N,N-dimethylformamide, thereby obtaining 3.78 parts of a compound (93) (Yield of 94.5%).

[Analysis Results of Compound (93) having Azo Skeleton Unit]

[1] Molecular weight measurement (GPC) results:

Weight average molecular weight (Mw)=48989

Number average molecular weight (Mn)=28481

[2] Acid value measurement results:

0 mgKOH/g

Figure 4:
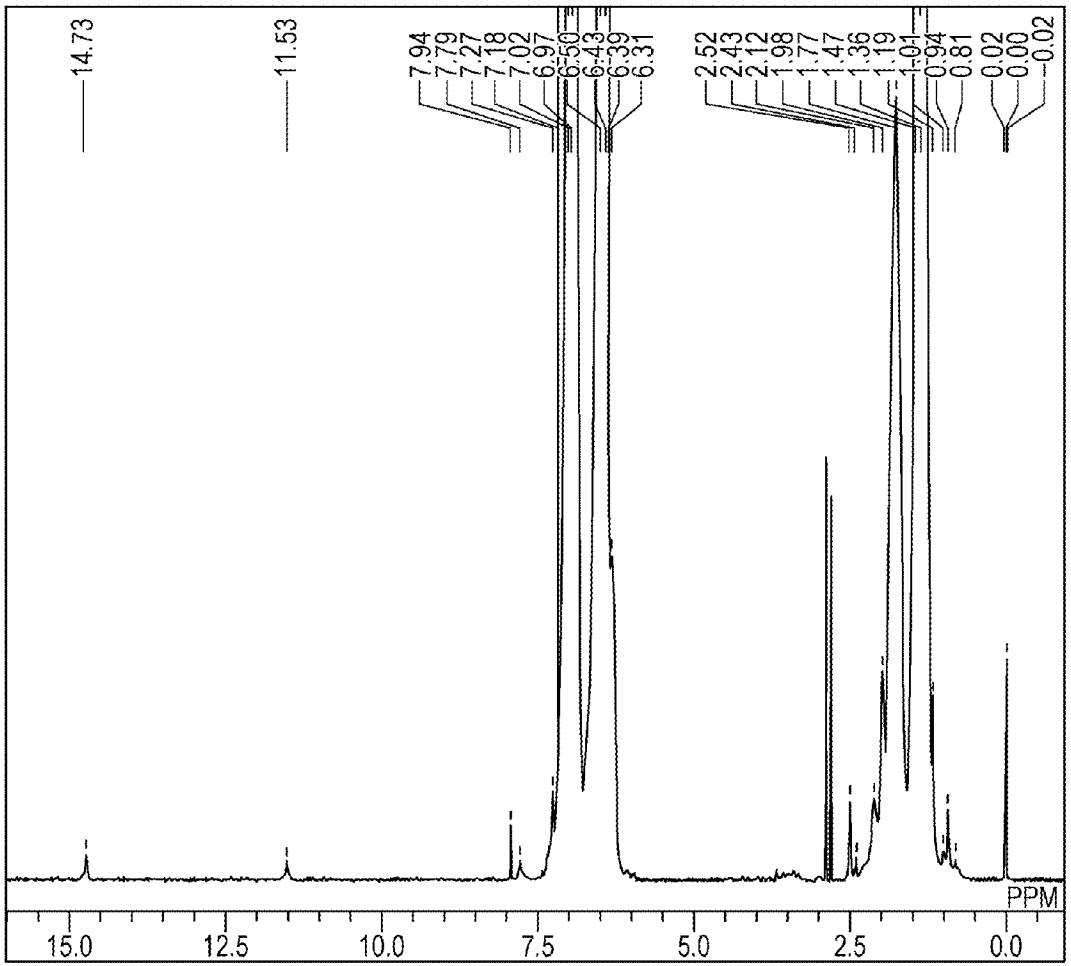
FIG. 4 is a view illustrating the $^1$H NMR spectrum at room temperature and at 400 MHz in $CDCl_3$ of a compound (93) having an azo skeleton unit.

[3] $^1$H NMR (400 MHz, $CDCl_3$, room temperature) results (refer to FIG. 4): δ [ppm]=14.73 (s, 3H), 11.53 (s, 3H), 7.79 (s, 3H), 7.27-6.31 (m, 2175H), 2.52 (s, 9H), 2.12-0.81 (m, 1461H).

Compounds having the azo skeleton unit (26) to (40), (42) to (53), (55) to (90), (92), and (94) to (96) were manufactured by the same operation as that of the synthesis examples of the compounds having the azo skeleton (41), (54), (91), and (93).

The following table 1 shows the polymer portions and the following tables 2-1 to 2-2 show the compounds having the azo skeleton.

TABLE 1

| Polymer portion | | | | | | | | | | | |
|---|---|---|---|---|---|---|---|---|---|---|---|
| Polymer portion No. | Sequential arrangement of monomer | Number of X | Number of $Y_1$ | Number of $Y_2$ | Number of Z | $R_{30}$ | $R_{31}$ | $R_{32}$ | $R_{33}$ | $R_{34}$ | $R_{35}$ |
| R-1 | α-W-polyX | 95 | 0 | 0 | 0 | H | — | — | — | — | — |
| R-2 | α-W-polyX | 149 | 0 | 0 | 0 | H | — | — | — | — | — |
| R-3 | α-W-poly$Y_1$ | 0 | 101 | 0 | 0 | — | H | $COOC_4H_9$(n) | — | — | — |
| R-4 | α-W-poly(X-co-$Y_1$) | 71 | 18 | 0 | 0 | H | H | $COOC_4H_9$(n) | — | — | — |
| R-5 | α-W-poly(X-co-$Y_1$) | 18 | 88 | 0 | 0 | H | H | $COOC_4H_9$(n) | — | — | — |
| R-6 | α-W-poly(X-co-$Y_1$) | 71 | 18 | 0 | 0 | H | H | $CONH_2$ | — | — | — |
| R-7 | α-W-poly(X-co-$Y_1$) | 71 | 18 | 0 | 0 | H | H | $COOCH_3$ | — | — | — |
| R-8 | α-W-poly(X-co-$Y_1$) | 71 | 18 | 0 | 0 | H | H | COOBn | — | — | — |
| R-9 | poly(X-co-$Y_1$-co-Z) | 141 | 30 | 0 | 11 | H | H | $COOC_4H_9$(n) | — | — | H |
| R-10 | poly(X-co-$Y_1$-co-Z) | 15 | 11 | 0 | 7 | $CH_3$ | $CH_3$ | $COOC_4H_9$(n) | — | — | H |
| R-11 | poly(X-co-$Y_1$-co-Z) | 220 | 4 | 0 | 4 | H | H | $COOCH_3$ | — | — | H |
| R-12 | poly(X-co-$Y_1$-co-Z) | 57 | 5 | 0 | 3 | H | H | $COOCH_2CH(C_2H_5)C_4H_9$ | — | — | H |
| R-13 | poly(X-co-$Y_1$-co-Z) | 49 | 4 | 0 | 2 | H | H | $COOC_{18}H_{37}$(n) | — | — | H |
| R-14 | poly(X-co-$Y_1$-co-Z) | 58 | 3 | 0 | 3 | H | H | $COOC_{22}H_{45}$(n) | — | — | H |
| R-15 | poly(X-co-$Y_1$-co-$Y_2$-co-Z) | 75 | 13 | 3 | 3 | H | H | $COOCH_3$ | H | $COOC_{22}H_{45}$(n) | H |
| R-16 | poly(X-co-$Y_1$-co-$Y_2$-co-Z) | 59 | 28 | 4 | 3 | H | H | $COOC_4H_9$(n) | H | $COOC_{22}H_{45}$(n) | H |
| R-17 | poly(X-co-Z) | 220 | 0 | 0 | 8 | H | — | — | — | — | H |
| R-18 | poly(X-co-Z) | 1174 | 0 | 0 | 384 | H | — | — | — | — | H |
| R-19 | poly($Y_1$-co-Z) | 0 | 90 | 0 | 10 | — | H | $COOC_4H_9$(n) | — | — | H |
| R-20 | polyX-b-polyZ | 84 | 0 | 0 | 5 | H | — | — | — | — | H |
| R-21 | poly(X-co-$Y_1$)-b-polyZ | 74 | 14 | 0 | 2 | H | H | $COOC_4H_9$(n) | — | — | H |

In Table 1, the prefix a represents a terminal group attached to the left of the structure. W represents a COOH group and X, Y, and Z represent the following structures. "Bn" represents an unsubstituted benzyl group and (n) represents that an alkyl group is linear.

X

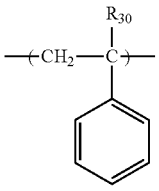

In Formula (X), $R_{30}$ represents a hydrogen atom or an alkyl group.

$Y_1$

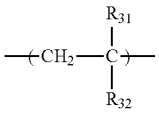

In Formula ($Y_1$), $R_{31}$ represents a hydrogen atom or an alkyl group and $R_{32}$ represents a carboxylic acid ester group or a carboxylic acid amide group.

$Y_2$

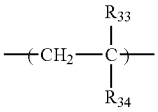

In Formula ($Y_2$), $R_{33}$ represents a hydrogen atom or and alkyl group and $R_{34}$ represents a carboxylic acid ester group or a carboxylic acid amide group.

Z

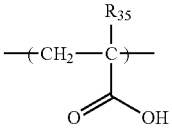

In Formula (Z), $R_{35}$ represents a hydrogen atom or an alkyl group.

TABLE 2-1

| Compound having azo skeleton unit | | | | | | | | | | | | | | | | | | | |
|---|---|---|---|---|---|---|---|---|---|---|---|---|---|---|---|---|---|---|---|
| Compound | Polymer portion | Bonding position with polymer portion | m | n | Introduction numbers of azo skeleton units | Substituent position of acetoacetamide groups | $R_1$ | $R_9$ | $R_{10}$ | $R_{11}$ | $R_{12}$ | $R_{13}$ | $R_{14}$ | $R_{15}$ | $R_{16}$ | $R_{17}$ | $R_{18}$ | $R_{19}$ | $R_{20}$ |
| 26 | R-1 | W | 4 | 1 | 1 | 1,4– | 2,3,5,6-H | $CH_3$ | $CH_3$ | $COOCH_3$ | H | H | $COOCH_3$ | H | H | H | $L_1$ | H | H |
| 27 | R-3 | W | 4 | 1 | 1 | 1,4– | 2,3,5,6-H | $CH_3$ | $CH_3$ | $COOCH_3$ | H | H | $COOCH_3$ | H | H | H | $L_1$ | H | H |
| 28 | R-4 | W | 4 | 1 | 1 | 1,4– | 2,3,5,6-H | $CH_3$ | $CH_3$ | $COOCH_3$ | H | H | $COOCH_3$ | H | H | H | $L_1$ | H | H |

TABLE 2-1-continued

| Compound having azo skeleton unit | | | | | | | | | | | | | | | | | | | | |
|---|---|---|---|---|---|---|---|---|---|---|---|---|---|---|---|---|---|---|---|---|
| Compound | Polymer portion | Bonding position with polymer portion | m | n | Introduction numbers of azo skeleton units | Substituent position of acetoacetamide groups | $R_1$ | $R_9$ | $R_{10}$ | $R_{11}$ | $R_{12}$ | $R_{13}$ | $R_{14}$ | $R_{15}$ | $R_{16}$ | $R_{17}$ | $R_{18}$ | $R_{19}$ | $R_{20}$ |
| 29 | R-5 | W | 4 | 1 | 1 | 1,4– | 2,3,5,6-H | $CH_3$ | $CH_3$ | $COOCH_3$ | H | H | $COOCH_3$ | H | H | H | $L_1$ | H | H |
| 30 | R-6 | W | 4 | 1 | 1 | 1,4– | 2,3,5,6-H | $CH_3$ | $CH_3$ | $COOCH_3$ | H | H | $COOCH_3$ | H | H | H | $L_1$ | H | H |
| 31 | R-7 | W | 4 | 1 | 1 | 1,4– | 2,3,5,6-H | $CH_3$ | $CH_3$ | $COOCH_3$ | H | H | $COOCH_3$ | H | H | H | $L_1$ | H | H |
| 32 | R-8 | W | 4 | 1 | 1 | 1,4– | 2,3,5,6-H | $CH_3$ | $CH_3$ | $COOCH_3$ | H | H | $COOCH_3$ | H | H | H | $L_1$ | H | H |
| 33 | R-1 | W | 4 | 1 | 1 | 1,4– | 2,3,5,6-H | $CH_3$ | $CH_3$ | $COOCH_3$ | H | H | $COOCH_3$ | H | H | H | $L_2$ | H | H |
| 34 | R-4 | W | 4 | 1 | 1 | 1,4– | 2,3,5,6-H | $CH_3$ | $CH_3$ | $COOCH_3$ | H | H | $COOCH_3$ | H | H | H | $L_2$ | H | H |
| 35 | R-1 | W | 4 | 1 | 1 | 1,4– | 2,3,5,6-H | $CH_3$ | $CH_3$ | $COOCH_3$ | H | H | $COOCH_3$ | H | H | H | $L_3$ | H | H |
| 36 | R-4 | W | 4 | 1 | 1 | 1,4– | 2,3,5,6-H | $CH_3$ | $CH_3$ | $COOCH_3$ | H | H | $COOCH_3$ | H | H | H | $L_3$ | H | H |
| 37 | R-1 | W | 4 | 1 | 1 | 1,4– | 2,3,5,6-H | $CH_3$ | $CH_3$ | $COOCH_3$ | H | H | $COOCH_3$ | H | H | H | $L_4$ | H | H |
| 38 | R-4 | W | 4 | 1 | 1 | 1,4– | 2,3,5,6-H | $CH_3$ | $CH_3$ | $COOCH_3$ | H | H | $COOCH_3$ | H | H | H | $L_4$ | H | H |
| 39 | R-1 | W | 4 | 1 | 1 | 1,4– | 2,3,5,6-H | $CH_3$ | $CH_3$ | $COOCH_3$ | H | H | $COOCH_3$ | H | H | H | $L_5$ | H | H |
| 40 | R-4 | W | 4 | 1 | 1 | 1,4– | 2,3,5,6-H | $CH_3$ | $CH_3$ | $COOCH_3$ | H | H | $COOCH_3$ | H | H | H | $L_5$ | H | H |
| 41 | R-2 | W | 4 | 1 | 1 | 1,4– | 2,3,5,6-H | $CH_3$ | $CH_3$ | $COOCH_3$ | H | H | $COOCH_3$ | H | H | H | $L_8$ | H | H |
| 42 | R-4 | W | 4 | 1 | 1 | 1,4– | 2,3,5,6-H | $CH_3$ | $CH_3$ | $COOCH_3$ | H | H | $COOCH_3$ | H | H | H | $L_6$ | H | H |
| 43 | R-9 | Z | 4 | 1 | 1 | 1,4– | 2,3,5,6-H | $CH_3$ | $CH_3$ | $COOCH_3$ | H | H | $COOCH_3$ | H | H | H | $L_7$ | H | H |
| 44 | R-9 | Z | 4 | 1 | 11 | 1,4– | 2,3,5,6-H | $CH_3$ | $CH_3$ | $COOCH_3$ | H | H | $COOCH_3$ | H | H | H | $L_7$ | H | H |
| 45 | R-10 | Z | 4 | 1 | 2 | 1,4– | 2,3,5,6-H | $CH_3$ | $CH_3$ | $COOCH_3$ | H | H | $COOCH_3$ | H | H | H | $L_7$ | H | H |
| 46 | R-10 | Z | 4 | 1 | 7 | 1,4– | 2,3,5,6-H | $CH_3$ | $CH_3$ | $COOCH_3$ | H | H | $COOCH_3$ | H | H | H | $L_7$ | H | H |
| 47 | R-11 | Z | 4 | 1 | 4 | 1,4– | 2,3,5,6-H | $CH_3$ | $CH_3$ | $COOCH_3$ | H | H | $COOCH_3$ | H | H | H | $L_7$ | H | H |
| 48 | R-12 | Z | 4 | 1 | 3 | 1,4– | 2,3,5,6-H | $CH_3$ | $CH_3$ | $COOCH_3$ | H | H | $COOCH_3$ | H | H | H | $L_7$ | H | H |
| 49 | R-13 | Z | 4 | 1 | 2 | 1,4– | 2,3,5,6-H | $CH_3$ | $CH_3$ | $COOCH_3$ | H | H | $COOCH_3$ | H | H | H | $L_7$ | H | H |
| 50 | R-14 | Z | 4 | 1 | 3 | 1,4– | 2,3,5,6-H | $CH_3$ | $CH_3$ | $COOCH_3$ | H | H | $COOCH_3$ | H | H | H | $L_7$ | H | H |
| 51 | R-15 | Z | 4 | 1 | 3 | 1,4– | 2,3,5,6-H | $CH_3$ | $CH_3$ | $COOCH_3$ | H | H | $COOCH_3$ | H | H | H | $L_7$ | H | H |
| 52 | R-16 | Z | 4 | 1 | 3 | 1,4– | 2,3,5,6-H | $CH_3$ | $CH_3$ | $COOCH_3$ | H | H | $COOCH_3$ | H | H | H | $L_7$ | H | H |
| 53 | R-17 | Z | 4 | 1 | 6 | 1,4– | 2,3,5,6-H | $CH_3$ | $CH_3$ | $COOCH_3$ | H | H | $COOCH_3$ | H | H | H | $L_7$ | H | H |
| 54 | R-17 | Z | 4 | 1 | 8 | 1,4– | 2,3,5,6-H | $CH_3$ | $CH_3$ | $COOCH_3$ | H | H | $COOCH_3$ | H | H | H | $L_7$ | H | H |
| 55 | R-18 | Z | 4 | 1 | 197 | 1,4– | 2,3,5,6-H | $CH_3$ | $CH_3$ | $COOCH_3$ | H | H | $COOCH_3$ | H | H | H | $L_7$ | H | H |
| 56 | R-19 | Z | 4 | 1 | 8 | 1,4– | 2,3,5,6-H | $CH_3$ | $CH_3$ | $COOCH_3$ | H | H | $COOCH_3$ | H | H | H | $L_7$ | H | H |
| 57 | R-20 | Z | 4 | 1 | 5 | 1,4– | 2,3,5,6-H | $CH_3$ | $CH_3$ | $COOCH_3$ | H | H | $COOCH_3$ | H | H | H | $L_7$ | H | H |
| 58 | R-21 | Z | 4 | 1 | 1 | 1,4– | 2,3,5,6-H | $CH_3$ | $CH_3$ | $COOCH_3$ | H | H | $COOCH_3$ | H | H | H | $L_7$ | H | H |
| 59 | R-1 | W | 4 | 1 | 1 | 1,4– | 2,3,5,6-H | $CH_3$ | $CH_3$ | $COOCH_3$ | H | H | $COOCH_3$ | H | H | H | $L_8$ | H | H |
| 60 | R-1 | W | 4 | 1 | 1 | 1,4– | 2,3,5,6-H | $C_6H_{13}$ (n) | Ph | $COOCH_3$ | H | H | $COOCH_3$ | H | H | H | $L_8$ | H | H |
| 61 | R-1 | W | 4 | 1 | 1 | 1,4– | 2-OH 3,6-H 5-CI | $CH_3$ | $CH_3$ | $COOCH_3$ | H | H | $COOCH_3$ | H | H | H | $L_8$ | H | H |

TABLE 2-2

| Compound having azo skeleton unit | | | | | | | | | | | |
|---|---|---|---|---|---|---|---|---|---|---|---|
| Compound | Polymer portion | Bonding position with polymer portion | m | n | Introduction numbers of azo skeleton units | Substituent position of acetoacetamide groups | $R_1$ | $R_9$ | $R_{10}$ | $R_{11}$ | $R_{12}$ |
| 62 | R-1 | W | 4 | 1 | 1 | 1,4– | 2-$OCH_3$ 3,5,6-H | $CH_3$ | $CH_3$ | $COOCH_3$ | H |
| 63 | R-1 | W | 4 | 1 | 1 | 1,4– | 2,3,5,6-H | $CH_3$ | $CH_3$ | $COOCH_3$ | H |
| 64 | R-1 | W | 4 | 1 | 1 | 1,4– | 2-$CF_3$ 3,5,6-H | $CH_3$ | $CH_3$ | $COOCH_3$ | H |
| 65 | R-1 | W | 4 | 1 | 1 | 1,4– | 2-CN 3,5,6-H | $CH_3$ | $CH_3$ | $COOCH_3$ | H |
| 66 | R-1 | W | 4 | 1 | 1 | 1,4– | 2,3,5,6-H | $CH_3$ | $CH_3$ | $CH_3$ | H |
| 67 | R-1 | W | 4 | 1 | 1 | 1,4– | 2,3,5,6-H | $CH_3$ | $CH_3$ | H | $CF_3$ |
| 68 | R-1 | W | 4 | 1 | 1 | 1,4– | 2,3,5,6-H | $CH_3$ | $CH_3$ | H | H |
| 69 | R-1 | W | 4 | 1 | 1 | 1,4– | 2,3,5,6-H | $CH_3$ | $CH_3$ | H | CN |
| 70 | R-1 | W | 4 | 1 | 1 | 1,4– | 2,3,5,6-H | $CH_3$ | $CH_3$ | COOH | H |
| 71 | R-1 | W | 4 | 1 | 1 | 1,4– | 2,3,5,6-H | $CH_3$ | $CH_3$ | $COOC_2H_5$ | H |
| 72 | R-1 | W | 4 | 1 | 1 | 1,4– | 2,3,5,6-H | $CH_3$ | $CH_3$ | COOPr(n) | H |
| 73 | R-1 | W | 4 | 1 | 1 | 1,4– | 2,3,5,6-H | $CH_3$ | $CH_3$ | COOPr(i) | H |
| 74 | R-1 | W | 4 | 1 | 1 | 1,4– | 2,3,5,6-H | $CH_3$ | $CH_3$ | $CONH_2$ | H |

TABLE 2-2-continued

Compound having azo skeleton unit

| | | | | | | | | | | | |
|---|---|---|---|---|---|---|---|---|---|---|---|
| 75 | R-1 | W | 4 | 1 | 1 | 1,4– | 2,3,5,6-H | $CH_3$ | $CH_3$ | $CONHCH_3$ | H |
| 76 | R-1 | W | 4 | 1 | 1 | 1,4– | 2,3,5,6-H | $CH_3$ | $CH_3$ | $CONHC_2H_5$ | H |
| 77 | R-1 | W | 4 | 1 | 1 | 1,4– | 2,3,5,6-H | $CH_3$ | $CH_3$ | CONHPr(i) | H |
| 78 | R-1 | W | 4 | 1 | 1 | 1,4– | 2,3,5,6-H | $CH_3$ | $CH_3$ | CONHPr(n) | H |
| 79 | R-1 | W | 4 | 1 | 1 | 1,4– | 2,3,5,6-H | $CH_3$ | $CH_3$ | $CON(C_2H_5)_2$ | H |
| 80 | R-1 | W | 4 | 1 | 1 | 1,4– | 2,3,5,6-H | $CH_3$ | $CH_3$ | $COOCH_3$ | H |
| 81 | R-1 | W | 4 | 1 | 1 | 1,4– | 2,3,5,6-H | $CH_3$ | $CH_3$ | H | $COOCH_3$ |
| 82 | R-1 | W | 4 | 1 | 1 | 1,4– | 2,3,5,6-H | $CH_3$ | $CH_3$ | H | H |
| 83 | R-1 | W | 4 | 1 | 1 | 1,4– | 2,3,5,6-H | $CH_3$ | $CH_3$ | H | $COOCH_3$ |
| 84 | R-1 | W | 4 | 1 | 1 | 1,4– | 2,3,5,6-H | $CH_3$ | $CH_3$ | H | $CONH_2$ |
| 85 | R-1 | W | 4 | 1 | 1 | 1,4– | 2,3,5,6-H | $CH_3$ | $CH_3$ | H | H |
| 86 | R-1 | W | 4 | 1 | 1 | 1,3– | 2,3,5,6-H | $CH_3$ | $CH_3$ | $COOCH_3$ | H |
| 87 | R-1 | W | 4 | 1 | 1 | 1,2– | 2,3,5,6-H | $CH_3$ | $CH_3$ | $COOCH_3$ | H |
| 88 | R-1 | W | 4 | 1 | 1 | 1,4– | 2,3,5,6-H | $CH_3$ | $CH_3$ | $COOCH_3$ | H |
| 89 | R-1 | W | 4 | 1 | 1 | 1,4– | 2,3,5,6-H | $CH_3$ | $CH_3$ | $COOCH_3$ | H |
| 90 | R-1 | W | 4 | 1 | 1 | 1,4– | 2,3,5,6-H | $CH_3$ | $CH_3$ | $COOCH_3$ | H |
| 91 | R-1 | W | 4 | 1 | 1 | 1,4– | 2,3,5,6-H | $CH_3$ | $CH_3$ | H | H |
| 92 | R-1 | W | 4 | 1 | 1 | 1,4– | 2,3,5,6-H | $CH_3$ | $CH_3$ | H | $L_6$ |
| 93 | R-1 | W | 3 | 2 | 1 | 1,3,5– | 2,4,6-H | $CH_3$ | $CH_3$ | H | H |
| 94 | R-1 | W | 3 | 2 | 1 | 1,2,3– | 2,4,6-H | $CH_3$ | $CH_3$ | H | H |
| 95 | R-1 | W | 3 | 2 | 1 | 1,2,5– | 2-$CH_3$ 6-H | $CH_3$ | $CH_3$ | H | H |
| 96 | R-1 | W | 3 | 2 | 1 | 1,3,5– | 2,6-H | $CH_3$ | $CH_3$ | H | $L_6$ |

| Compound | $R_{13}$ | $R_{14}$ | $R_{15}$ | $R_{16}$ | $R_{17}$ | $R_{18}$ | $R_{19}$ | $R_{20}$ |
|---|---|---|---|---|---|---|---|---|
| 62 | H | $COOCH_3$ | H | H | H | $L_8$ | H | H |
| 63 | H | $COOCH_3$ | H | H | H | $L_8$ | H | H |
| 64 | H | $COOCH_3$ | H | H | H | $L_8$ | H | H |
| 65 | H | $COOCH_3$ | H | H | H | $L_8$ | H | H |
| 66 | Cl | H | H | H | H | $L_8$ | H | H |
| 67 | H | H | H | H | H | $L_8$ | H | H |
| 68 | $OCH_2CH_3$ | H | H | H | H | $L_8$ | H | H |
| 69 | H | H | H | H | H | $L_8$ | H | H |
| 70 | H | COOH | H | H | H | $L_8$ | H | H |
| 71 | H | $COOC_2H_5$ | H | H | H | $L_8$ | H | H |
| 72 | H | COOPr(n) | H | H | H | $L_8$ | H | H |
| 73 | H | COOPr(i) | H | H | H | $L_8$ | H | H |
| 74 | H | $CONH_2$ | H | H | H | $L_8$ | H | H |
| 75 | H | $CONHCH_3$ | H | H | H | $L_8$ | H | H |
| 76 | H | $CONHC_2H_5$ | H | H | H | $L_8$ | H | H |
| 77 | H | CONHPr(i) | H | H | H | $L_8$ | H | H |
| 78 | H | CONHPr(n) | H | H | H | $L_8$ | H | H |
| 79 | H | $CON(C_2H_5)_2$ | H | H | H | $L_8$ | H | H |
| 80 | H | H | H | H | H | $L_8$ | H | H |
| 81 | H | H | H | H | H | $L_8$ | H | H |
| 82 | $COOCH_3$ | H | H | H | H | $L_8$ | H | H |
| 83 | H | $COOCH_3$ | H | H | H | $L_8$ | H | H |
| 84 | H | H | H | H | H | $L_8$ | H | H |
| 85 | $CONH_2$ | H | H | H | H | $L_8$ | H | H |
| 86 | H | $COOCH_3$ | H | H | H | $L_8$ | H | H |
| 87 | H | $COOCH_3$ | H | H | H | $L_8$ | H | H |
| 88 | H | $COOCH_3$ | H | H | $L_8$ | H | H | H |
| 89 | H | $COOCH_3$ | H | $L_8$ | H | H | H | H |
| 90 | H | $COOCH_3$ | H | H | $L_8$ | H | $L_8$ | H |
| 91 | $L_8$ | H | H | H | H | $L_8$ | H | H |
| 92 | H | $L_6$ | H | H | $L_8$ | H | $L_8$ | H |
| 93 | $L_8$ | H | H | H | H | $L_8$ | H | H |
| 94 | $L_8$ | H | H | H | H | $L_8$ | H | H |
| 95 | $L_8$ | H | H | H | H | $L_8$ | H | H |
| 96 | H | $L_6$ | H | H | $L_8$ | H | $L_8$ | H |

In Tables 2-1 to 2-2 m, n, $R_1$, and $R_9$ to $R_{20}$ represent m, n, $R_1$, and $R_9$ to $R_{20}$ in the following Formula (3), respectively. "Pr" represents an unsubstituted propyl group, "Ph" represents an unsubstituted phenyl group, and (n) and (i) represent that alkyl groups are linear or branched, respectively. The compounds in which the "Linking portion with polymer portion" is "W" are bonded to the COOH groups represented by "W" in the polymer portions shown in Table 1 to form the linking groups L. The compounds in which the "Linking portion with polymer portion" is "Z" are bonded to the COOH groups in the monomers "Z" in the polymer portions shown in Table 1 to form the linking groups L. $L_1$ to $L_8$ in Tables 2-1 to 2-2 represent the linking groups L with a polymer resin and represent the following structures.

Formula (3)

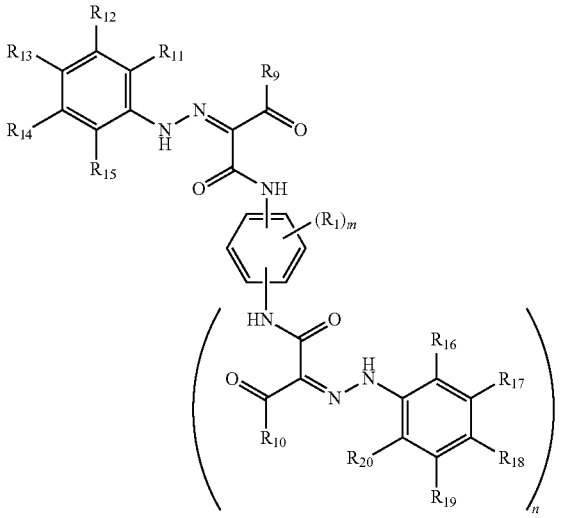

$L_1$

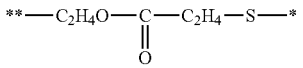

"*" in Formula ($L_1$) represents the linking portion with the polymer portions shown in Table 1. "**" represents the linking portion in the azo skeleton structure represented by Formula (1) above.

$L_2$

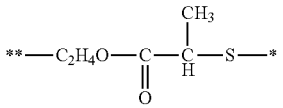

"*" in Formula ($L_2$) represents the linking portion with the polymer portions shown in Table 1. "**" represents the linking portion in the azo skeleton structure represented by Formula (1) above.

$L_3$

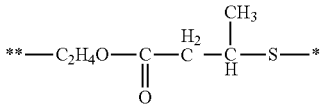

"*" in Formula ($L_3$) represents the linking portion with the polymer portions shown in Table 1. "**" represents the linking portion in the azo skeleton structure represented by Formula (1) above.

$L_4$

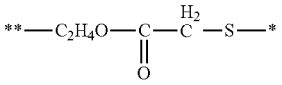

"*" in Formula ($L_4$) represents the linking portion with the polymer portions shown in Table 1. "**" represents the linking portion in the azo skeleton structure represented by Formula (1) above.

$L_5$

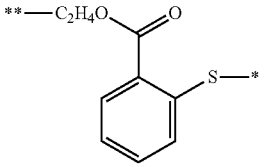

"*" in Formula ($L_5$) represents the linking portion with the polymer portions shown in Table 1. "**" represents the linking portion in the azo skeleton structure represented by Formula (1) above.

$L_6$

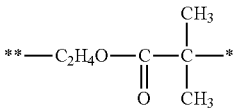

"*" in Formula ($L_6$) represents the linking portion with the polymer portions shown in Table 1. "**" represents the linking portion in the azo skeleton structure represented by Formula (1) above.

$L_7$

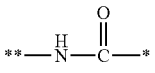

"*" in Formula ($L_7$) represents the linking portion with the polymer portions shown in Table 1. "**" represents the linking portion in the azo skeleton structure represented by Formula (1) above.

$L_8$

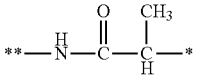

"*" in Formula ($L_8$) represents the linking portion with the polymer portions shown in Table 1. "**" represents the linking portion in the azo skeleton structure represented by Formula (1) above.

Example 2

First, carbon black dispersion liquids containing carbon black and the compounds having the azo skeleton unit in a toner manufacturing process by a suspension polymerization method were prepared by the following methods.

Preparation Example 1 of Carbon Black Dispersion Liquid 30.0 parts of carbon black (a) (Specific surface area=65 $m^2/g$, Average particle diameter=30 nm, pH=9.0) as a colorant, 3.0 parts of the compound (26) having the azo skeleton unit, 180 parts of styrene as a non-water soluble solvent, and 130 parts of glass beads (ϕ 1 mm) were mixed, and then the mixture was dispersed by an attritor [manufactured by NIPPON COKE & ENGINEERING. CO., LTD.] for 3 hours, followed by filtration through a mesh, thereby obtaining a carbon black dispersion liquid (DIS1).

Preparation Example 2 of Carbon Black Dispersion Liquid

Carbon black dispersion liquids (DIS2) to (DIS71) were obtained by performing the same operation, except changing the compound (26) having the azo skeleton unit in Preparation Example 1 of the carbon black dispersion liquid described above to the compounds (27) to (96) having the azo skeleton unit, respectively.

Preparation Example 3 of Carbon Black Dispersion Liquid

Carbon black dispersion liquids (DIS72) and (DIS73) were obtained by performing the same operation, except changing the carbon black (a) (Specific surface area=65 $m^2/g$, Average particle diameter=30 nm, pH=9.0) in Preparation Example 1 of the carbon black dispersion liquid described above to carbon black (b) (Specific surface area=77 $m^2/g$, Average particle diameter=28 nm, pH=7.5) and carbon black (c) (Specific surface area=370 $m^2/g$, Average particle diameter=13 nm, pH=3.0), respectively.

Comparative Example 1

A carbon black dispersion liquid serving as a reference value of evaluation and a comparative carbon black dispersion liquid were prepared by the following methods.

Preparation Example 1 of Reference Carbon Black Dispersion Liquid

A reference carbon black dispersion liquid (DIS74) was obtained by performing the same operation, except not adding the compound (26) having the azo skeleton unit in Preparation Example 1 of the carbon black dispersion liquid of Example 2 described above.

Preparation Example 2 of Reference Carbon Black Dispersion Liquid

Reference carbon black dispersion liquids (DIS75) and (DIS76) were obtained by performing the same operation, except not adding the compound (26) having the azo skeleton unit in Preparation Example 3 of the carbon black dispersion liquid of Example 2 described above.

Preparation Example 1 of Comparative Carbon Black Dispersion Liquid

Comparative carbon black dispersion liquids (DIS77) to (DIS79) were obtained by performing the same operation, except changing the compound (26) having the azo skeleton unit in Preparation Example 1 of the carbon black dispersion liquid of Example 2 described above to a styrene homopolymer (Mw=10,976) (Comparative Compound 1), a styrene/butylacrylate [Copolymerization ratio (mass ratio)=80/20] random polymer (Mw=10,804) (Comparative Compound 2), and styrene/butylacrylate [Copolymerization ratio (mass ratio)=95/5] block copolymer (Mw=9,718) (Comparative Compound 3) described in Japanese Patent No. 3285623, respectively.

Example 3

The carbon black dispersion liquids were evaluated by the following method.

Evaluation of Dispersibility in Carbon Black Dispersion Liquid

The carbon black dispersibility of the compounds having an azo pigment skeleton unit of the invention were evaluated by performing a gloss test of coating films of the carbon black dispersion liquids. More specifically, the carbon black dispersion liquid was dipped out with a syringe, placed in the shape of a straight line in the upper portion of a super art paper [SA Kanefuji, 180 kg, 80×160, manufactured by Oji Paper Co., Ltd.], uniformly coated onto an art paper using a wire bar (#10), and then the gloss (Reflection angle: 75°) after drying was measured with a gloss meter Gloss Meter VG2000 [manufactured by NIPPON DENSHOKU INDUSTRIES CO., LTD.] and evaluated according to the following criteria. When the carbon black more finely dispersed, the smoothness of the coating films improves, so that the gloss improves.

A: Gloss value of 80% higher

B: Gloss value of 50% or higher and lower than 80%

C: Gloss value of 20% or higher and lower than 50%

D: Gloss value of lower than 20%

When the gloss value was 20% or higher, it was judged that the carbon black dispersibility was good.

The evaluation results of the carbon black dispersion liquids are shown in Table 3.

TABLE 3

Evaluation results of carbon black dispersion liquids

| Carbon black dispersion liquid | Compound | Carbon black | Gloss (Gloss value) |
|---|---|---|---|
| DIS1 | 26 | (a) | A(110) |
| DIS2 | 27 | (a) | A(108) |
| DIS3 | 28 | (a) | A(102) |
| DIS4 | 29 | (a) | A(99) |
| DIS5 | 30 | (a) | A(107) |
| DIS6 | 31 | (a) | A(110) |
| DIS7 | 32 | (a) | A(115) |
| DIS8 | 33 | (a) | A(100) |
| DIS9 | 34 | (a) | A(102) |
| DIS10 | 35 | (a) | A(109) |
| DIS11 | 36 | (a) | A(110) |
| DIS12 | 37 | (a) | A(101) |
| DIS13 | 38 | (a) | A(103) |
| DIS14 | 39 | (a) | A(115) |
| DIS15 | 40 | (a) | A(102) |

TABLE 3-continued

Evaluation results of carbon black dispersion liquids

| Carbon black dispersion liquid | Compound | Carbon black | Gloss (Gloss value) |
|---|---|---|---|
| DIS16 | 41 | (a) | A(114) |
| DIS17 | 42 | (a) | A(103) |
| DIS18 | 43 | (a) | A(109) |
| DIS19 | 44 | (a) | A(100) |
| DIS20 | 45 | (a) | A(109) |
| DIS21 | 46 | (a) | A(112) |
| DIS22 | 47 | (a) | A(105) |
| DIS23 | 48 | (a) | A(108) |
| DIS24 | 49 | (a) | A(101) |
| DIS25 | 50 | (a) | A(110) |
| DIS26 | 51 | (a) | A(104) |
| DIS27 | 52 | (a) | A(115) |
| DIS28 | 53 | (a) | A(110) |
| DIS29 | 54 | (a) | A(109) |
| DIS30 | 55 | (a) | A(101) |
| DIS31 | 56 | (a) | A(115) |
| DIS32 | 57 | (a) | A(114) |
| DIS33 | 58 | (a) | A(103) |
| DIS34 | 59 | (a) | A(114) |
| DIS35 | 60 | (a) | A(86) |
| DIS36 | 61 | (a) | A(96) |
| DIS37 | 62 | (a) | A(110) |
| DIS38 | 63 | (a) | A(122) |
| DIS39 | 64 | (a) | A(103) |
| DIS40 | 65 | (a) | A(98) |
| DIS41 | 66 | (a) | A(85) |
| DIS42 | 67 | (a) | A(88) |
| DIS43 | 68 | (a) | A(92) |
| DIS44 | 69 | (a) | A(85) |
| DIS45 | 70 | (a) | A(109) |
| DIS46 | 71 | (a) | A(98) |
| DIS47 | 72 | (a) | A(95) |
| DIS48 | 73 | (a) | A(96) |
| DIS49 | 74 | (a) | A(102) |
| DIS50 | 75 | (a) | A(114) |
| DIS51 | 76 | (a) | A(113) |
| DIS52 | 77 | (a) | A(109) |
| DIS53 | 78 | (a) | A(110) |
| DIS54 | 79 | (a) | A(115) |
| DIS55 | 80 | (a) | A(92) |
| DIS56 | 81 | (a) | A(98) |
| DIS57 | 82 | (a) | A(90) |
| DIS58 | 83 | (a) | A(100) |
| DIS59 | 84 | (a) | A(103) |
| DIS60 | 85 | (a) | A(110) |
| DIS61 | 86 | (a) | A(105) |
| DIS62 | 87 | (a) | A(109) |
| DIS63 | 88 | (a) | A(114) |
| DIS64 | 89 | (a) | A(101) |
| DIS65 | 90 | (a) | A(107) |
| DIS66 | 91 | (a) | A(112) |
| DIS67 | 92 | (a) | A(109) |
| DIS68 | 93 | (a) | A(115) |
| DIS69 | 94 | (a) | A(118) |
| DIS70 | 95 | (a) | A(112) |
| DIS71 | 96 | (a) | A(106) |
| DIS72 | 26 | (b) | B(64) |
| DIS73 | 26 | (c) | A(100) |
| DIS74 | None | (a) | D(5) |
| DIS75 | None | (b) | C(42) |
| DIS76 | None | (c) | D(2) |
| DIS77 | Comparative Compound 1 | (a) | D(17) |
| DIS78 | Comparative Compound 2 | (a) | C(23) |
| DIS79 | Comparative Compound 3 | (a) | D(15) |

Example 4

Next, toners of the invention by a suspension polymerization method were manufactured by the following method.

Manufacturing Example 1 of Toner 710 parts of ion exchange water and 450 parts of an aqueous 0.1 mol/1-$Na_3PO_4$ solution were added into a 2 L four-necked flask having a high-speed stirring apparatus T.K. homomixer [manufactured by PRIMIX Corporation], the number of rotations was adjusted to 12000 rpm, and then the flask was warmed to 60° C. 68 parts of an aqueous 1.0 mol/1-$CaCl_2$ solution was gradually added thereto, thereby preparing an aqueous medium containing a minute poor water-soluble dispersion stabilizer $Ca_3(PO_4)_2$. Next, the following composition was warmed to 60° C., and then uniformly dissolved and dispersed at 5000 rpm using a high-speed stirring apparatus T.K. homomixer [manufactured by PRIMIX Corporation].

| | |
|---|---|
| Carbon black dispersion liquid (DIS1) above | 132 parts |
| Styrene monomer | 46 parts |
| n-butyl acrylate monomer | 34 parts |
| Polar resin [Saturated polyester resin (terephthalic acid-propylene oxide modified bisphenol A, Acid value 15, Peak molecular weight 6000)] | 10 parts |
| Ester wax (Maximum endothermic peak in DSC measurement = 70° C., Mn = 704) | 25 parts |
| Salicylic acid aluminum compound (manufactured by Orient Chemical Industries Co., Ltd., Product name: BONTRON E-108) | 2 parts |
| Divinylbenzene monomer | 0.1 part |

10 parts of 2,2'-azobis(2,4-dimethylvaleronitrile) which is a polymerization initiator was added thereto, the mixture was put in the above-described aqueous medium, and then granulation was performed for 15 minutes while maintaining the number of rotations of 12000 rpm. Thereafter, the stirrer was changed to a propeller stirring blade from the high-speed stirrer, polymerization was continued at a liquid temperature of 60° C. for 5 hours, the liquid temperature was increased to 80° C., and then the polymerization was continued for 8 hours. After the end of the polymerization reaction, a residual monomer was distilled off at 80° C. under reduced pressure, and then the resultant substance was cooled to 30° C., thereby obtaining a polymer fine particle dispersion liquid.

The obtained polymer fine particle dispersion liquid was transferred to a washing vessel, diluted hydrochloric acid was added under stirring, the mixture was stirred at a pH of 1.5 for 2 hours, a compound of phosphoric acid and calcium containing $Ca_3(PO_4)_2$ was dissolved, and then the solution was subjected to solid-liquid separation with a filtering unit, thereby obtaining polymer fine particles. The polymer fine particles were put in water and stirred to form a dispersion liquid again, and thereafter the dispersion liquid was subjected to solid-liquid separation with a filtering unit. The redispersion of the polymer fine particles in water and the solid-liquid separation were repeatedly until the compound of phosphoric acid and calcium containing $Ca_3(PO_4)_2$ was sufficiently removed. Thereafter, the polymer fine particles in which the solid-liquid separation was finally achieved were sufficiently dried with a drier, thereby obtaining toner particles.

1.0 part (Number average diameter of primary particles of 7 nm) of hydrophobic silica fine powder which was surface treated with hexamethyldisilazane, 0.15 part (Number average diameter of primary particles of 45 nm) of rutile-type titanium dioxide fine powder, and 0.5 part (Number average diameter of primary particles of 200 nm) of rutile-type titanium dioxide fine powder were dry-mixed with 100 parts of the obtained toner particles for 5 minutes by a Henschel mixer [manufactured by NIPPON COKE & ENGINEERING. CO., LTD.], thereby obtaining a toner (TNR1).

Manufacturing Example 2 of Toner

Toners (TNR2) to (TNR71) of the invention were obtained in the same manner as in Manufacturing Example 1 of toner, except changing the carbon black dispersion liquid (DIS1) in Manufacturing Example 1 of toner described above to the carbon black dispersion liquids (DIS2) to (DIS71), respectively.

Manufacturing Example 3 of Toner

Toners (TNR72) and (TNR73) of the invention were obtained in the same manner as in Manufacturing Example 1 of toner, except changing the carbon black dispersion liquid (DIS1) in Manufacturing Example 1 of toner described above to the carbon black dispersion liquids (DIS72), respectively (DIS73).

Comparative Example 2

Toners serving as a reference value of evaluation and comparative toners were manufactured by the following method to the toners of the invention manufactured in Example 4 above.

Manufacturing Example 1 of Reference Toner

A reference toner (TNR74) was obtained in the same manner as in Manufacturing Example 1 of toner, except changing the carbon black dispersion liquid (DIS1) in Manufacturing Example 1 of toner described above to the carbon black dispersion liquid (DIS74).

Manufacturing Example 2 of Reference Toner

Reference toners (TNR75) and (TNR76) were obtained in the same manner as in Manufacturing Example 1 of toner, except changing the carbon black dispersion liquid (DIS1) in Manufacturing Example 1 of toner described above to the carbon black dispersion liquids (DIS75) and (DIS76), respectively.

Manufacturing Example 1 of Comparative Toner

Comparative toners (TNR77) to (TNR79) were obtained in the same manner as in Manufacturing Example 1 of toner, except changing the carbon black dispersion liquid (DIS1) in Manufacturing Example 1 of toner described above to the carbon black dispersion liquids (DIS77) to (DIS79), respectively.

Example 5

Next, toners of the invention by a suspension granulation method were manufactured by the following method.

Manufacturing Example 4 of Toner 180 parts of ethyl acetate, 30 parts of carbon black (a), 3.0 parts of the compound (26) having the azo skeleton unit, 130 parts of glass beads (1 mm in diameter) were mixed, and then the mixture was dispersed by an attritor [manufactured by NIPPON COKE & ENGINEERING. CO., LTD.] for 3 hours, followed by filtration through a mesh, thereby preparing a carbon black dispersion liquid.

By dispersing the following composition in a ball mill for 24 hours, 200 parts of a toner composition mixed liquid was obtained.

| | |
|---|---|
| Carbon black dispersion liquid above | 96.0 parts |
| Polar resin [saturated polyester resin (Polycondensate of propylene oxide modified bisphenol A and phthalic acid, Tg = 75.9° C., Mw = 11000, Mn = 4200, Acid value of 11)] | 85.0 parts |
| Hydrocarbon wax (Fischer Tropsch wax, Maximum endothermic peak in DSC measurement = 80° C., Mw = 750) | 9.0 parts |
| Salicylic acid aluminum compound [BONTRON E-108, manufactured by Orient Chemical Industries Co., Ltd.] | 2 parts |
| Ethyl acetate (solvent) | 10.0 parts |

By dispersing the following composition in a ball mill for 24 hours, carboxymethyl cellulose was dissolved, thereby obtaining an aqueous medium.

| | |
|---|---|
| Calcium carbonate (covered with an acrylic acid copolymer) | 20.0 parts |
| Carboxymethyl cellulose [CELLOGEN BS-H, manufactured by Dai-Ichi Kogyo Seiyaku Co., Ltd.] | 0.5 part |
| Ion exchange water | 99.5 parts |

1200 parts of the aqueous medium was put in a high-speed stirring apparatus T.K. homomixer [manufactured by PRIMIX Corporation], 1000 parts of the toner composition mixed liquid was put therein under stirring with a peripheral velocity of a rotating blade of 20 m/sec, and then the mixture was stirred for 1 minute while constantly maintaining 25° C., thereby obtaining a suspension liquid.

The liquid temperature was constantly maintained at 40° C. while stirring 2200 parts of the suspension liquid at a peripheral velocity of 45 m/min by a full zone blade [manufactured by KOBELCO ECO-SOLUTIONS Co., Ltd.], the gaseous phase on the suspension liquid surface was forcibly sucked using a blower, and then the removal of the solvent was initiated. In this case, 75 parts of ammonia water diluted to 1% was added as an ionic substance after 15 minutes passed after the solvent removal was initiated. Then, after 1 hour passed after the solvent removal was initiated, 25 parts of the ammonia water was added. Then, after 2 hours passed after the solvent removal was initiated, 25 parts of the ammonia water was added. Finally, after 3 hours passed after the solvent removal was initiated, 25 parts of the ammonia water was added, so that the total addition amount was 150 parts. The liquid was held for 17 hours from the initiation of the solvent removal while maintaining the liquid temperature at 40° C., thereby obtaining a toner dispersion liquid in which the solvent (ethyl acetate) was removed from the suspended particles.

80 parts of 10 mol/L hydrochloric acid was added to 300 parts of the toner dispersion liquid obtained in the solvent removal process, neutralization treatment was performed with an aqueous 0.1 mol/L sodium hydroxide solution, and then washing with ion exchange water by suction filtration was repeated 4 times, thereby obtaining a toner cake. The obtained toner cake was dried with a vacuum dryer, and then sieved through a sieve with an opening of 45 μm, thereby obtaining toner particles. The subsequent operation was performed in the same manner as in Manufacturing Example 1 of toner described above, thereby obtaining a toner (TNR80).

Manufacturing Example 5 of Toner

Toners of the invention (TNR81) and (TNR150) were obtained by the same operation, except changing the compound (26) having the azo skeleton unit in Manufacturing Example 4 described above to the compounds (27) to (96), respectively.

Manufacturing Example 6 of Toner

Toners of the invention (TNR151) and (TNR152) were obtained in the same manner as in Manufacturing Example 5 of toner described above, except changing the carbon black (a) to carbon black (b) and carbon black (c), respectively.

Comparative Example 3

Toners serving as a reference value of evaluation and comparative toners were prepared by the following method to the toners of the invention manufactured in Example 5.

Manufacturing Example 3 of Reference Toner

A reference toner (TNR153) was obtained in the same manner as in Manufacturing Example 4 of toner described above, except not adding the compound (26) having the azo skeleton unit.

Manufacturing Example 4 of Reference Toner

Reference toners (TNR154) and (TNR155) were obtained in the same manner as in Manufacturing Example 6 of toner described above, except not adding the compound (26) having the azo skeleton unit.

Manufacturing Example 2 of Comparative Toner

Comparative toners (TNR156) to (TNR158) were obtained in the same manner as in Manufacturing Example 4 of toner described above, except changing the compound (26) having the azo skeleton unit above to a styrene homopolymer (Mw=10,976) (Comparative Compound 1), a styrene/butylacrylate [Copolymerization ratio (mass ratio)=80/20] random copolymer (Mw=10,804) (Comparative Compound 2), and a styrene/butylacrylate [Copolymerization ratio (mass ratio)=95/5] block copolymer (Mw=9,718) (Comparative Compound 3) described in Patent Document 1.

Example 6

The toners obtained by the invention were evaluated by the following methods.

Image samples were output using the toners (TNR1) to (TNR76) and (TNR80) to (TNR155), and then comparatively evaluated for the image properties described later. The paper passage durability using a modified machine of LBP-5300 (manufactured by CANON KABUSHIKI KAISHA) as an image formation apparatus (hereinafter abbreviated as LBP) was performed when comparing the image properties. As modified parts, a development blade in a process cartridge (hereinafter referred to as CRG) was exchanged to an SUS blade having a thickness of 8 [μm]. Then, the application of a blade bias of −200 [V] to a development bias applied to a development roller which is a toner support was achieved.

Measurement of weight average particle diameter D4 and number average particle diameter D1 of toner An interface [manufactured by nikkaki bios Co., Ltd.] and a personal computer which output the number distribution and the volume distribution using a Coulter Multisizer [manufactured by Beckman Coulter] were connected. As an electrolytic solution, an aqueous 1% NaCl solution using sodium chloride is used. For example, ISOTON R-II [manufactued by Beckman Coulter] can be used. A specific measurement procedure is described in the catalog (February, 2002 version) of Coulter Multisizer publisded by Coulter and the operations manual of measurent devices and is as follows.

2 to 20 mg of measurement samples were added to 100 to 150 ml of the aqueous electrolytic solutions. The electrolytic solutions in which the samples were suspended were dispersed for about 1 to 3 minutes with an ultrasonic dispersion unit, and then the volume and the number of toner particles of 2.0 μm or more and 64.0 μm or lower were measured using a 100 μm aperture of the Coulter Multisizer. The obtained data was distributed to 16 channels, and then the weight average particle diameter D4, the number average particle diameter D1, and D4/D1 were determined.

The measurement evaluation results of the weight average particle diameter D4 and D4/D1 of the toners by a suspension polymerization method of the invention are shown in Tables 4-1 to 4-2 and the measurement evaluation results of the weight average particle diameter D4 and D4/D1 of the toners by a suspension granulation method are shown in Tables 5-1 to 5-2.

Evaluation of Coloring Power of Toner

Solid images with a toner applied amount of 0.5 mg/cm$^2$ were formed on a transfer paper (75 g/m$^2$ paper) under an environment of normal temperature and normal humidity [N/N (23.5° C., 60% RH)]. The density of the solid images was measured using a reflection densitometer Spectrolino (manufactured by GretagMacbeth). The coloring power of the toners was evaluated based on an improvement rate of the solid image density.

With respect to the improvement rate of the solid image density of the toners (TNR1) to (TNR73), the solid image density of the reference toners (TNR74) to (TNR76) was used as a reference value.

With respect to the improvement rate of the solid image density of the toners (TNR80) to (TNR152), the solid image density of the reference toners (TNR153) to (TNR155) was used as a reference value.

The evaluation criteria of the coloring power of the toners are shown below.

A: Improvement rate of solid image density of 60% or higher

B: Improvement rate of solid image density of 40% or higher and lower than 60%

C: Improvement rate of solid image density of 20% or higher and lower than 40%

D: Improvement rate of solid image density of lower than 20%

When the improvement rate of the solid image density was 20% or higher, it was judged that the coloring power was good.

The evaluation results of the coloring power of the toners by a suspension polymerization method of the invention are shown in Tables 4-1 to 4-2 and the evaluation results of the coloring power of the toners by a suspension granulation method are shown in Tables 5-1 to 5-2.

Evaluation of Fogging of Toner

In an image output test in which images with a printing ratio of 2% were printed out up to 10,000 sheets using a transfer paper (75 g/m$^2$ paper) under an environment of normal temperature and normal humidity [N/N (23.5° C., 60% RH)] and under an environment of high temperature and high humidity [H/H (30° C., 80% RH)], images having a blank space at the completion of durabilility evaluation were output, and then the fogging density (%) [=Dr(%)−Ds(%)] was calculated from a difference between the whiteness degree [Reflectance Ds (%)] of the blank space of the printed-out images and the whiteness degree [Average reflectance Dr (%)] of the transfer paper measured by "REFLECTMETER MODEL TC-6DS [manufactured by Tokyo Denshoku CO., LTD.]", whereby the fogging at the completion of durability evaluation was evaluated.

The evaluation criteria of the toner fogging are shown below.

A: Fogging density of lower than 1.0%

B: Fogging density of 1.0% or higher and lower than 2.0%

C: Fogging density of 2.0% or higher and lower than 3.0%

D: Fogging density of 3.0% or higher

When the fogging density was lower than 3%, it was judged that the toner did not pose problems in practical use.

The evaluation results of the fogging density of the toners by a suspension polymerization method of the invention are shown in Tables 4-1 to 4-2 and the evaluation results of the fogging density of the toners by a suspension granulation method are shown in Tables 5-1 to 5-2.

Evaluation of Transferability of Toner

In an image output test in which images with a printing ratio of 2% were printed out up to 10,000 sheets using a transfer paper (75 g/m$^2$ paper) under an environment of high temperature and high humidity [H/H (30° C., 80% RH)], the transfer efficiency was confirmed at the completion of durability evaluation. Solid images with a toner applied amount of 0.65 mg/cm$^2$ were developed on a drum, and then transferred to a transfer paper (75 g/m$^2$ paper), thereby obtaining unfixed images. The transfer efficiency was determined from a change in the weight between the toner amount on the drum and the toner amount on the transfer paper (A case where the entire amount of the toner on the drum is transferred onto the transfer paper is defined as a transfer efficiency of 100%.).

The evaluation criteria of the transfer efficiency of the toners are shown below.

A: Transfer efficiency of 95% or higher

B: Transfer efficiency of 90% or higher and lower than 95%

C: Transfer efficiency of 80% or higher and lower than 90%

D: Transfer efficiency of lower than 80%

When the transfer efficiency was 80% or higher, it was judged that the transfer efficiency was good.

The evaluation results of the transfer efficiency of the toners by a suspension polymerization method of the invention are shown in Tables 4-1 to 4-2 and the evaluation results of the transfer efficiency of the toners by a suspension granulation method are shown in Tables 5-1 to 5-2.

Comparative Example 4

Each of the comparative toners (TNR77) to (TNR79) and (TNR156) to (TNR158) was evaluated for the weight average particle diameter D4, D4/D1, coloring power, fogging, and transfer efficiency by the same methods as those of Example 6.

With respect to the improvement rate of the solid image density of the comparative toners (TNR77) to (TNR79), the solid image density of the reference toner (TNR74) was used as a reference value.

With respect to the improvement rate of the solid image density of the comparative toners (TNR156) to (TNR158), the solid image density of the reference toner (TNR153) was used as a reference value.

The evaluation results of the comparative toners by a suspension polymerization method are shown in Tables 4-1 to 4-2 and the evaluation results of the comparative toners by a suspension granulation method are shown in Tables 5-1 to 5-2.

TABLE 4-1

Evaluation results of toner by suspension polymerization method of invention

| Toner | Carbon black dispersion liquid | Compound | Carbon black | Toner particles D4 [μm] | D4/D1 | Coloring power | Fogging [N/N] | Fogging [H/H] | Transferability |
|---|---|---|---|---|---|---|---|---|---|
| TNR1 | DIS1 | 26 | (a) | 6.20 | 1.18 | A | A | A | A |
| TNR2 | DIS2 | 27 | (a) | 6.39 | 1.12 | A | A | A | A |
| TNR3 | DIS3 | 28 | (a) | 6.15 | 1.18 | A | A | A | A |
| TNR4 | DIS4 | 29 | (a) | 6.22 | 1.18 | A | A | A | A |
| TNR5 | DIS5 | 30 | (a) | 6.18 | 1.21 | A | A | A | A |
| TNR6 | DIS6 | 31 | (a) | 6.34 | 1.23 | A | A | A | A |
| TNR7 | DIS7 | 32 | (a) | 6.29 | 1.18 | A | A | A | A |
| TNR8 | DIS8 | 33 | (a) | 6.41 | 1.20 | A | A | A | A |
| TNR9 | DIS9 | 34 | (a) | 6.16 | 1.15 | A | A | A | A |
| TNR10 | DIS10 | 35 | (a) | 6.32 | 1.18 | A | A | A | A |
| TNR11 | DIS11 | 36 | (a) | 6.20 | 1.22 | A | A | A | A |
| TNR12 | DIS12 | 37 | (a) | 6.25 | 1.20 | A | A | A | A |
| TNR13 | DIS13 | 38 | (a) | 6.09 | 1.22 | A | A | A | A |
| TNR14 | DIS14 | 39 | (a) | 6.16 | 1.21 | A | A | A | A |
| TNR15 | DIS15 | 40 | (a) | 6.38 | 1.18 | A | A | A | A |
| TNR16 | DIS16 | 41 | (a) | 6.11 | 1.21 | A | A | A | A |
| TNR17 | DIS17 | 42 | (a) | 6.36 | 1.20 | A | A | A | A |
| TNR18 | DIS18 | 43 | (a) | 6.29 | 1.16 | A | A | A | A |
| TNR19 | DIS19 | 44 | (a) | 6.06 | 1.15 | A | A | A | A |
| TNR20 | DIS20 | 45 | (a) | 6.13 | 1.15 | A | A | A | A |
| TNR21 | DIS21 | 46 | (a) | 6.25 | 1.18 | A | A | A | A |
| TNR22 | DIS22 | 47 | (a) | 6.38 | 1.31 | A | A | A | A |
| TNR23 | DIS23 | 48 | (a) | 6.08 | 1.23 | A | A | A | A |
| TNR24 | DIS24 | 49 | (a) | 6.21 | 1.20 | A | A | A | A |
| TNR25 | DIS25 | 50 | (a) | 6.35 | 1.10 | A | A | A | A |

TABLE 4-1-continued

| Evaluation results of toner by suspension polymerization method of invention | | | | | | | | | |
|---|---|---|---|---|---|---|---|---|---|
| | Carbon black | | | Toner particles | | | | | |
| Toner | dispersion liquid | Com-pound | Carbon black | D4 [μm] | D4/D1 | Coloring power | Fogging [N/N] | Fogging [H/H] | Transfer-ability |
| TNR26 | DIS26 | 51 | (a) | 6.24 | 1.26 | A | A | A | A |
| TNR27 | DIS27 | 52 | (a) | 6.30 | 1.20 | A | A | A | A |
| TNR28 | DIS28 | 53 | (a) | 6.38 | 1.21 | A | A | A | A |
| TNR29 | DIS29 | 54 | (a) | 6.10 | 1.23 | A | A | A | A |
| TNR30 | DIS30 | 55 | (a) | 6.12 | 1.18 | A | A | A | A |
| TNR31 | DIS31 | 56 | (a) | 6.24 | 1.12 | A | A | A | A |
| TNR32 | DIS32 | 57 | (a) | 6.09 | 1.15 | A | A | A | A |
| TNR33 | DIS33 | 58 | (a) | 6.36 | 1.21 | A | A | A | A |
| TNR34 | DIS34 | 59 | (a) | 6.12 | 1.39 | A | A | A | A |
| TNR35 | DIS35 | 60 | (a) | 6.25 | 1.23 | A | A | A | A |
| TNR36 | DIS36 | 61 | (a) | 6.08 | 1.22 | A | A | A | A |
| TNR37 | DIS37 | 62 | (a) | 6.18 | 1.40 | A | A | A | A |
| TNR38 | DIS38 | 63 | (a) | 6.26 | 1.18 | A | A | A | A |
| TNR39 | DIS39 | 64 | (a) | 6.16 | 1.12 | A | A | A | A |

TABLE 4-2

| Evaluation results of toner by suspension polymerization method of invention | | | | | | | | | |
|---|---|---|---|---|---|---|---|---|---|
| | Carbon black | | | Toner particles | | | | | |
| Toner | dispersion liquid | Com-pound | Carbon black | D4 [μm] | D4/D1 | Coloring power | Fogging [N/N] | Fogging [H/H] | Transfer-ability |
| TNR40 | DIS40 | 65 | (a) | 6.27 | 1.20 | A | A | A | A |
| TNR41 | DIS41 | 66 | (a) | 6.11 | 1.18 | A | A | A | A |
| TNR42 | DIS42 | 67 | (a) | 6.30 | 1.15 | A | A | A | A |
| TNR43 | DIS43 | 68 | (a) | 6.14 | 1.35 | A | A | A | A |
| TNR44 | DIS44 | 69 | (a) | 6.06 | 1.18 | A | A | A | A |
| TNR45 | DIS45 | 70 | (a) | 6.25 | 1.22 | A | A | A | A |
| TNR46 | DIS46 | 71 | (a) | 6.21 | 1.16 | A | A | A | A |
| TNR47 | DIS47 | 72 | (a) | 6.32 | 1.15 | A | A | A | A |
| TNR48 | DIS48 | 73 | (a) | 6.16 | 1.18 | A | A | A | A |
| TNR49 | DIS49 | 74 | (a) | 6.28 | 1.20 | A | A | A | A |
| TNR50 | DIS50 | 75 | (a) | 6.32 | 1.13 | A | A | A | A |
| TNR51 | DIS51 | 76 | (a) | 6.34 | 1.15 | A | A | A | A |
| TNR52 | DIS52 | 77 | (a) | 6.13 | 1.32 | A | A | A | A |
| TNR53 | DIS53 | 78 | (a) | 6.38 | 1.16 | A | A | A | A |
| TNR54 | DIS54 | 79 | (a) | 6.20 | 1.13 | A | A | A | A |
| TNR55 | DIS55 | 80 | (a) | 6.29 | 1.15 | A | A | A | A |
| TNR56 | DIS56 | 81 | (a) | 6.27 | 1.21 | A | A | A | A |
| TNR57 | DIS57 | 82 | (a) | 6.16 | 1.18 | A | A | A | A |
| TNR58 | DIS58 | 83 | (a) | 6.06 | 1.21 | A | A | A | A |
| TNR59 | DIS59 | 84 | (a) | 6.14 | 1.10 | A | A | A | A |
| TNR60 | DIS60 | 85 | (a) | 6.41 | 1.13 | A | A | A | A |
| TNR61 | DIS61 | 86 | (a) | 6.38 | 1.15 | A | A | A | A |
| TNR62 | DIS62 | 87 | (a) | 6.48 | 1.20 | A | A | A | A |
| TNR63 | DIS63 | 88 | (a) | 6.23 | 1.16 | A | A | A | A |
| TNR64 | DIS64 | 89 | (a) | 6.21 | 1.17 | A | A | A | A |
| TNR65 | DIS65 | 90 | (a) | 6.08 | 1.32 | A | A | A | A |
| TNR66 | DIS66 | 91 | (a) | 6.17 | 1.15 | A | A | A | A |
| TNR67 | DIS67 | 92 | (a) | 6.29 | 1.21 | A | A | A | A |
| TNR68 | DIS68 | 93 | (a) | 6.20 | 1.15 | A | A | A | A |
| TNR69 | DIS69 | 94 | (a) | 6.16 | 1.39 | A | A | A | A |
| TNR70 | DIS70 | 95 | (a) | 6.30 | 1.31 | A | A | A | A |
| TNR71 | DIS71 | 96 | (a) | 6.26 | 1.22 | A | A | A | A |
| TNR72 | DIS72 | 26 | (b) | 6.41 | 1.09 | B | B | B | B |
| TNR73 | DIS73 | 26 | (c) | 6.16 | 1.15 | B | B | B | B |
| TNR74 | DIS74 | None | (a) | 6.42 | 1.43 | — | D | D | D |
| TNR75 | DIS75 | None | (b) | 6.28 | 1.32 | — | D | D | D |
| TNR76 | DIS76 | None | (c) | 6.26 | 1.21 | — | D | D | D |
| TNR77 | DIS77 | Comparative compound 1 | (a) | 6.69 | 1.19 | D | D | D | D |
| TNR78 | DIS78 | Comparative compound 2 | (a) | 6.52 | 1.21 | D | D | D | D |

TABLE 4-2-continued

| Evaluation results of toner by suspension polymerization method of invention | | | | | | | | | |
|---|---|---|---|---|---|---|---|---|---|
| | Carbon black | | | Toner particles | | | | | |
| Toner | dispersion liquid | Com-pound | Carbon black | D4 [μm] | D4/D1 | Coloring power | Fogging [N/N] | Fogging [H/H] | Transfer-ability |
| TNR79 | DIS79 | Comparative compound 3 | (a) | 6.61 | 1.18 | D | D | D | D |

TABLE 5-1

| Evaluation results of toner by suspension granulation method of invention | | | | | | | | |
|---|---|---|---|---|---|---|---|---|
| | | | Toner particles | | | | | |
| Toner | Compound | Carbon black | D4 [μm] | D4/D1 | Coloring power | Fogging [N/N] | Fogging [H/H] | Transferability |
| TNR80 | 26 | (a) | 6.18 | 1.20 | A | A | A | A |
| TNR81 | 27 | (a) | 6.35 | 1.25 | A | A | A | A |
| TNR82 | 28 | (a) | 6.32 | 1.15 | A | A | A | A |
| TNR83 | 29 | (a) | 6.25 | 1.19 | A | A | A | A |
| TNR84 | 30 | (a) | 6.11 | 1.25 | A | A | A | A |
| TNR85 | 31 | (a) | 6.30 | 1.20 | A | A | A | A |
| TNR86 | 32 | (a) | 6.38 | 1.15 | A | A | A | A |
| TNR87 | 33 | (a) | 6.40 | 1.23 | A | A | A | A |
| TNR88 | 34 | (a) | 6.26 | 1.11 | A | A | A | A |
| TNR89 | 35 | (a) | 6.21 | 1.16 | A | A | A | A |
| TNR90 | 36 | (a) | 6.34 | 1.20 | A | A | A | A |
| TNR91 | 37 | (a) | 6.22 | 1.18 | A | A | A | A |
| TNR92 | 38 | (a) | 6.13 | 1.19 | A | A | A | A |
| TNR93 | 39 | (a) | 6.09 | 1.25 | A | A | A | A |
| TNR94 | 40 | (a) | 6.20 | 1.24 | A | A | A | A |
| TNR95 | 41 | (a) | 6.12 | 1.14 | A | A | A | A |
| TNR96 | 42 | (a) | 6.13 | 1.20 | A | A | A | A |
| TNR97 | 43 | (a) | 6.22 | 1.30 | A | A | A | A |
| TNR98 | 44 | (a) | 6.15 | 1.21 | A | A | A | A |
| TNR99 | 45 | (a) | 6.32 | 1.13 | A | A | A | A |
| TNR100 | 46 | (a) | 6.20 | 1.19 | A | A | A | A |
| TNR101 | 47 | (a) | 6.25 | 1.25 | A | A | A | A |
| TNR102 | 48 | (a) | 6.16 | 1.22 | A | A | A | A |
| TNR103 | 49 | (a) | 6.22 | 1.32 | A | A | A | A |
| TNR104 | 50 | (a) | 6.25 | 1.24 | A | A | A | A |
| TNR105 | 51 | (a) | 6.34 | 1.20 | A | A | A | A |
| TNR106 | 52 | (a) | 6.09 | 1.30 | A | A | A | A |
| TNR107 | 53 | (a) | 6.30 | 1.21 | A | A | A | A |
| TNR108 | 54 | (a) | 6.13 | 1.23 | A | A | A | A |
| TNR109 | 55 | (a) | 6.24 | 1.18 | A | A | A | A |
| TNR110 | 56 | (a) | 6.31 | 1.32 | A | A | A | A |
| TNR111 | 57 | (a) | 6.05 | 1.21 | A | A | A | A |
| TNR112 | 58 | (a) | 6.32 | 1.31 | A | A | A | A |
| TNR113 | 59 | (a) | 6.23 | 1.30 | A | A | A | A |
| TNR114 | 60 | (a) | 6.18 | 1.25 | A | A | A | A |
| TNR115 | 61 | (a) | 6.27 | 1.31 | A | A | A | A |
| TNR116 | 62 | (a) | 6.21 | 1.43 | A | A | A | A |
| TNR117 | 63 | (a) | 6.10 | 1.31 | A | A | A | A |
| TNR118 | 64 | (a) | 6.25 | 1.26 | A | A | A | A |

TABLE 5-2

| Evaluation results of toner by suspension granulation method of invention | | | | | | | | |
|---|---|---|---|---|---|---|---|---|
| | | | Toner particles | | | | | |
| Toner | Com-pound | Carbon black | D4 [μm] | D4/D1 | Coloring power | Fogging [N/N] | Fogging [H/H] | Transfer-ability |
| TNR119 | 65 | (a) | 6.31 | 1.29 | A | A | A | A |
| TNR120 | 66 | (a) | 6.50 | 1.10 | A | A | A | A |
| TNR121 | 67 | (a) | 6.28 | 1.36 | A | A | A | A |

TABLE 5-2-continued

| Evaluation results of toner by suspension granulation method of invention | | | | | | | | |
|---|---|---|---|---|---|---|---|---|
| | | | Toner particles | | | | | |
| Toner | Compound | Carbon black | D4 [μm] | D4/D1 | Coloring power | Fogging [N/N] | Fogging [H/H] | Transferability |
| TNR122 | 68 | (a) | 6.19 | 1.31 | A | A | A | A |
| TNR123 | 69 | (a) | 6.13 | 1.13 | A | A | A | A |
| TNR124 | 70 | (a) | 6.33 | 1.20 | A | A | A | A |
| TNR125 | 71 | (a) | 6.35 | 1.35 | A | A | A | A |
| TNR126 | 72 | (a) | 6.47 | 1.12 | A | A | A | A |
| TNR127 | 73 | (a) | 6.23 | 1.13 | A | A | A | A |
| TNR128 | 74 | (a) | 6.08 | 1.19 | A | A | A | A |
| TNR129 | 75 | (a) | 6.42 | 1.35 | A | A | A | A |
| TNR130 | 76 | (a) | 6.39 | 1.24 | A | A | A | A |
| TNR131 | 77 | (a) | 6.30 | 1.33 | A | A | A | A |
| TNR132 | 78 | (a) | 6.28 | 1.20 | A | A | A | A |
| TNR133 | 79 | (a) | 6.10 | 1.17 | A | A | A | A |
| TNR134 | 80 | (a) | 6.23 | 1.16 | A | A | A | A |
| TNR135 | 81 | (a) | 6.08 | 1.21 | A | A | A | A |
| TNR136 | 82 | (a) | 6.31 | 1.16 | A | A | A | A |
| TNR137 | 83 | (a) | 6.40 | 1.11 | A | A | A | A |
| TNR138 | 84 | (a) | 6.38 | 1.06 | A | A | A | A |
| TNR139 | 85 | (a) | 6.32 | 1.03 | A | A | A | A |
| TNR140 | 86 | (a) | 6.31 | 1.09 | A | A | A | A |
| TNR141 | 87 | (a) | 6.46 | 1.38 | A | A | A | A |
| TNR142 | 88 | (a) | 6.30 | 1.38 | A | A | A | A |
| TNR143 | 89 | (a) | 6.32 | 1.27 | A | A | A | A |
| TNR144 | 90 | (a) | 6.10 | 1.34 | A | A | A | A |
| TNR145 | 91 | (a) | 6.16 | 1.26 | A | A | A | A |
| TNR146 | 92 | (a) | 6.25 | 1.25 | A | A | A | A |
| TNR147 | 93 | (a) | 6.24 | 1.31 | A | A | A | A |
| TNR148 | 94 | (a) | 6.11 | 1.25 | A | A | A | A |
| TNR149 | 95 | (a) | 6.32 | 1.26 | A | A | A | A |
| TNR150 | 96 | (a) | 6.28 | 1.32 | A | A | A | A |
| TNR151 | 26 | (b) | 6.25 | 1.37 | B | B | B | B |
| TNR152 | 26 | (c) | 6.38 | 1.29 | B | B | B | B |
| TNR153 | None | (a) | 6.50 | 1.30 | — | D | D | D |
| TNR154 | None | (b) | 6.29 | 1.35 | — | D | D | D |
| TNR155 | None | (c) | 6.21 | 1.39 | — | D | D | D |
| TNR156 | Comparative compound 1 | (a) | 6.54 | 1.26 | D | D | D | D |
| TNR157 | Comparative compound 2 | (a) | 6.59 | 1.24 | D | D | D | D |
| TNR158 | Comparative compound 3 | (a) | 6.54 | 1.28 | D | D | D | D |

Evaluation of Carbon Black Dispersibility in Toner

The cross section of the synthesized black toner was formed using a cross section polisher SM-09010 [manufactured by JEOL Co., Ltd.], and then carbon black of the cross section of the toner was observed with a scanning electron microscope (hereinafter abbreviated as SEM) S-4800 [manufactured by Hitachi High-Technologies Corporation]. A cross section SEM photograph of the toner TNR16 is shown in FIG. 5 and a cross section SEM photograph of the toner TNR74 is shown in FIG. 6.

As is clear from Table 3, it was confirmed that, by the use of the compound having the azo skeleton unit, the dispersibility of the carbon black in the binder resin improves.

As is clear from Tables 4-1 to 4-2, it was confirmed that, by the use of the compound having the azo skeleton unit, the black toners in which the dispersibility of the carbon black in the binder resin improves and the coloring power is good are provided. Moreover, it was confirmed that, by the use of the compound having the azo skeleton unit, the black toners in which fogging is suppressed and the transfer efficiency is high are provided. As is clear from Tables 5-1 to 5-2, similarly also in a suspension granulation method, the black toners in which the dispersibility of the carbon black in the binder resin improves and the coloring power is good are provided and the black toners in which fogging is suppressed and the transfer efficiency is high are provided.

Figure 5:
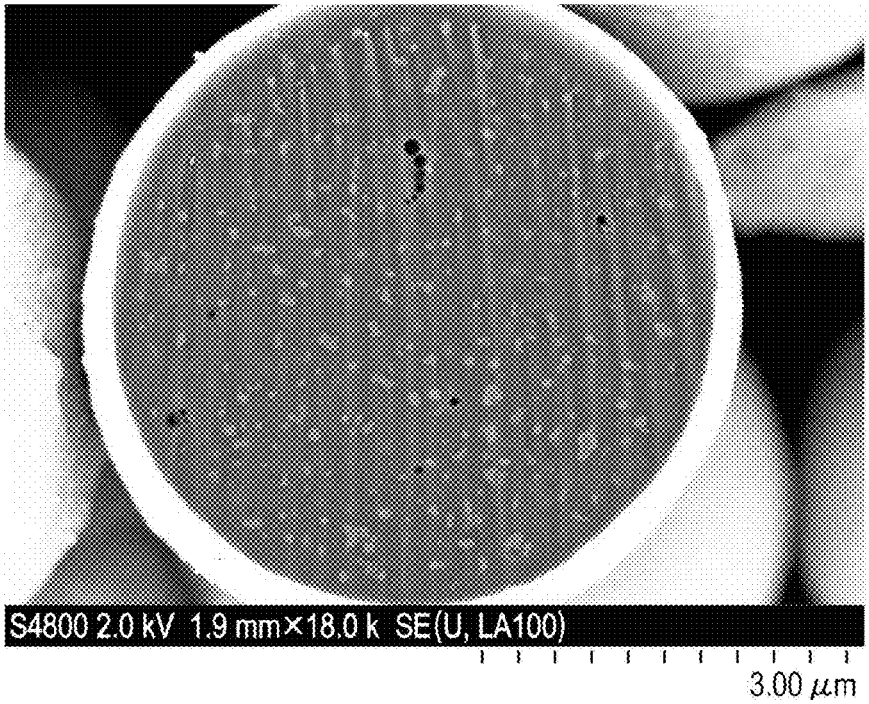
FIG. 5 is a scanning electron microscope photograph of the cross section of a toner (TNR16) of the invention.
Figure 6:
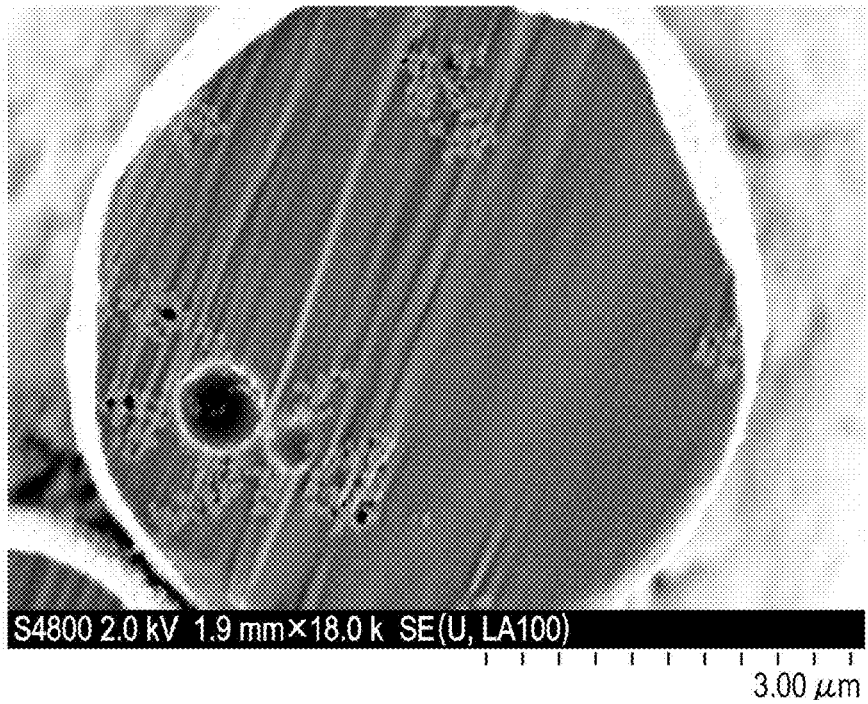
FIG. 6 is a scanning electron microscope photograph of the cross section of a comparative toner (TNR74).

As is clear from FIGS. 5 and 6, it was confirmed that, by the use of the compound having the azo skeleton unit, the carbon black is favorably dispersed also in the toners.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-043071 filed Feb. 29, 2012, which is hereby incorporated by reference herein in its entirety.

What is claimed is:

1. A black toner, comprising toner particles, each of which contains a binder resin, a compound and a carbon black, the compound has a structure of which a polymer portion having a monomer unit represented by the Formula (2) is bound to a structure represented by Formula (1);

Formula (1)

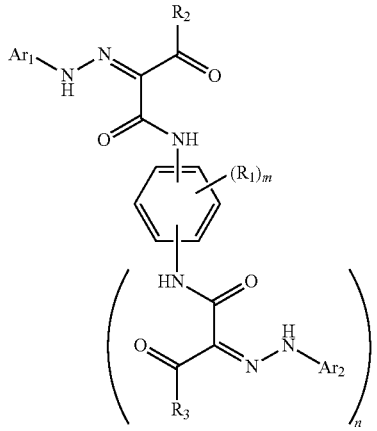

wherein, in Formula (1), at least one of $R_2$, $R_3$, $Ar_1$, and $Ar_2$ is bound to the polymer portion directly or through a linking group, wherein each $R_1$ independently represents a hydrogen atom, a halogen atom, an alkyl group, an alkoxy group, a trifluoromethyl group, a cyano group, or a hydroxyl group, $R_2$ and $R_3$ not bound to the polymer portion independently represent a monovalent group selected from the group consisting of an alkyl group, a phenyl group, an $OR_4$ group, and an $NR_5R_6$ group and $R_4$ to $R_6$ independently represent a hydrogen atom, an alkyl group, a phenyl group, or an aralkyl group, $Ar_1$ and $Ar_2$ not bound to the polymer portion independently represent an aryl group, wherein any one of $R_2$ and $R_3$, $Ar_1$, and $Ar_2$ bound to the polymer portion independently represents a divalent group of which a hydrogen atom is removed from the corresponding monovalent group of any one of $R_2$ and $R_3$, any one of $Ar_1$ and $Ar_2$ bound to the polymer portion independently represents a divalent group of which a hydrogen atom is removed from the corresponding aryl group of any one of $Ar_1$ and $Ar_2$, m represents an integer of 3 or 4, n represents an integer of 1 or 2, and n+m is 5; and Formula (2)

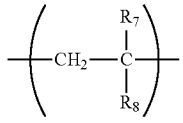

in Formula (2), $R_7$ represents a hydrogen atom or an alkyl group, and $R_8$ represents a phenyl group, a carboxyl group, a carboxylic acid ester group, or a carboxylic acid amide group.

2. The black toner according to claim 1, wherein the structure represented by Formula (1) is represented by the following general Formula (3):

Formula (3)

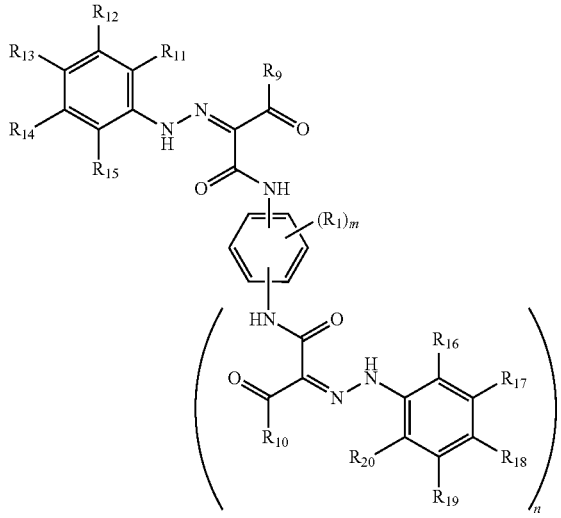

wherein, in Formula (3), $R_1$ each independently represents a hydrogen atom, a halogen atom, an alkyl group, an alkoxy group, a trifluoromethyl group, a cyano group, or a hydroxyl group, $R_9$ and $R_{10}$ independently represent an alkyl group, a phenyl group, an $OR_4$ group, or an $NR_5R_6$ group ($R_4$ to $R_6$ each independently represent a hydrogen atom, an alkyl group, a phenyl group, or an aralkyl group), $R_{11}$ to $R_{20}$ independently represent a linking group or a monovalent group selected from the group consisting of a hydrogen atom, a $COOR_{21}$ group, and a $CONR_{22}R_{23}$ group and $R_{21}$ to $R_{23}$ each independently represent a hydrogen atom or an alkyl group, wherein at least one of $R_{11}$ to $R_{20}$ is the linking group that binds to the polymer portion, m represents an integer of 3 or 4, n represents an integer of 1 or 2, and n+m is 5.

3. The black toner according to claim 1, wherein the structure represented by Formula (1) is represented by the following general Formula (4):

Formula (4)

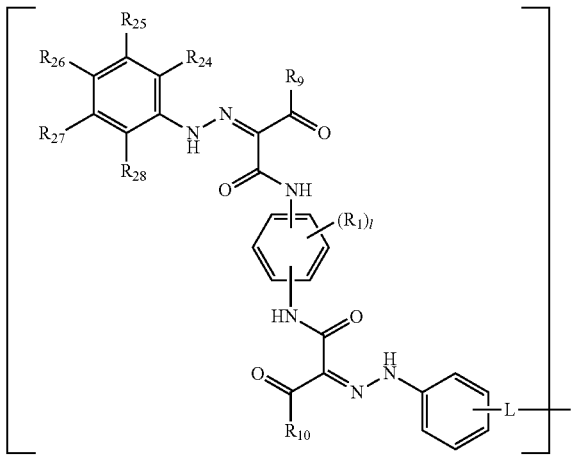

wherein, in Formula (4), $R_1$ each independently represents a hydrogen atom, a halogen atom, an alkyl group, an alkoxy group, a trifluoromethyl group, a cyano group, or a hydroxyl group, $R_9$ and $R_{10}$ independently represent an alkyl group, a phenyl group, an $OR_4$ group, or an $NR_5R_6$ group; $R_4$ to $R_6$ each independently represent a hydrogen atom, an alkyl group, a phenyl group, or an aralkyl group, $R_{24}$ to $R_{28}$ independently represent a hydrogen atom, a $COOR_{21}$ group, or a $CONR_{22}R_{23}$ group; $R_{21}$ to $R_{23}$ independently represent a hydrogen atom or an alkyl group, I is 4, and L represents a divalent linking group that binds to the polymer portion.

4. The black toner according to claim 3, wherein the structure represented by Formula (1) is Formula (4), wherein, in Formula (4), at least one of $R_{24}$ to $R_{28}$ is a $COOR_{21}$ group or a $CONR_{22}R_{23}$ group; $R_{21}$ to $R_{23}$ independently represent a hydrogen atom or an alkyl group, and $R_1$ is a hydrogen atom.

5. The black toner according to claim 1, wherein the structure represented by Formula (1) is a structure represented by the following Formula (6):

Formula (6)

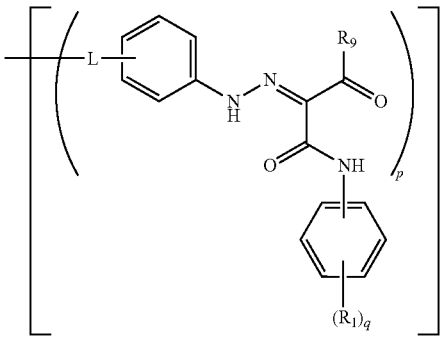

wherein, in Formula (6), each $R_1$ independently represents a hydrogen atom, a halogen atom, an alkyl group, an alkoxy group, a trifluoromethyl group, a cyano group, or a hydroxyl group, each $R_9$ independently represents an alkyl group, a phenyl group, an $OR_4$ group, or an $NR_5R_6$ group; $R_4$ to $R_6$ independently represent a hydrogen atom, an alkyl group, a phenyl group, or an aralkyl group, p represents an integer of 2 or 3, q represents an integer of 3 or 4, and p+q is 6, and L represents a divalent linking group that binds to the polymer portion.

6. The black toner according to claim 5, wherein the structure represented by Formula (1) is Formula (6), wherein, in Formula (6), $R_1$ is a hydrogen atom and q is 3 or 4.

7. The black toner according to claim 1, wherein at least one of $R_2$, $R_3$, $Ar_1$, and $Ar_2$ in formula (1) is bound to the polymer portion through a carboxylic acid ester bond or a carboxylic acid amide bond.

8. The black toner according to claim 1, wherein the toner particles are manufactured using a suspension polymerization method or a suspension granulation method.

* * * * *